US010515616B2

(12) United States Patent
Ua-Aphithorn

(10) Patent No.: US 10,515,616 B2
(45) Date of Patent: Dec. 24, 2019

(54) FREE BASS A SYSTEM

(71) Applicant: Tanate Ua-Aphithorn, Bangkok (TH)

(72) Inventor: Tanate Ua-Aphithorn, Bangkok (TH)

( * ) Notice: Subject to any disclaimer, the term of this patent is extended or adjusted under 35 U.S.C. 154(b) by 79 days.

(21) Appl. No.: 15/842,447

(22) Filed: Dec. 14, 2017

(65) Prior Publication Data

US 2018/0166052 A1 Jun. 14, 2018

Related U.S. Application Data

(60) Provisional application No. 62/434,403, filed on Dec. 14, 2016.

(51) Int. Cl.

| | |
|---|---|
| ***G10C 3/12*** | (2006.01) |
| ***G10H 1/34*** | (2006.01) |
| ***G10D 11/00*** | (2006.01) |

(52) U.S. Cl.

CPC ..... *G10H 1/34* (2013.01); *G10D 11/00* (2013.01); *G10H 1/344* (2013.01); *G10H 2210/571* (2013.01); *G10H 2220/231* (2013.01); *G10H 2220/251* (2013.01); *G10H 2230/245* (2013.01)

(58) Field of Classification Search

CPC .. G10D 11/00; G10H 1/344; G10H 2210/571; G10H 2220/231; G10H 2220/251; G10H 2230/245

USPC ..... 84/423 R

See application file for complete search history.

(56) References Cited

U.S. PATENT DOCUMENTS

| | | | | |
|---|---|---|---|---|
| 3,402,251 A * | 9/1968 | Bright | ..... | G10H 1/0033 84/676 |
| 3,776,089 A | 12/1973 | Cohen | | |
| 6,946,594 B2 * | 9/2005 | Bruti | ..... | G10H 1/02 84/376 EA |

FOREIGN PATENT DOCUMENTS

| | | |
|---|---|---|
| CN | 2273036 Y | 1/1998 |
| EP | 2420998 A1 | 2/2012 |
| FR | 2926390 A1 | 7/2009 |
| WO | 2009/035171 A1 | 3/2009 |

OTHER PUBLICATIONS

EPO, The European Extended Search Report dated Mar. 20, 2018 in European Patent Application No. EP17207446, 8 pages.

"Stradella Bass System", May 27, 2016, description extracted from Wikipedia (https://en.wikipedia.org/w/index.php?title=Stradella_bass_system&oldid=722299584), 5 pages.

* cited by examiner

*Primary Examiner* — Jianchun Qin

(74) *Attorney, Agent, or Firm* — Masuvalley & Partners

(57) ABSTRACT

An accordion includes a right hand play side, a left hand play side, a bellow provided between the right hand play side and the left hand play side. A plurality of columns of buttons provide on at least one of the right hand play side and the left hand play side. Each of the plurality of columns may have at least three buttons to which three single pitches are assigned, the three single pitches constituting a triad major chord. Embodiments of the present invention provide a user-friendly system for accordionists that can also cover more than 90% of the accordion songs being public in the world.

28 Claims, 22 Drawing Sheets

X = Any starting notes

FREE BASS A SYSTEM

This application claims the benefit of and is a non-provisional of U.S. Provisional Application Ser. No. 62/434,403 filed on Dec. 14, 2016, which is hereby expressly incorporated by reference in its entirety for all purposes.

TECHNICAL FIELD

The present invention relates to an accordion and more specifically to an electronic accordion.

BACKGROUND OF THE INVENTION

In an ideal world, a musical instrument such as an accordion is played very easily and friendly by the user. Unfortunately, this is not yet possible. For example, Staradella system cannot serve all purposes. So there are many inventions of the freebass system. Depending on the skill or level of an accordionist, in a performance by an accordionist it is very important to play very good music. However, sometime the performance of the accordionist is limited by the current accordion.

The limitation in the accordion is note layout patterns. The note layout patterns have many layout patterns which can be selected according to accordionist's characteristic such as, for example, physiology of accordionist (left hand, fingers and wrist) and accordionist's skill and, or song format such as speed of tempo, beats, key of the note and Scale. However, all of the note layout patterns cannot be a right answer for all accordionists. This is mainly because this note layout pattern has been played for over 100 years. Old traditional accordion patterns have to be improved by changing from a mechanism accordion to an electronic accordion. However, the electronic accordions are still using the same note layout pattern of the mechanism accordion. By using old traditional accordion patterns, the players cannot choose a variety of songs with more desired song selections using an easy note layout patterns. Now a days, there are many new songs being public in the world, but they are not covered by using the old traditional accordion patterns. This leads to a very limited song selections for accordionists.

SUMMARY OF THE INVENTION

In accordance with an aspect of the present invention, an accordion may include a right hand play side, a left hand play side, and a bellow provided between the right hand play side and the left hand play side. The accordion further includes a plurality of columns of buttons which are provided on at least one of the right hand play side and the left hand play side. Each of the plurality of columns has at least three buttons to which three single pitches are assigned, said three single pitches constituting a triad major chord.

According to another aspect of the present invention, an accordion may include a right hand play side, a left hand play side, a bellow provided between the right hand play side and the left hand play side, and a plurality of columns of buttons which are provided on at least one of the right hand play side and the left hand play side. The accordion further includes a controller configured to assign three single pitches to at least three buttons of each of the plurality of columns, the three single pitches constituting a triad major chord.

Embodiments of the present invention provide a user-friendly system for accordionists that can also cover more than 90% of the accordion songs being public in the world.

BRIEF DESCRIPTION OF THE DRAWINGS

The present disclosure is described in conjunction with the appended figures.

DETAILED DESCRIPTION OF THE INVENTION

Figure 1:
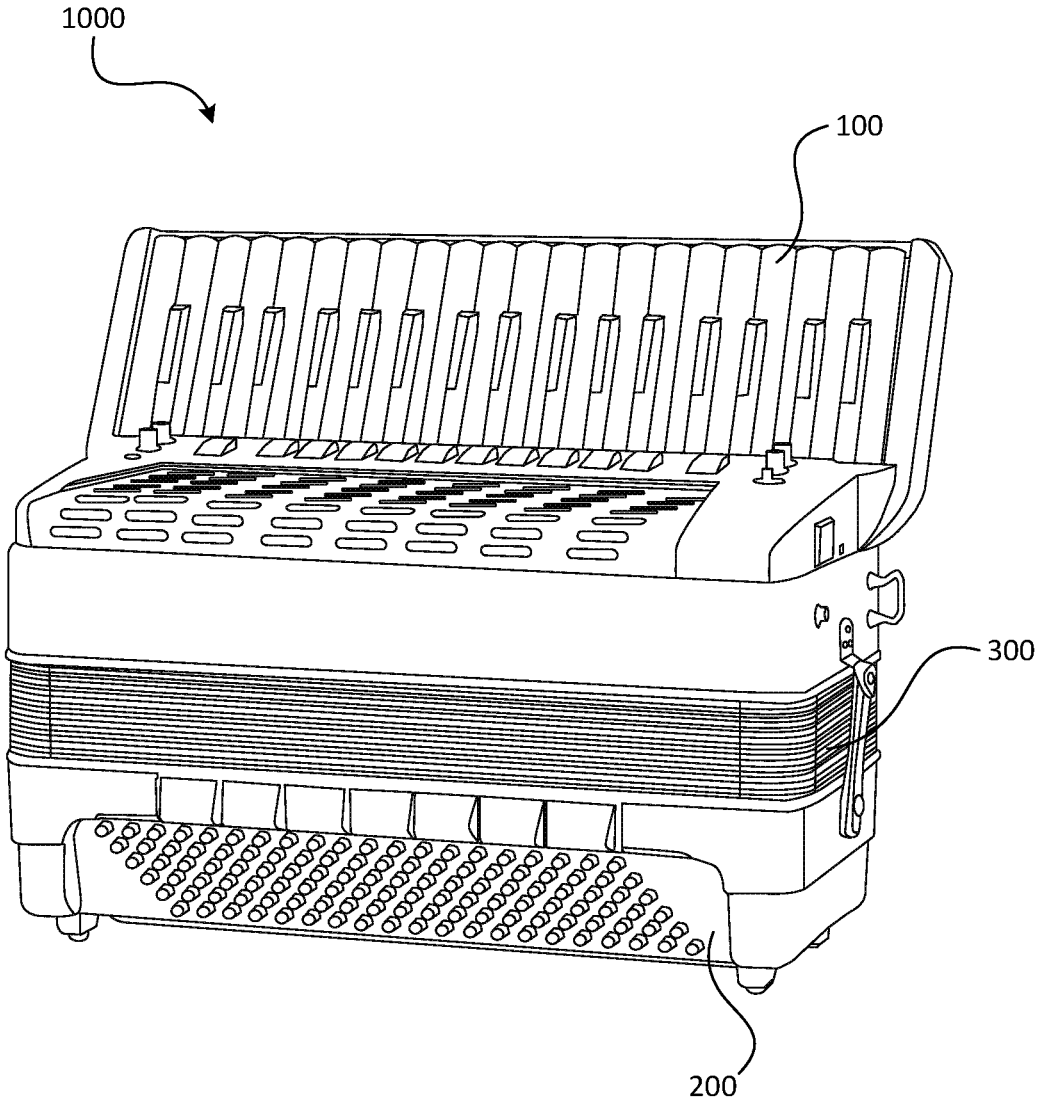
FIG. 1 is a diagram illustrating an overall configuration of accordion of the present invention.

Embodiments of the present invention will be described hereinafter in detail with reference to the accompanying drawings. FIG. 1 illustrates a perspective view of an embodiment of an accordion 1000. As can be seen in this figure, the accordion 1000 has a right hand play side 100, a left hand play side 200, and a bellow 300. As well known in the art, the accordion 1000 is a musical instrument which is played by compressing or expanding the bellow 300 while pressing buttons or keys on the right hand play side 100 and/or the left hand play side 200. The bellow 300 allows air to flow across strips of brass or steel, called reeds, which vibrate in order to produce sounds inside the accordion's body.

The right hand play side 100 uses a musical keyboard similar to a piano-style keyboard and/or an organ-style keyboard by compressing or expanding the bellow 300 while pressing button or keys on the right hand play side 100. The right hand play side 100 is normally used for playing the melody. Some use a button layout arranged in one way or another, while others use the piano-style keyboard and/or the organ-style keyboard. Each system has different claimed benefits by those who prefer it.

Figure 2:
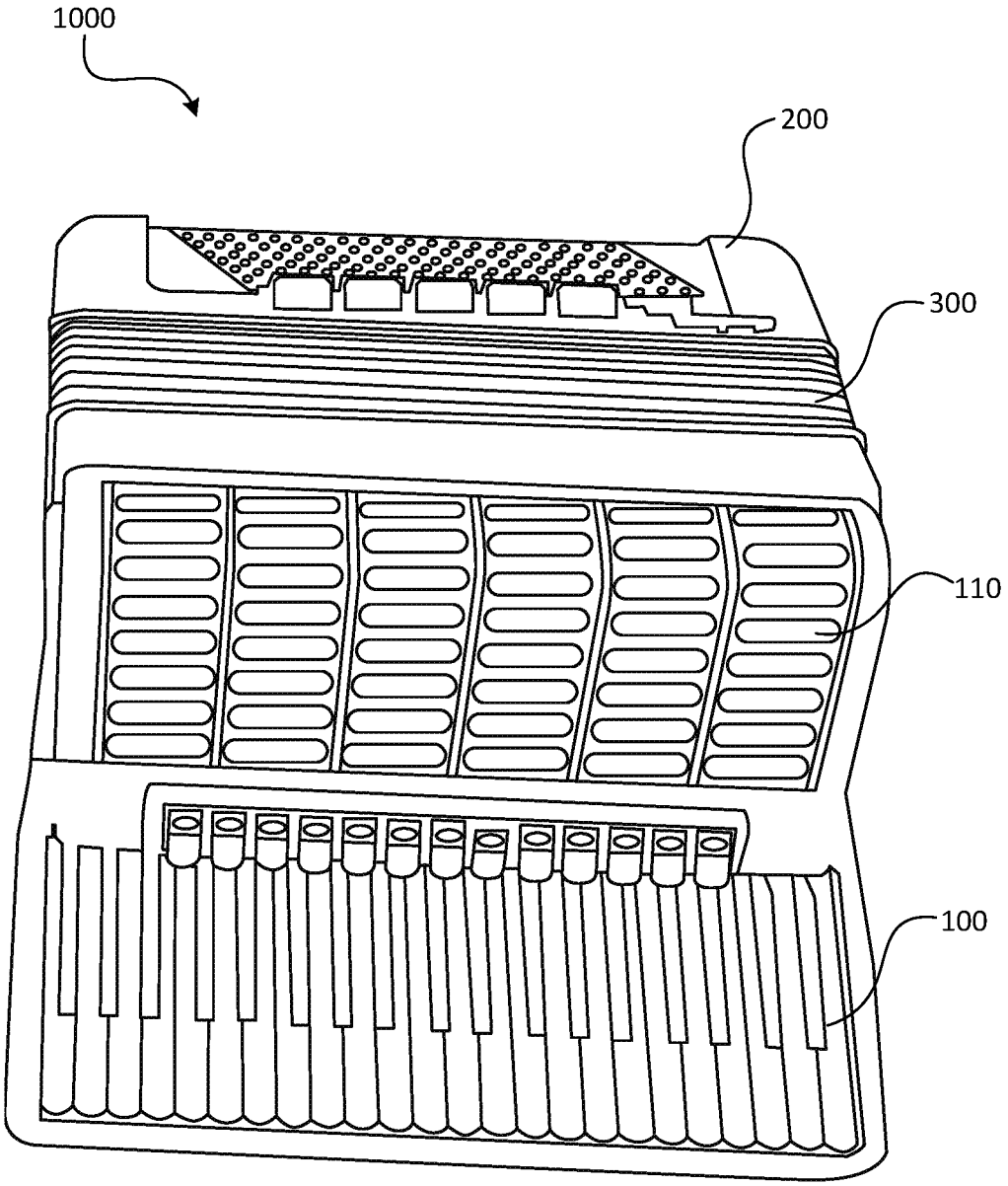
FIG. 2 is a diagram illustrating a right hand configuration of accordion of the present invention.

The left hand play side 200 includes buttons or keys on the left hand play side 200. The left hand play side 200 is normally used for playing the accompaniment. These almost always use distinct bass buttons and often have buttons with concavities or studs to help an accordionist navigate the layout despite not being able to see the buttons while playing, Referring next to FIG. 2, a perspective view of the right hand play side 100 is depicted. As shown in the drawing, the right hand play side 100, according to the embodiment of the present invention, includes a musical keyboard similar to a piano-style keyboard and/or an organ-style keyboard. The right hand play side 100 further includes a speaker 110. The speaker 110 is a channel for sound by compressing or expanding the bellow 300 while pressing button or keys on the right hand play side 100 and/or left hand play side 200.

Figure 3:
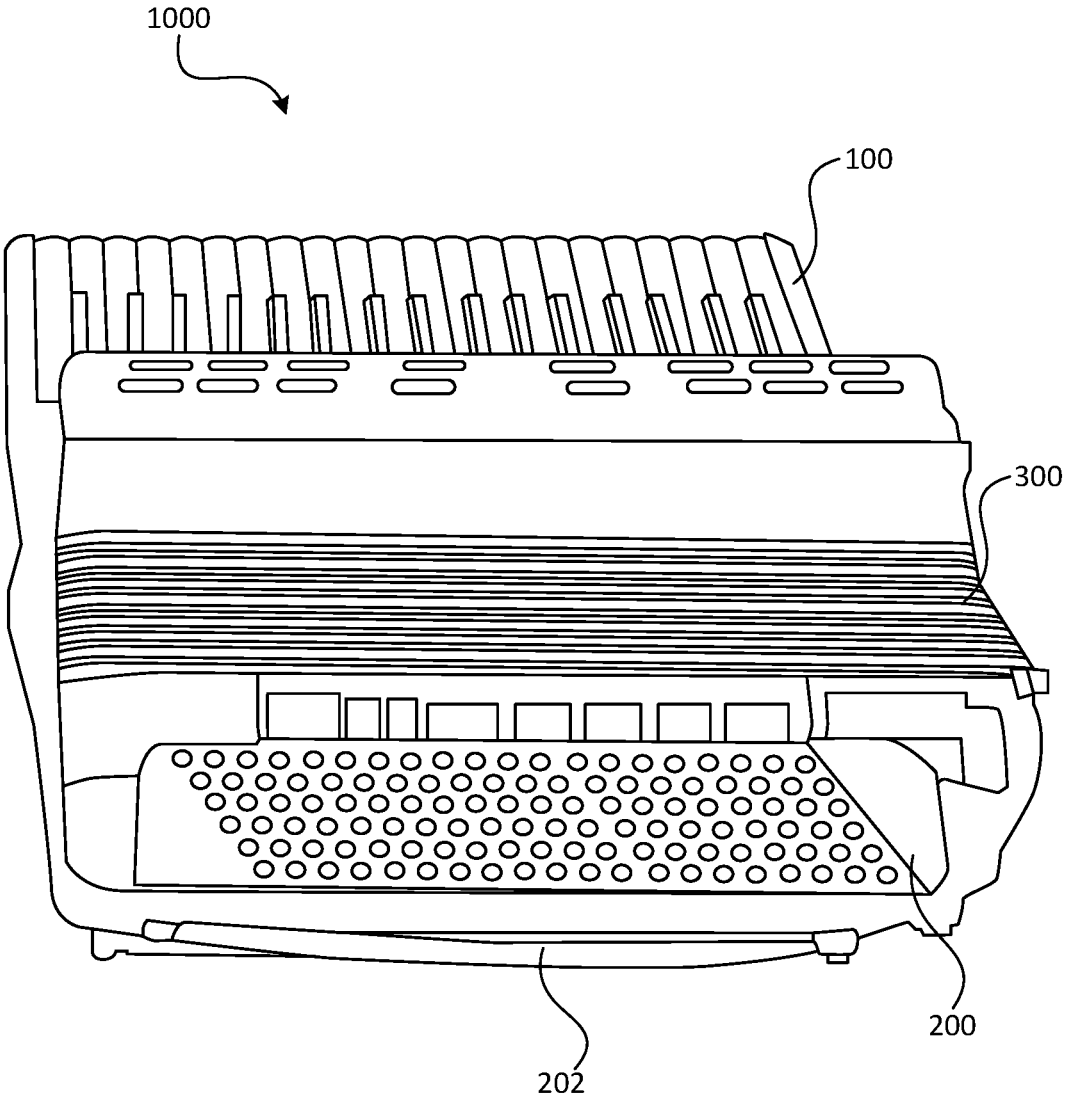
FIG. 3 is a diagram illustrating a left hand configuration of accordion of the present invention.

FIG. 3 illustrates a perspective view of an embodiment of a left hand configuration of accordion 1000 of the present invention. This figure is different from FIG. 2 in that the left hand play side 100 of this embodiment includes a musical keyboard similar to a piano-style keyboard and/or an organ-style keyboard and speaker 110. The speaker 110 is a channel for sound by compressing or expanding the bellow 300 while pressing button or keys in the right 100 and/or left hand play side 200. These components are the same as those illustrated in FIG. 2.

Figure 4:
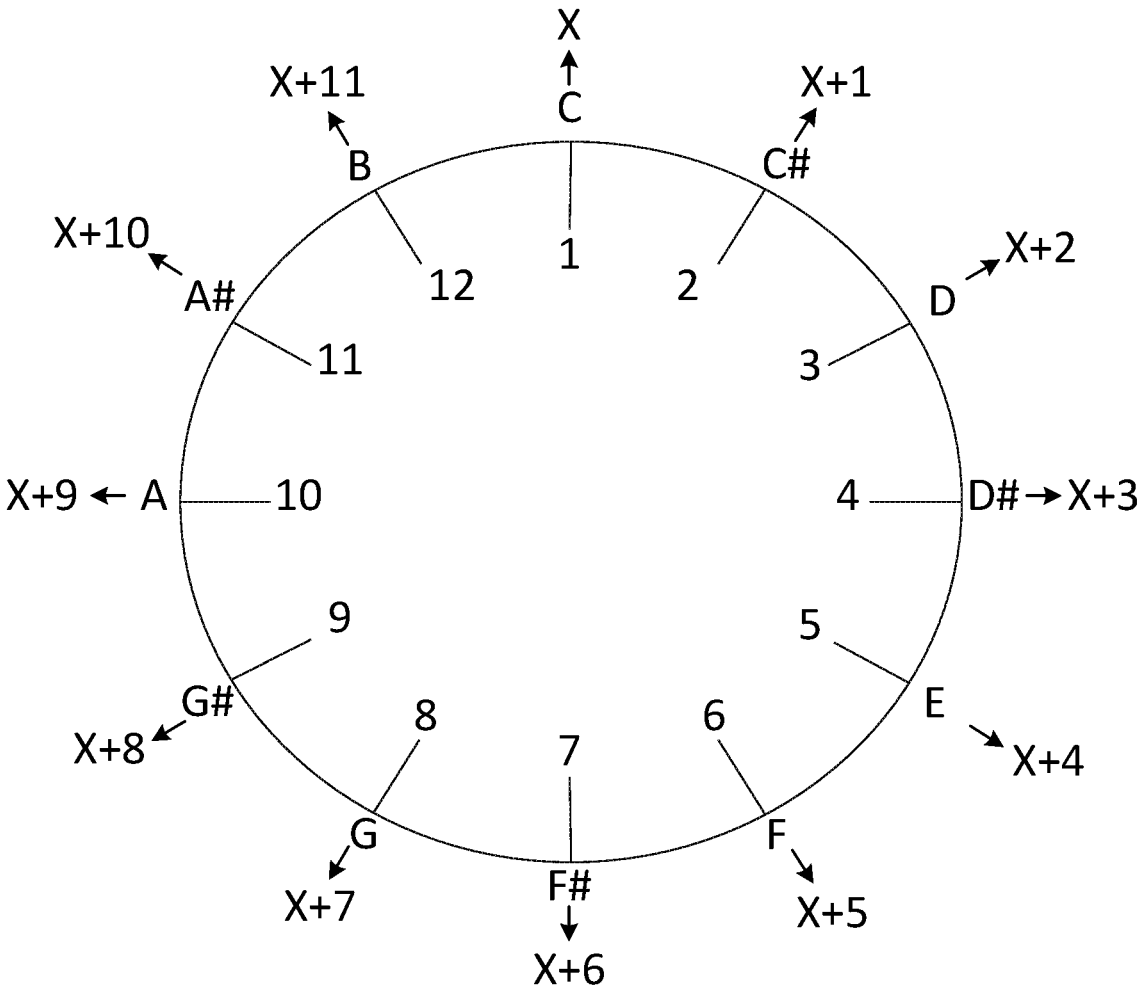
FIG. 4 is a diagram illustrating an exploded perspective view of a functional equation.

Referring next to FIG. 4, an exploded perspective view of a functional equation is schematically depicted. As shown in the drawing, the functional equation according to the embodiments of the present invention may include a function to explain a method of this invention. The functional equation is based on a clock that has a cycle and 12 numbers. The 12 numbers start from 1 to 12. Arrangements of the 12 numbers are clockwise. The 12 numbers are arranged inside the circle.

Figure 5:
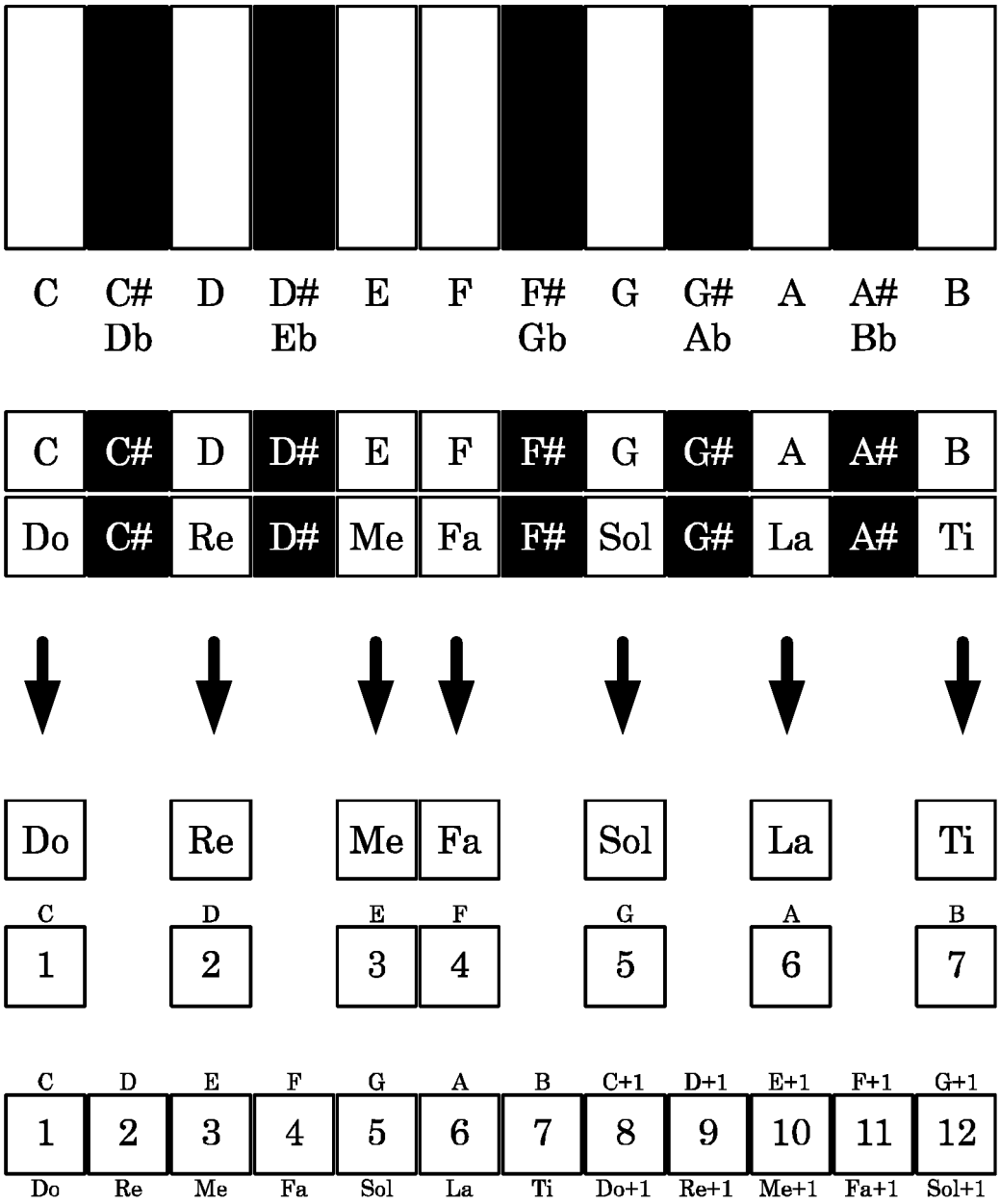
FIG. 5 is a diagram illustrating the Chromatic Scale and Major Scale.

The functional equation has notes on the outside of the cycle. A first row outside of the cycle shows the 12 notes which are C note key (C chromatic Scale) as shown in FIG. 5. The chromatic Scale has 12 notes, and uses ever half-tone/semitone position. By way of example, the C chromatic Scale may include C, C#, D, D#, E, F, F#, G, G#, A, A# and B. The arrangement of C chromatic Scale starts on the C note at a number 1 position. The direction of the C chromatic Scale is clockwise. Thus, a second note is a C# note at a number 2 position, a third note is a D note at a number 3 position, . . . a last note is a B note at a number 12 position. When the direction is reached one round or one loop, it will be counted as one octave. The functional equation has a last explanation on the outside of the cycle. A second row outside of the cycle illustrates an X function. The X function has a method for arranging 12 notes. A direction of X function is clockwise by X, X+1, X−2, X+3, X−4, X+5, X+6, X+7, X+8, X+9, X+10 and X+1. In this embodiment, the X is placed in a starting note position. The starting note X can be any note of this position.

The set of 12 notes called "Chromatic Scale" is rarely used to compose songs. There are some experimental songs that may use chromatic scale in all part but the songs are not popular for public audience. To compose a song, Chromatic scale is used only partially for making the sounds or songs more interesting. Human's ears prefer to hear pleasant songs rather than atonal music (unpleasant song). All kind of western music mainly use "Major Scale" or "Minor Scale" to compose songs. About 98%-99% of the produced songs in the world use only these 2 scales.

FIG. 5 illustrates the Chromatic Scale. The piano keyboard is one of the classic ways of viewing the Chromatic Scale. The white keys play the simple notes and the black keys play the altered notes which add sharps or flats. The whole pattern of note names repeats after every 12 notes with different octave. The sequence of white keys consists of C, C#, D, D#, E, F, F#, G, A, A# and B. C is corresponding to Do note, D is corresponding to Re note, E is corresponding to Me note, F is corresponding to Fa note, G is corresponding to Sol note, A is corresponding to La note, B is corresponding to Ti note. Most classical western music is built around the octave (do-re-mi). Chromatic scales, however, are often used in composing modern, atonal music. They are also commonly used in jazz compositions. Some Indian and Chinese music are also built around a 12-note scale. It's important to note that contemporary symphonic instruments are almost always tuned to a scale of 12 equal tones. In the past, however, even western instruments were tuned in different ways, with unequal gaps between tones.

In Major scale, The seven-note Major scale is such a dominant force in western music that it provides the foundation for the naming of notes and chords, even with music using different scale types. When a scale type is played from a particular starting note (also known as the root or key note) it becomes a scale. Scales of a certain type may contain 12 different sets of notes, depending on the starting note. The scale of a song defines its melodic structure, by identifying which notes can be used in the melody (or tune) of the song. The scale also strongly influences the harmonic structure of a song, mainly because the same notes are generally used for building chords to accompany the melody. This may not be a fixed rule, as many songs use notes outside of their scale, but these are considered to be exceptions. They are called "accidental notes", and in music sheets they are specially marked to show that they do not belong to the scale.

Figure 6:
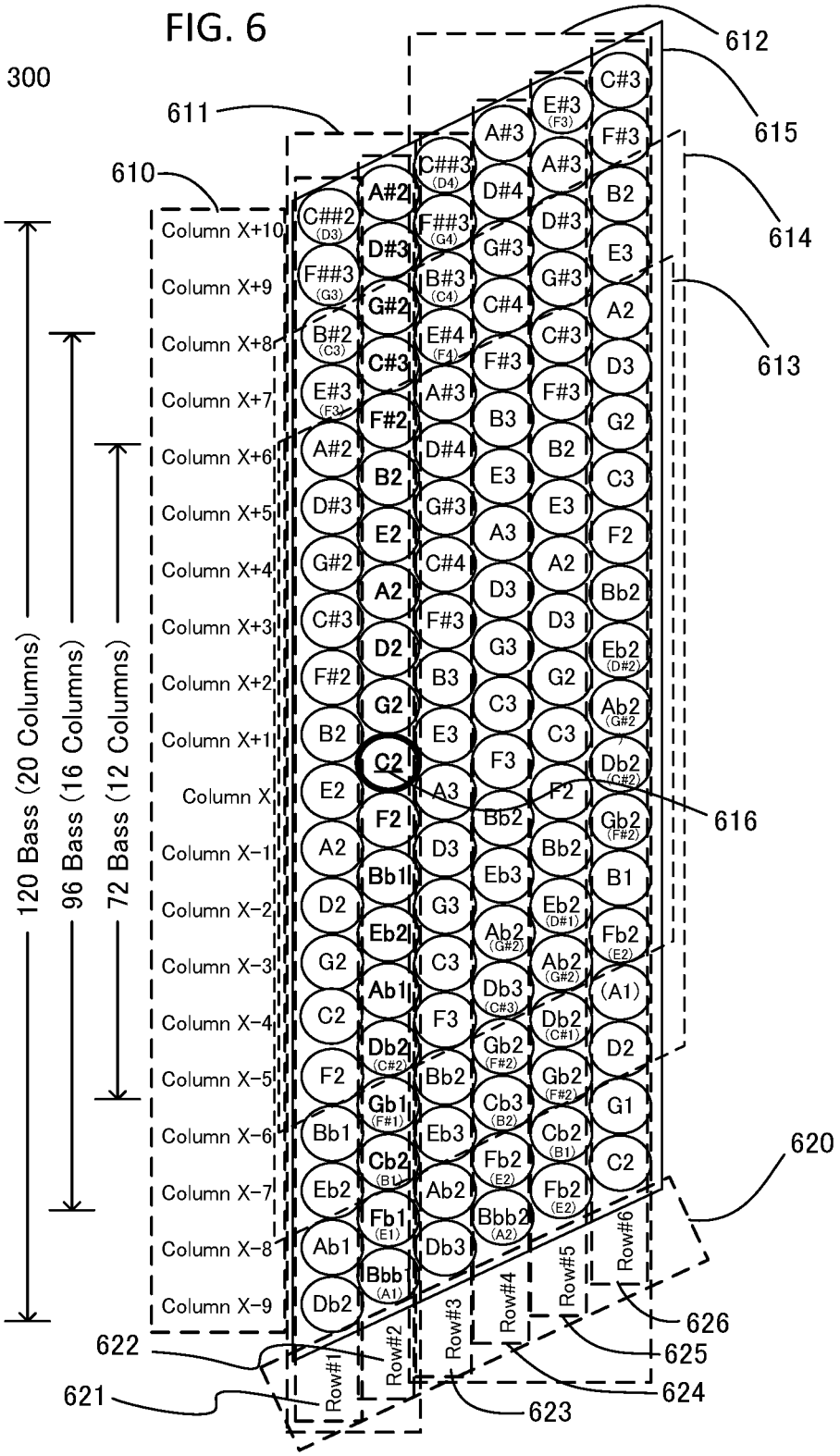
FIG. 6 is a diagram illustrating an example of chord tone pattern which contains single note and low note chart.

FIG. 6 illustrates an exploded view of the Chord Tone Pattern. As shown in this figure, the Chord Tone Pattern of the present embodiment includes six rows of buttons 620. The six rows of button 620 are arranged in lines in a direction substantially orthogonal to an expansion and contraction direction of the bellow 300. Columns 610 contain from 12 columns 613, 16 columns 614 and 20 columns 615. The six rows of button 620 with 12 columns 613 contain about 72 basses. The six rows of button 620 with 16 columns 614 contain about 96 basses. The six rows of button 620 with 20 columns 615 contain about 120 basses. The six rows of buttons 620 include 12 columns 613 consisting of X−5, X−4, X−3, X−2, X−1, X, X+1, X+2, X+3, X+4, X+5 and X+6. The six rows of buttons 620 include 16 columns 614 consisting of X−7, X−6, X−5, X−4, X−3, X−2, X−1, X, X+1, X+2, X+3, X+4, X+5, X+6, X+7 and X+8. The six rows of buttons 620 include 20 columns 615 consisting of X−9, X−8, X−7, X−6, X−5, X−4, X−3, X−2, X−1, X, X+1, X+2, X+3, X+4, X+5, X+6, X+7, X+8, X+9 and X+10. Row#1 621 and Row#2 622 are assigned to base notes 611. Row#3 623, Row#4 624, Row#5 625 and Row#6 626 are assigned to present chords 612 (triads).

As shown in the embodiment depicted in FIG. 6, for each buttons from the six rows of buttons 620 a number appears after a note. These numbers are octave numbers which are used for identifying the pitches in an octave. The octave number increases or decreases by one. A greater number refers to a higher octave while a smaller number refers to a lower octave. Though a "C4" is normally assigned as a middle C, a "C2" button 616 is a C Root note, which is assigned as a middle C and is located in Row#2 622 and Column X, in order to solve the problem when playing the triad with the close contiguous 3 fingers by arranging 3 notes of major triad or minor triad in the column. This "C2" button 616 allows more extension of directions both following the circle of fifths and the circle of fourths (Moving counter-clockwise in the direction of the circle of fifths).

The Row#1 621 includes up to 20 buttons of bass consisting of four flat notes, seven natural notes, seven sharp notes and two double-sharp notes. As shown in the embodiment depicted in FIG. 6, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X−2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 613 (72 buttons in 12 columns), the second pattern 614 (96 buttons in 16 columns) as well as the last pattern 615 (120 buttons in 20 columns). On the other hand, Eb2 (Column X−7), Bb1 (Column X−6), E#3 (F3) (Column X+7) and B#2(C3) (Column X+8) are additional notes from the first pattern 613, the second pattern 614 (96 buttons in 16 columns) as well as the last pattern 615 (120 buttons in 20 columns). Similarly, Db2 (Column X−9), Ab1 (Column X−8), F##3(G3) (Column X+9) and C##2 (D3) (Column X+10) are additional notes from the second pattern 614 (96 buttons in 16 columns) in the last pattern 615 (120 buttons in 20 columns). As such, there are 12 bass notes in the first pattern 613 (72 buttons in 12 columns), 16 bass notes in the second pattern 614 (96 buttons in 16 columns) and 20 bass notes in the last pattern 615 (120 buttons in 20 columns). The note formulation in 20 columns 610 of Row#1 621 is the 3$^{rd}$ note in major scale count from root (major third note).

The Row#2 622 includes 20 buttons of bass consisting of one double-flat note, seven flat notes, seven natural notes and five sharp notes. As shown in the embodiment depicted in FIG. 6, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 613 (72 buttons in 12 columns), the second pattern 614 (96 buttons in 16 columns) as well as the last pattern 615 (120 buttons in 20 columns). On the other hand, Cb2(B1) (Column X−7), Gb1(F#1) (Column X−6), C#3 (Column X+7) and G#2 (Column X+8) are additional notes from the first pattern 613, the second pattern 614 (96 buttons in 16 columns) as well as the last pattern 615 (120 buttons in 20 columns). Similarly, Bbb1(A1) (Column X−9), Fb1 (E1) (Column X−8), D#3 (Column X+9) and A#2 (Column X+10) are additional notes from the second pattern 614 (96 buttons in 16 columns) in the last pattern 615 (120 buttons in 20 columns). As such, there are 12 bass notes in the first pattern 613 (72 buttons in 12 columns), 16 bass notes in the second pattern 614 (96 buttons in 16 columns) and 20 bass notes in the last pattern 615 (120 buttons in 20 columns). The note formulation in 20 columns 610 of Row#2 622 is a root of scale and chord.

The Row#3 623 includes 20 buttons of preset chords (triads) consisting of four flat notes, seven natural notes, seven sharp notes and two double-sharp notes. As shown in the embodiment depicted in FIG. 6, Db3 is located in Column X−9; Ab2 is located in Column X−8; Eb3 is located in Column X−7; Bb2 is located in Column X−6; F3 is located in Column X−5; C3 is located in Column X−4; G3 is located in Column X−3; D3 is located in Column X−2; A3 is located in Column X−1; E3 is located in Column X (center); B3 is located in Column X+1; F#3 is located in Column X+2; C#4 is located in Column X+3; G#3 is located in Column X+4; D#4 is located in Column X+5; A#3 is located in Column X+6; E#4(F4) is located in Column X+7; B#3(C4) is located in Column X+8; F##3(G4) is located in Column X+9 and C##3(D4) is located in Column X+10. F3, C3, G3, D3, A3, E3, B3, F#3, C#4, G#3, D#4 and A#3 are elements of all patterns, i.e., the first pattern 613 (72 buttons in 12 columns), the second pattern 614 (96 buttons in 16 columns) as well as the last pattern 615 (120 buttons in 20 columns). On the other hand, Eb3 (Column X−7), Bb2 (Column X−6), E#4(F4) (Column X+7) and B#3(C4) (Column X+8) are additional notes from the first pattern 613, the second pattern 614 (96 buttons in 16 columns) as well as the last pattern 615 (120 buttons in 20 columns). Similarly, Db3 (Column X−9), Ab2 (Column X−8), F##3(G4) (Column X+9) and C##3(D4) (Column X+10) are additional notes from the second pattern 614 (96 buttons in 16 columns) in the last pattern 615 (120 buttons in 20 columns). As such, there are 12 preset chords (triads) in the first pattern 613 (72 buttons in 12 columns), 16 preset chords (triads) in the second pattern 614 (96 buttons in 16 columns) and 20 preset chords (triads) in the last pattern 615 (120 buttons in 20 columns). The note formulation in 20 columns 610 of Row#3 623 is the Major $10^{th}$ of scale, Major $3^{rd}$ note (major third of next higher octave).

The Row#4 624 includes 20 buttons of preset chords (triads) consisting of one double-flat note, seven flat notes, seven natural notes and five sharp notes. As shown in the embodiment depicted in FIG. 6, Bbb2(A2) is located in Column X−9; Fb2(E2) is located in Column X−8; Cb3(B2) is located in Column X−7; Gb2(F#2) is located in Column X−6; Db3(C#3) is located in Column X−5; Ab2(G#2) is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; F#3 is located in Column X+6; C#4 is located in Column X+7; G#3 is located in Column X+8; D#4 is located in Column X+9 and A#3 is located in Column X+10. Db3(C#3), Ab2(G#2), Eb3, Bb2, F3, C3, G3, D3, A3, E3, B3 and F#3 are elements of all patterns, i.e., the first pattern 613 (72 buttons in 12 columns), the second pattern 614 (96 buttons in 16 columns) as well as the last pattern 615 (120 buttons in 20 columns). On the other hand, Cb3(B2) (Column X−7), Gb2(F#2) (Column X−6), C#4 (Column X+7) and G#3 (Column X+8) are additional notes from the first pattern 613, the second pattern 614 (96 buttons in 16 columns) as well as the last pattern 615 (120 buttons in 20 columns). Similarly, Bbb2(A2) (Column X−9), Fb2(E2) (Column X−8), D#4 (Column X+9) and A#3 (Column X+10) are additional notes from the second pattern 614 (96 buttons in 16 columns) in the last pattern 615 (120 buttons in 20 columns). As such, there are 12 preset chords (triads) in the first pattern 613 (72 buttons in 12 columns), 16 preset chords (triads) in the second pattern 614 (96 buttons in 16 columns) and 20 preset chords (triads) in the last pattern 615 (120 buttons in 20 columns). The note formulation in 20 columns 610 of Row#4 624 is the $8^{th}$ common note (Octaved note).

The Row#5 625 includes 20 buttons of preset chords (triads) consisting of seven flat notes, seven natural notes and six sharp notes. As shown in the embodiment depicted in FIG. 6, Fb2(E2) is located in Column X−9; Cb2(B1) is located in Column X−8; Gb2(F#2) is located in Column X−7; Db2(C#1) is located in Column X−6; Ab2(G#2) is located in Column X−5; Eb2(D#1) is located in Column X−4; Bb2 is located in Column X−3; F2 is located in Column X−2; C3 is located in Column X−1; G2 is located in Column X (center); D3 is located in Column X+1; A2 is located in Column X+2; E3 is located in Column X+3; B2 is located in Column X+4; F#3 is located in Column X+5; C#3 is located in Column X+6; G#3 is located in Column X+7; D#3 is located in Column X+8; A#3 is located in Column X+9 and E#3(F3) is located in Column X+10. Ab2(G#2), Eb2(D#1), Bb2, F2, C3, G2, D3, A2, E3, B2, F#3 and C#3 are elements of all patterns, i.e., the first pattern 613 (72 buttons in 12 columns), the second pattern 614 (96 buttons in 16 columns) as well as the last pattern 615 (120 buttons in 20 columns). On the other hand, Gb2(F#2) (Column X−7), Db2(C#1) (Column X−6), G#3 (Column X+7) and D#3 (Column X+8) are additional notes from the first pattern 613, the second pattern 614 (96 buttons in 16 columns) as well as the last pattern 615 (120 buttons in 20 columns). Similarly, Fb2(E2) (Column X−9), Cb2(B1) (Column X−8), A#3 (Column X+9) and E#3(F3) (Column X+10) are additional notes from the second pattern 614 (96 buttons in 16 columns) in the last pattern 615 (120 buttons in 20 columns). As such, there are 12 preset chords (triads) in the first pattern 613 (72 buttons in 12 columns), 16 preset chords (triads) in the second pattern 614 (96 buttons in 16 columns) and 20 preset chords (triads) in the last pattern 615 (120 buttons in 20 columns). The note formulation in 20 columns 610 of Row#5 625 is the $5^{th}$ common note in Major and minor scale (Perfect Fifth Note).

The Row#6 626 includes 20 buttons of preset chords (triads) consisting of 12 natural notes, six flat notes, and two sharp notes. As shown in the embodiment depicted in FIG. 6, C2 is located in Column X−9; G1 is located in Column X−8; D2 is located in Column X−7; (A1) is located in Column X−6; Fb2(E2) is located in Column X−5; B1 is located in Column X−4; Gb2(F#2) is located in Column X−3; Db2(C#2) is located in Column X−2; Ab2(G#2) is located in Column X−1; Eb2(D#2) is located in Column X (center); Bb2 is located in Column X+1; F2 is located in Column X+2; C3 is located in Column X+3; G2 is located in Column X+4; D3 is located in Column X+5; A2 is located in Column X+6; E3 is located in Column X+7; B2 is located in Column X+8; F#3 is located in Column X+9 and C#3 is located in Column X+10. Fb2(E2), B1, Gb2(F#2), Db2 (C#2), Ab2(G#2), Eb2(D#2), Bb2, F2, C3, G2, D3 and A2 are elements of all forms i.e. the first pattern 613 (72 buttons in 12 columns), the second pattern 614 (96 buttons in 16 columns) as well as the last pattern 615 (120 buttons in 20 columns). On the other hand, D2 (Column X−7), (A1) (Column X−6), E3 (Column X+7) and B2 (Column X+8) are additional notes from the first pattern 613, the second pattern 614 (96 buttons in 16 columns) as well as the last pattern 615 (120 buttons in 20 columns). Similarly, C2 (Column X−9), G1 (Column X−8), F#3 (Column X+9) and C#3 (Column X+10) are additional notes from the second pattern 614 (96 buttons in 16 columns) in the last pattern 615 (120 buttons in 20 columns). As such, there are 12 preset chords (triads) in the first pattern 613 (72 buttons in 12 columns), 16 preset chords (triads) in the second pattern 614 (96 buttons in 16 columns) and 20 preset chords (triads) in the last pattern 615 (120 buttons in 20 columns). The note formulation in 20 columns 610 of Row#6 626 is the Minor $3^{rd}$ note of scale (Minor Third).

In the Note layout of FIG. 6, most of the individual notes are compatible with this note layout in case of accordion designs shutters that can switch from standard chord note chart into new note chart by using a sound register switch. This individual notes or set of notes in each rows belong to set of notes in preset chord standard system. This note layout is very easy to play with many fingering patterns and can help beginners to learn the accordion easier. First, the Major chord in Arpeggio style (Wide Octave Arpeggio Scale) i.e.; the fingering of 1-5-8-5-10-5-8-5-1, if the starting note is C2. The pattern will be C2-G2-C3-G2-E3-G2-C3-G2-C2. If the starting note is D2, the pattern will be D2-A2-D3-A2-F#3-A2-D3-A2-D2. Or if the starting note is E2, the pattern will be E2-B2-E3-B2-G#3-B2-E2-B2-E2. Second, the Major and Minor chords in Arpeggio Style by ignore $3^{rd}$ or $10^{th}$ note that can identify chord quality of major or minor. Third, the Minor chord by fingering pattern of 1-b3-5-8-5-b3-1 (Arpeggio Style). Fourth, the Arpeggio style of Major $7^{th}$ chord by fingering pattern of 1-3-5-7. Fifth, the Arpeggio style on the $9^{th}$, $11^{th}$ extended chords. Sixth, the Arpeggio style of dominant $7^{th}$ chord by fingering of 1-3-5-b7-1-5-b7-8. Seventh, the Arpeggio style of diminished chord (1, b3, b5) or (1, b3, b5, bb7) or (1, b3, bb7(6)) which have alternative notes in adjacent columns to create Dim chord. Eighth, the Diminished Block chord (1, b3, b5). Ninth, 3 notes block chord of major triad or the shape of 3 notes are contiguously arranged in the same column. Tenth, 3 notes (1-b3-5 or b3-5-8) of minor triad are contiguously arranged in the column which makes it easy to play triad minor block chord with close contiguous 3 fingers.

This note layout can fairly played minor chord in Arpeggio style or arpeggio scale as 1-5-8-5-b10-5-8-5-1, Arpeggio style of diminished chord (1, b3, b5, bb7(6)) for 2 octaves and have the alternative notes in adjacent columns to create dim chord, Chromatic scale 12 notes, Major of minor scale 1.5-2 octaves, Adaptable to use 5-line notation to communicate or record how to play notes in a song (Solmization). Using this note layout might be difficult for fingering to play Major $9^{th}$, $11^{th}$ block chord by using only 2-3 pitches combination.

An additional ability of this note layout is to play each type of music scale of chord tone. Chromatic Scale; there are 2 octaves that can be played, 2 different shapes for 12 keys. It is very easy to remember this note layout since it contains only 2 shapes of scale but it is not easy to practice from the starting note ($1^{st}$ note) of scale to $10^{th}$ note or $11^{th}$ note of Chromatic scale, mainly because each note located too far from each other. Partial of Chromatic Scale 4-5-6 notes scale; there are within 2 octaves that can be played scale. It is very easy to remember this note layout since it contains only 2 shapes of scale and moderate to practice the fingering from starting note ($1^{st}$ note) of scale to $4^{th}$ or $5^{th}$ or $6^{th}$ notes of chromatic scale, as the notes are not located too far from each other. Major scale; there are 2 octaves for 6 keys (Fb, Gb, Ab, Bb, C, D, E, F#, G# and A#) and 1.5 octaves for 6 keys (A, B, Db, Eb, F, G, A, B, C# and D#). The uniform of fingering is using row of 1-4 to play by 2 different shapes for 12 keys. 1 shape for Fb, Gb, Ab, Bb, C, D, E, F# and G# key, and another shape for B, Db, Eb, F, G, A, B, C#(1.5 Octaves). Similarly, it is very easy to remember for Major scale since it has only 2 fingering shapes of scale and also easy for practicing. Natural Minor scale; there are 1.5-2 octaves depends on the key. The uniform of fingering is using row of 1-4 to play 2 different shapes for 12 keys, 1 shape for Fbm, Gbm, Abm, Bbm, Cm, Dm, Em, F#m and G#m key, and the other shape for Bm, Dbm, Ebm, Fm, Gm, Am, Bm and C#m. It is very easy to remember for natural minor scale since it has only 2 fingering shapes of scale and also easy for practicing. The last scale is Harmonic Minor Scale; there are 1.5-2 octaves depend on the key. Uniform of fingering is using row 1-4 to play 2 different shapes for 12 keys, 1 shape for Fbm, Gbm, Abm, Bbm, Cm, Dm, Em, F#m, and G# keys. Another shape for Bn, Dbm, Ebm, Fm, Gm, Am, Bm, and C#m. It is very easy to remember for Major scale since it has only 2 fingering shapes of scale. Moderate level for practicing or fingering on $6^{th}$ note and $7^{th}$ note in Harmonic Minor Scale when paly in row 3-4, as they are located about 5-6 columns far from each other, which makes it hard to locate the fingers. In this invention, the chord pitches mean the mixture of several notes. By using the several notes easily, provide a user-friendly system to accordionists. The player can play more than 90% of the accordion songs being public in the world.

Figure 7:
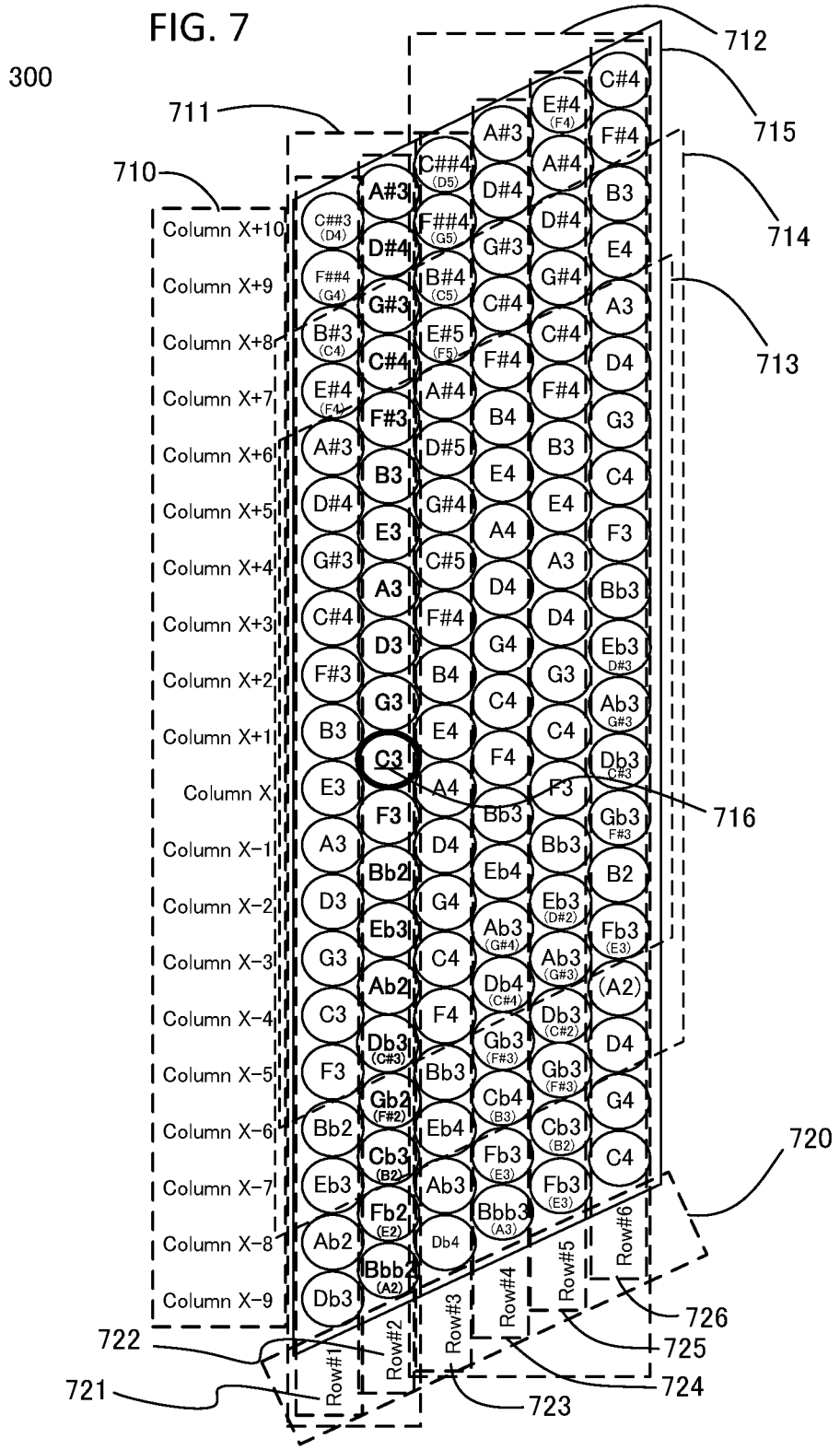
FIG. 7 is a diagram illustrating an example of chord tone pattern which contains single note and 1 higher octave.

FIG. 7 illustrates an exploded view of the Chord Tone Pattern with 1 higher octave. As shown in this figure, the Chord Tone Pattern includes six rows of buttons 720. The six rows of button 720 are arranged in lines in a direction substantially orthogonal to an expansion and contraction direction of the bellow 300. Columns 710 contain from 12 columns 713, 16 columns 714 and 20 columns 715. The six rows of button 720 with 12 columns 713 contain about 72 basses. The six rows of button 720 with 16 columns 714 contain about 96 basses. The six rows of button 720 with 20 columns 715 contain about 120 basses. The six rows of buttons 720 include 12 columns 713 consisting of X−5, X−4, X−3, X−2, X−1, X, X+1, X+2, X+3, X+4, X+5 and X+6. The six rows of buttons 720 include 16 columns 714 consisting of X−7, X−6, X−5, X−4, X−3, X−2, X−1, X, X+1, X+2, X+3, X+4, X+5, X+6, X+7 and X+8. The six rows of buttons 720 include 20 columns 715 consisting of X−9, X−8, X−7, X−6, X−5, X−4, X−3, X−2, X−1, X, X+1, X+2, X+3, X+4, X+5, X+6, X+7, X+8, X+9 and X+10. Row#1 721 and Row#2 722 are assigned to base notes 711. Row#3 723, Row#4 724, Row#5 725 and Row#6 726 are assigned to present chords 712 (triads).

As shown in the embodiment depicted in FIG. 7, for each buttons from the six rows of buttons 720 a number appears after a note. These numbers are octave numbers which are used for identifying the pitches in an octave. The octave number increases or decreases by one. A greater number refers to a higher octave while a smaller number refers to a lower octave. Though a "C4" is normally assigned as a middle C, a "C3" button 716 is a C Root note, which is assigned as a middle C and is located in Row#2 722 and Column X, in order to solve the problem when playing the triad with the close contiguous 3 fingers by arranging 3 notes of major triad or minor triad in the column. This "C3" button 716 allows more extension of directions both following the circle of fifths and the circle of fourths (Moving counter-clockwise in the direction of the circle of fifths).

The Row#1 721 includes up to 20 buttons of bass consisting of four flat notes, seven natural notes, seven sharp notes and two double-sharp notes. As shown in the embodiment depicted in FIG. 6, Db3 is located in Column X−9; Ab2 is located in Column X−8; Eb3 is located in Column X−7; Bb2 is located in Column X−6; F3 is located in Column X−5; C3 is located in Column X−4; G3 is located in Column X−3; D3 is located in Column X−2; A3 is located in Column X−1; E3 is located in Column X (center); B3 is located in Column X+1; F#3 is located in Column X+2; C#4 is located in Column X+3; G#3 is located in Column X+4; D#4 is located in Column X+5; A#3 is located in Column X+6; E#4(F4) is located in Column X+7; B#3(C4) is located in Column X+8; F##4(G4) is located in Column X+9 and C##3(D4) is located in Column X+10. F3, C3, G3, D3, A3, E3, B3, F#3, C#4, G#3, D#4 and A#3 are elements of all patterns, i.e., the first pattern 713 (72 buttons in 12 columns), the second pattern 714 (96 buttons in 16 columns) as well as the last pattern 715 (120 buttons in 20 columns). On the other hand, Eb3 (Column X−7), Bb2 (Column X−6), E#4 (F4) (Column X+7) and B#3(C4) (Column X+8) are additional notes from the first pattern 713, the second pattern 714 (96 buttons in 16 columns) as well as the last pattern 715 (120 buttons in 20 columns). Similarly, Db3 (Column X−9), Ab2 (Column X−8), F##4(G4) (Column X+9) and C##3 (D4) (Column X+10) are additional notes from the second pattern 714 (96 buttons in 16 columns) in the last pattern 715 (120 buttons in 20 columns). As such, there are 12 bass notes in the first pattern 713 (72 buttons in 12 columns), 16 bass notes in the second pattern 714 (96 buttons in 16 columns) and 20 bass notes in the last pattern 715 (120 buttons in 20 columns). The note formulation in 20 columns 710 of Row#1 721 is the $3^{rd}$ note in Major scale count from root (Major third note).

The Row#2 722 includes 20 buttons of bass consisting of one double-flat note, seven flat notes, seven natural notes and five sharp notes. As shown in the embodiment depicted in FIG. 6, Bbb2(A2) is located in Column X−9; Fb2(E2) is located in Column X−8; Cb3(B2) is located in Column X−7; Gb2(F#2) is located in Column X−6; Db3(C#3) is located in Column X−5; Ab2 is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; F#3 is located in Column X+6; C#4 is located in Column X+7; G#3 is located in Column X+8; D#4 is located in Column X+9 and A#3 is located in Column X+10. Db3(C#3), Ab2, Eb3, Bb2, F3, C3, G3, D3, A3, E3, B3 and F#3 are elements of all patterns, i.e., the first pattern 713 (72 buttons in 12 columns), the second pattern 714 (96 buttons in 16 columns) as well as the last pattern 715 (120 buttons in 20 columns). On the other hand, Cb3(B2) (Column X−7), Gb2(F#2) (Column X−6), C#4 (Column X+7) and G#3 (Column X+8) are additional notes from the first pattern 713, the second pattern 714 (96 buttons in 16 columns) as well as the last pattern 715 (120 buttons in 20 columns) and Bbb2(A2) (Column X−9), Fb2(E2) (Column X−8), D#4 (Column X+9). Similarly, A#3 (Column X+10) are additional notes from the second pattern 714 (96 buttons in 16 columns) in the last pattern 715 (120 buttons in 20 columns). As such, there are 12 bass notes in the first pattern 713 (72 buttons in 12 columns), 16 bass notes in the second pattern 714 (96 buttons in 16 columns) and 20 bass notes in the last pattern 715 (120 buttons in 20 columns). The note formulation in 20 columns 710 of Row#2 722 is a root of scale and chord.

The Row#3 723 includes 20 buttons of preset chords (triads) consisting of four flat notes, seven natural notes, seven sharp notes and two double-sharp notes. As shown in the embodiment depicted in FIG. 7, Db4 is located in Column X−9; Ab3 is located in Column X−8; Eb4 is located in Column X−7; Bb3 is located in Column X−6; F4 is located in Column X−5; C4 is located in Column X−4; G4 is located in Column X−3; D4 is located in Column X−2; A4 is located in Column X−1; E4 is located in Column X (center); B4 is located in Column X+1; F#4 is located in Column X+2; C#5 is located in Column X+3; G#4 is located in Column X+4; D#5 is located in Column X+5; A#4 is located in Column X+6; E#5(F5) is located in Column X+7; B#4(C5) is located in Column X+8; F##4(G5) is located in Column X+9 and C##4(D5) is located in Column X+10. F4, C4, G4, D4, A4, E4, B4, F#4, C#5, G#4, D#5 and A#4 are elements of all patterns, i.e., the first pattern 713 (72 buttons in 12 columns), the second pattern 714 (96 buttons in 16 columns) as well as the last pattern 715 (120 buttons in 20 columns). On the other hand, Eb4 (Column X−7), Bb3 (Column X−6), E#5(F5) (Column X+7) and B#4(C5) (Column X+8) are additional notes from the first pattern 713, the second pattern 714 (96 buttons in 16 columns) as well as the last pattern 715 (120 buttons in 20 columns). Similarly, Db4 (Column X−9), Ab3 (Column X−8), F##4(G5) (Column X+9) and C##4(D5) (Column X+10) are additional notes from the second pattern 714 (96 buttons in 16 columns) in the last pattern 715 (120 buttons in 20 columns). As such, there are 12 preset chords (triads) in the first pattern 713 (72 buttons in 12 columns), 16 preset chords (triads) in the second pattern 714 (96 buttons in 16 columns) and 20 preset chords (triads) in the last pattern 715 (120 buttons in 20 columns). The note formulation in 20 columns 710 of Row#3 723 is the Major $10^{th}$ of scale, Major $3^{rd}$ note (major third of next higher octave).

The Row#4 724 includes 20 buttons of preset chords (triads) consisting of one double-flat note, seven flat notes, seven natural notes and five sharp notes. As shown in the embodiment depicted in FIG. 7, Bbb3(A3) is located in Column X−9; Fb3(E3) is located in Column X−8; Cb4(B3) is located in Column X−7; Gb3(F#3) is located in Column X−6; Db4(C#4) is located in Column X−5; Ab3(G#3) is located in Column X−4; Eb4 is located in Column X−3; Bb3 is located in Column X−2; F4 is located in Column X−1; C4 is located in Column X (center); G4 is located in Column X+1; D4 is located in Column X+2; A4 is located in Column X+3; E4 is located in Column X+4; B4 is located in Column X+5; F#4 is located in Column X+6; C#5 is located in Column X+7; G#4 is located in Column X+8; D#5 is located in Column X+9 and A#4 is located in Column X+10. Db4(C#4), Ab3(G#3), Eb4, Bb4, F4, C4, G4, D4, A4, E4, B4 and F#4 are elements of all patterns, i.e., the first pattern 713 (72 buttons in 12 columns), the second pattern 714 (96 buttons in 16 columns) as well as the last pattern 715 (120 buttons in 20 columns). On the other hand, Cb4(B3) (Column X−7), Gb3(F#3) (Column X−6), C#5 (Column X+7) and G#4 (Column X+8) are additional notes from the first pattern 713, the second pattern 714 (96 buttons in 16 columns) as well as the last pattern 715 (120 buttons in 20 columns). Similarly, Bbb3(A3) (Column X−9), Fb3(E3) (Column X−8), D#5 (Column X+9) and A#4 (Column X+10) are additional notes from the second pattern 714 (96 buttons in 16 columns) in the last pattern 715 (120 buttons in 20 columns). As such, there are 12 preset chords (triads) in the first pattern 713 (72 buttons in 12 columns), 16 preset chords (triads) in the second pattern 714 (96 buttons in 16 columns) and 20 preset chords (triads) in the last pattern 715 (120 buttons in 20 columns). The note formulation in 20 columns 710 of Row#4 724 is the $8^{th}$ common note (Octaved note).

The Row#5 725 includes 20 buttons of preset chords (triads) consisting of seven flat notes, seven natural notes and six sharp notes. As shown in the embodiment depicted in FIG. 7, Fb4(E3) is located in Column X−9; Cb3(B2) is located in Column X−8; Gb3(F#3) is located in Column X−7; Db3(C#2) is located in Column X−6; Ab3(G#3) is located in Column X−5; Eb3(D#2) is located in Column X−4; Bb3 is located in Column X−3; F3 is located in Column X−2; C4 is located in Column X−1; G3 is located in Column X (center); D4 is located in Column X+1; A3 is located in Column X+2; E4 is located in Column X+3; B3 is located in Column X+4; F#4 is located in Column X+5; C#4 is located in Column X+6; G#4 is located in Column X+7; D#4 is located in Column X+8; A#4 is located in Column X+9 and E#4(F4) is located in Column X+10. Ab3(G#3), Eb3(D#2), Bb3, F3, C4, G3, D4, A3, E4, B3, F#4 and C#4 are elements of all patterns, i.e., the first pattern 713 (72 buttons in 12 columns), the second pattern 714 (96 buttons in 16 columns) as well as the last pattern 715 (120 buttons in 20 columns). On the other hand, Gb3(F#3) (Column X−7), Db3(C#2) (Column X−6), G#4 (Column X+7) and D#4 (Column X+8) are additional notes from the first pattern 713, the second pattern 714 (96 buttons in 16 columns) as well as the last pattern 715 (120 buttons in 20 columns). Similarly, Fb3(E3) (Column X−9), Cb3(B2) (Column X−8), A#4 (Column X+9) and E#4(F4) (Column X+10) are additional notes from the second pattern 714 (96 buttons in 16 columns) in the last pattern 715 (120 buttons in 20 columns). As such, there are 12 preset chords (triads) in the first pattern 713 (72 buttons in 12 columns), 16 preset chords (triads) in the second pattern 714 (96 buttons in 16 columns) and 20 preset chords (triads) in the last pattern 715 (120 buttons in 20 columns). The note formulation in 20 columns 710 of Row#5 725 is the $5^{th}$ common note in Major and Minor scale (Perfect Fifth Note).

The Row#6 726 includes 20 buttons of preset chords (triads) consisting of 12 natural notes, six flat notes, and two sharp notes. As shown in the embodiment depicted in FIG. 7, C4 is located in Column X−9; G4 is located in Column X−8; D4 is located in Column X−7; (A2) is located in Column X−6; Fb3(E3) is located in Column X−5; B2 is located in Column X−4; Gb3(F#3) is located in Column X−3; Db3(C#3) is located in Column X−2; Ab3(G#3) is located in Column X−1; Eb3(D#3) is located in Column X (center); Bb3 is located in Column X+1; F3 is located in Column X+2; C4 is located in Column X+3; G3 is located in Column X+4; D4 is located in Column X+5; A3 is located in Column X+6; E4 is located in Column X+7; B3 is located in Column X+8; F#4 is located in Column X+9 and C#4 is located in Column X+10. Fb3(E3), B2, Gb3(F#3), Db3 (C#3), Ab3(G#3), Eb3(D#3), Bb3, F3, C4, G3, D4 and A3 are elements of all forms, i.e., the first pattern 713 (72 buttons in 12 columns), the second pattern 714 (96 buttons in 16 columns) as well as the last pattern 715 (120 buttons in 20 columns). On the other hand, D4 (Column X−7), (A2) (Column X−6), E4 (Column X+7) and B3 (Column X+8) are additional notes from the first pattern 713, the second pattern 714 (96 buttons in 16 columns) as well as the last pattern 715 (120 buttons in 20 columns). Similarly, C4 (Column X−9), G4 (Column X−8), F#4 (Column X+9) and C#4 (Column X+10) are additional notes from the second pattern 714 (96 buttons in 16 columns) in the last pattern 715 (120 buttons in 20 columns). As such, there are 12 preset chords (triads) in the first pattern 713 (72 buttons in 12 columns), 16 preset chords (triads) in the second pattern 714 (96 buttons in 16 columns) and 20 preset chords (triads) in the last pattern 715 (120 buttons in 20 columns). The note formulation in 20 columns 710 of Row#6 726 is the Minor $3^{rd}$ note of scale (Minor Third).

In the Note layout of FIG. 7, most of notes are compatible with this note layout in case of accordion designs shutters that can switch from standard chord note chart into new note chart by using a sound register switch. This individual notes or set of notes in each rows belong to set of notes in preset chord standard system. This note layout is very easy to play with many fingering patterns and can help beginners to learn the accordion easier. First, the Major chord in Arpeggio style (Wide Octave Arpeggio Scale) i.e.; the fingering of 1-5-8-5-10-5-8-5-1, if the starting note is C3. The pattern will be C3-G3-C4-G3-E4-G3-C4-G3-C3. If the starting note is D3, the pattern will be D3-A3-D4-A3-F#4-A3-D4-A3-D3. Or if the starting note is E3, the pattern will be E3-B3-E4-B3-G#4-B3-E3-B3-E3. Second, the Major and Minor chords in Arpeggio Style by ignore $3^{rd}$ or $10^{th}$ note that can identify chord quality of major or minor. Third, the Minor chord by fingering of 1-b3-5-8-5-b3-1 (Arpeggio Style). Fourth, the Arpeggio style of Major $7^{th}$ chord by fingering of 1-3-5-7. Fifth, the Arpeggio style on the $9^{th}$, $11^{th}$ extended chords. Sixth, the Arpeggio style of dominant $7^{th}$ chord by fingering of 1-3-5-b7-1-5-b7-8. Seventh, the Arpeggio style of diminished chord (1, b3, b5) or (1, b3, b5, bb7) or (1, b3, bb7(6)) which have alternative notes in adjacent columns to create Dim chord. Eighth, the Diminished Block chord (1, b3, b5). Ninth, 3 notes block chord of major triad or the shape of 3 notes are contiguously arranged in the same column. Tenth, 3 notes (1-b3-5 or b3-5-8) of minor triad are contiguously arranged in the column which makes it easy to play triad minor block chord with close contiguous 3 fingers.

This note layout can fairly played minor chord in Arpeggio style or arpeggio scale as 1-5-8-5-b10-5-8-5-1, Arpeggio style of diminished chord (1, b3, b5, bb7(6)) for 2 octaves and have the alternative notes in adjacent columns to create dim chord, Chromatic scale 12 notes, Major of minor scale 1.5-2 octaves, Adaptable to use 5-line notation to communicate or record how to play notes in a song (Solmization). Using this note layout might be difficult for fingering to play Major $9^{th}$, $11^{th}$ block chord by using only 2-3 pitches combination.

The additional ability of this note layout is to play each type of music scale of chord tone. Chromatic Scale; there are 2 octaves that can be played, 2 different shapes for 12 keys. It is very easy to remember this note layout since it contains only 2 shapes of scale but it is not easy to practice from the starting note ($1^{st}$ note) of scale to $10^{th}$ note or $11^{th}$ note of Chromatic scale, mainly because each note located too far from each other. Partial of Chromatic Scale 4-5-6 notes scale; there are within 2 octaves that can be played scale. It is very easy to remember this note layout since it contains only 2 shapes of scale and moderate to practice the fingering from starting note ($1^{st}$ note) of scale to $4^{th}$ or $5^{th}$ or $6^{th}$ notes of chromatic scale, as the notes are not located too far from each other. Major scale; there are 2 octaves for 6 keys (Fb, Gb, Ab, Bb, C, D, E, F#, G# and A#) and 1.5 octaves for 6 keys (A, B, Db, Eb, F, G, A, B, C# and D#). The uniform of fingering is using row of 1-4 to play by 2 different shapes for 12 keys. 1 shape for Fb, Gb, Ab, Bb, C, D, E, F# and G# key, and another shape for B, Db, Eb, F, G, A, B, C#(1.5 Octaves). Similarly, it is very easy to remember for Major scale since it has only 2 fingering shapes of scale and also easy for practicing. Natural Minor scale; there are 1.5-2 octaves depends on the key. The uniform of fingering is using row of 1-4 to play 2 different shapes for 12 keys, 1 shape for Fbm, Gbm, Abm, Bbm, Cm, Dm, Em, F#m and G#m key, and other shape for Bm, Dbm, Ebm, Fm, Gm, Am, Bm and C#m. It is very easy to remember for natural minor scale since it has only 2 fingering shapes of scale and also easy for practicing. The last scale is Harmonic Minor Scale; There are 1.5-2 octaves depend on the key. Uniform of fingering is using row 1-4 to play 2 different shapes for 12 keys, 1 shape for Fbm, Gbm, Abm, Bbm, Cm, Dm, Em, F#m, and G# keys. Another shape for Bm, Dbm, Ebm, Fm, Gm, Am, Bm, and C#m. It is very easy to remember for Major scale since it has only 2 fingering shapes of scale. Moderate level for practicing or fingering on $6^{th}$ note and $7^{th}$ note in Harmonic Minor Scale when paly in row 3-4, as they are located about 5-6 columns far from each other, which makes it hard to locate the fingers.

Figure 8:
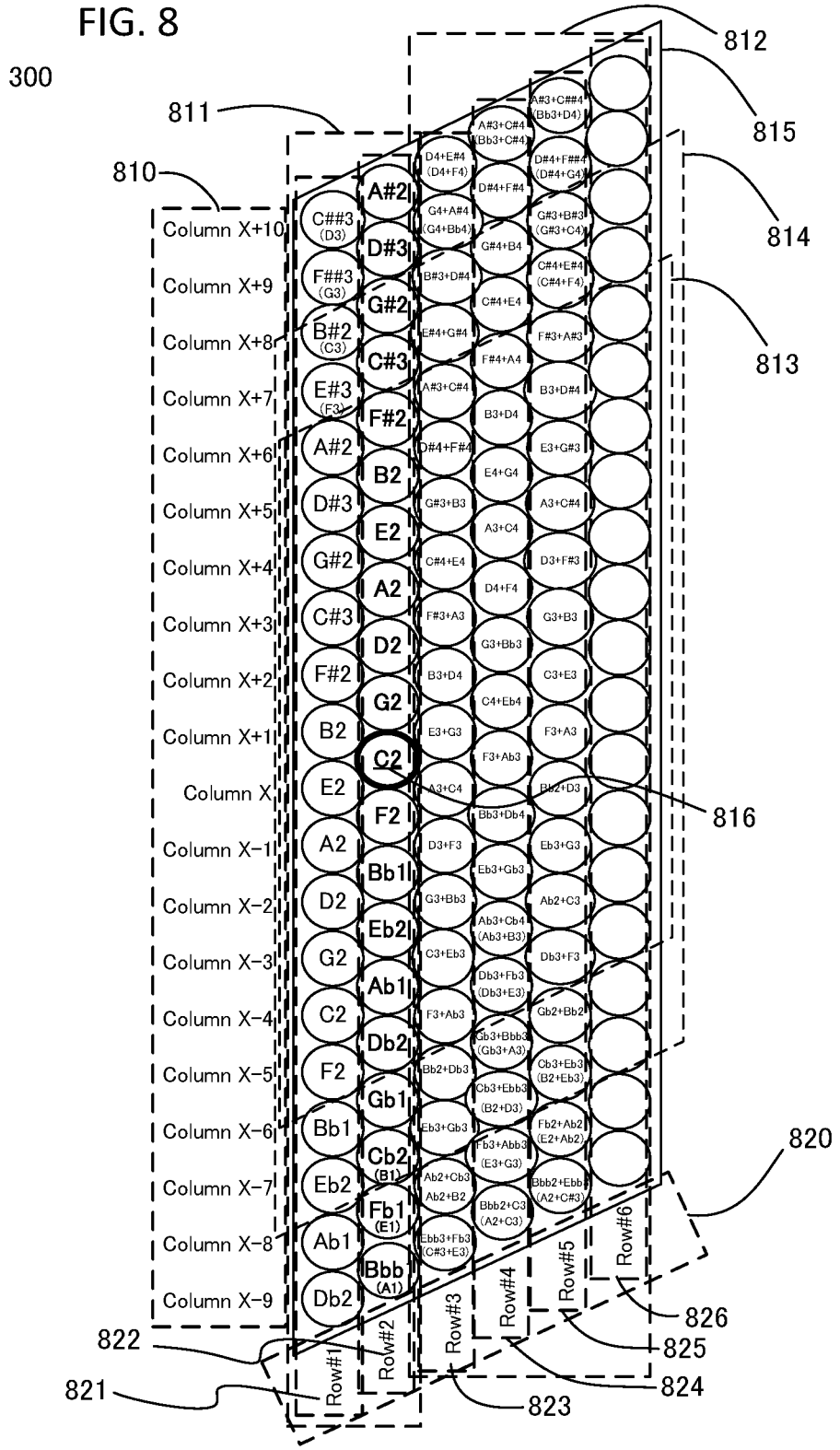
FIG. 8 is a diagram illustrating an example of chord tone pattern which contains double notes, 120 basses layer 0, fixed pattern of Row 1 to Row 5.

FIG. 8 illustrates an exploded view of the Chord Tone Pattern with double notes by fixed Row 1-5. As shown in this figure, the Chord Tone Pattern of this embodiment includes six rows of buttons 820. The six rows of button 820 are arranged in lines in a direction substantially orthogonal to an expansion and contraction direction of the bellow 300. Columns 810 contain from 12 columns 813, 16 columns 814 and 20 columns 815. The six rows of button 820 with 12 columns 813 contain about 72 basses. The six rows of button 820 with 16 columns 814 contain about 96 basses. The six rows of button 820 with 20 columns 815 contain about 120 basses. The six rows of buttons 820 include 12 columns 813 consisting of X−5, X−4, X−3, X−2, X−1, X, X+1, X+2, X+3, X+4, X+5 and X+6. The six rows of buttons 820 include 16 columns 814 consisting of X−7, X−6, X−5, X−4, X−3, X−2, X−1, X, X+1, X+2, X+3, X+4, X+5, X+6, X+7 and X+8. The six rows of buttons 820 include 20 columns 815 consisting of X−9, X−8, X−7, X−6, X−5, X−4, X−3, X−2, X−1, X, X+1, X+2, X+3, X+4, X+5, X+6, X+7, X+8, X+9 and X+10. Row#1 821 and Row#2 822 are assigned to base notes 811. Row#3 823, Row#4 824, Row#5 825 and Row#6 826 are assigned to present chords 812 (triads).

As shown in the embodiment depicted in FIG. 8, for each buttons from the six rows of buttons 820 a number appears after a note. These numbers are octave numbers which are used for identifying the pitches in an octave. The octave number increases or decrease by one. A greater number refers to a higher octave while a smaller number refers to a lower octave. Though a "C4" is normally assigned as a middle C, a "C2" button 816 is a C Root note, which is assigned as a middle C and is located in Row#2 822 and Column X, in order to solve the problem when playing the triad with the close contiguous 3 fingers by arranging 3 notes of major triad or minor triad in the column. This "C2" button 816 allows more extension of directions both following the circle of fifths and the circle of fourths (Moving counter-clockwise the in direction of the circle of fifths).

The Row#1 821 includes up to 20 buttons of bass consisting of four flat notes, seven natural notes, seven sharp notes and two double-sharp notes. As shown in the embodiment depicted in FIG. 8, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X−2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 813 (72 buttons in 12 columns), the second pattern 814 (96 buttons in 16 columns) as well as the last pattern 815 (120 buttons in 20 columns). On the other hand, Eb2 (Column X−7), Bb1 (Column X−6), E#3 (F3) (Column X+7) and B#2(C3) (Column X+8) are additional notes from the first pattern 813, the second pattern 814 (96 buttons in 16 columns) as well as the last pattern 815 (120 buttons in 20 columns). Similarly, Db2 (Column X−9), Ab1 (Column X−8), F##3(G3) (Column X+9) and C##2 (D3) (Column X+10) are additional notes from the second pattern 814 (96 buttons in 16 columns) in the last pattern 815 (120 buttons in 20 columns). As such, there are 12 bass notes in the first pattern 813 (72 buttons in 12 columns), 16 bass notes in the second pattern 814 (96 buttons in 16 columns) and 20 bass notes in the last pattern 815 (120 buttons in 20 columns). The note formulation in 20 columns 810 of Row#1 821 is the $3^{rd}$ note in major scale count from root (major third note).

The Row#2 822 includes 20 buttons of bass consisting of one double-flat note, seven flat notes, seven natural notes and five sharp notes. As shown in the embodiment depicted in FIG. 8, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 813 (72 buttons in 12 columns), the second pattern 814 (96 buttons in 16 columns) as well as the last pattern 815 (120 buttons in 20 columns). On the other hand, Cb2(B1) (Column X−7), Gb1(F#1) (Column X−6), C#3 (Column X+7) and G#2 (Column X+8) are additional notes from the first pattern 813, the second pattern 814 (96 buttons in 16 columns) as well as the last pattern 815 (120 buttons in 20 columns). Similarly, Bbb1(A1) (Column X−9), Fb1 (E1) (Column X−8), D#3 (Column X+9) and A#2 (Column X+10) are additional notes from the second pattern 814 (96 buttons in 16 columns) in the last pattern 815 (120 buttons in 20 columns). As such, there are 12 bass notes in the first pattern 813 (72 buttons in 12 columns), 16 bass notes in the second pattern 814 (96 buttons in 16 columns) and 20 bass notes in the last pattern 815 (120 buttons in 20 columns). The note formulation in 20 columns 810 of Row#2 822 is a root of scale and chord.

The Row#3 823 includes 20 buttons of preset chords (triads) consisting of one combination of double flat note with flat note, three combination of flat note with flat note, three combination of flat note with natural note, four combination of natural note with natural note, five combination of natural note with sharp note, four combination of sharp note with sharp note. As shown in the embodiment depicted in FIG. 8, Ebb3+Fb3(C#3+E3) is located in Column X−9; Ab2+Cb3(Ab2+B2) is located in Column X−8; Eb3+Gb3 is located in Column X−7; Bb2+Db3 is located in Column X−6; F3+Ab3 is located in Column X−5; C3+Eb3 is located in Column X−4; G3+Bb3 is located in Column X−3; D3+F3 is located in Column X−2; A3+C4 is located in Column X−1; E3+G3 is located in Column X (center); B3+D4 is located in Column X+1; F#3+A3 is located in Column X+2; C#4+E4 is located in Column X+3; G#3+B3 is located in Column X+4; D#4+F##4 is located in Column X+5; A#3+C#4 is located in Column X+6; E#4+G#4 is located in Column X+7; B#3+D#4 is located in Column X+8; G4+A#4 (G4+Bb4) is located in Column X+9 and D4+E#4(D4+F4) is located in Column X+10. F3+Ab3, C3+Eb3, G3+Bb3, D3+F3, A3+C4, E3+G3, B3+D4, F#3+A3, C#4+E4, G#3+B3 and A#3+C#4 are elements of all patterns, i.e., the first pattern 813 (72 buttons in 12 columns), the second pattern 814 (96 buttons in 16 columns) as well as the last pattern 815 (120 buttons in 20 columns). On the other hand, Eb3+Gb3 (Column X−7), Bb2+Db3 (Column X−6), E#4+G#4 (Column X+7) and B#3+D#4 (Column X+8) are additional notes from the first pattern 813, the second pattern 814 (96 buttons in 16 columns) as well as the last pattern 815 (120 buttons in 20 columns). Similarly, Ebb3+Fb3(C#3+E3) (Column X−9), Ab2+Cb3(Ab2B2) (Column X−8), G4+A#4(G4+Bb4)(Column X+9) and D4+E#4(D4+F4)(Column X+10) are additional notes from the second pattern 814 (96 buttons in 16 columns) in the last pattern 815 (120 buttons in 20 columns). As such, there are 12 preset chords (triads) in the first pattern 813 (72 buttons in 12 columns), 16 preset chords (triads) in the second pattern 814 (96 buttons in 16 columns) and 20 preset chords (triads) in the last pattern 815 (120 buttons in 20 columns). The note formulation in 20 columns 810 of Row#3 823 is the Major Chord (Root form exclude root note), $3^{rd}$ combines with $5^{th}$ of Major chord.

The Row#4 824 includes 20 buttons of preset chords (triads) consisting of one combination of double flat note with natural note, three combination of double flat note with flat note, four combination of flat note with flat note, three combination of flat note with natural note, four combination of natural note with natural note, three combination of natural note with flat note, two combination of sharp note with sharp note. As shown in the embodiment depicted in FIG. 8, Bbb2+C3(A2+C3) is located in Column X−9; Fb3+Abb3(E3+G3) is located in Column X−8; Cb3+Ebb3(B2+D3) is located in Column X−7; Gb3+Bbb3(Gb3+A3) is located in Column X−6; Db3+Fb3(Db3+E3) is located in Column X−5; Ab3+Cb4(Ab3+B3) is located in Column X−4; Eb3+Gb3 is located in Column X−3; Bb3+Db4 is located in Column X−2; F3+Ab3 is located in Column X−1; C4+Eb4 is located in Column X (center); G3+Bb3 is located in Column X+1; D4+F4 is located in Column X+2; A3+C4 is located in Column X+3; E4+G4 is located in Column X+4; B3+D4 is located in Column X+5; F#4+A4 is located in Column X+6; C#4+E4 is located in Column X+7; G#4+B4 is located in Column X+8; D#4+F#4 is located in Column X+9 and A#3+C#4(Bb3+C#4) is located in Column X+10. Db3+Fb3(Db3+E3), Ab3+Cb4(Ab3+B3), Eb3+Gb3, Bb3+Db4, F3+Ab3, C4+Eb4, G3+Bb3, D4+F4, A3+C4, E4+G4, B3+D4 and F#4+A4 are elements of all patterns, i.e., the first pattern 813 (72 buttons in 12 columns), the second pattern 814 (96 buttons in 16 columns) as well as the last pattern 815 (120 buttons in 20 columns). On the other hand, Cb3+Ebb3(B2+D3) (Column X−7), Gb3+Bbb3(Gb3+A3) (Column X−6), C#4+E4 (Column X+7) and G#4+B4 (Column X+8) are additional notes from the first pattern 813, the second pattern 814 (96 buttons in 16 columns) as well as the last pattern 815 (120 buttons in 20 columns). Similarly, Bbb2+C3(A2+C3) (Column X−9), Fb3+Abb3 (E2+G3) (Column X−8), D#4+F#4 (Column X+9) and A#3+C#4(Bb3+C#4) (Column X+10) are additional notes from the second pattern 814 (96 buttons in 16 columns) in the last pattern 815 (120 buttons in 20 columns). As such, there are 12 preset chords (triads) in the first pattern 813 (72 buttons in 12 columns), 16 preset chords (triads) in the second pattern 814 (96 buttons in 16 columns) and 20 preset chords (triads) in the last pattern 815 (120 buttons in 20 columns). The note formulation in 20 columns 810 of Row#4 824 is Minor chord (Root form exclude 5th) $1^{st}$ combines with $3^{rd}$ of minor chord.

The Row#5 825 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 8, Bbb2+Ebb3(A2+C#3) is located in Column X−9; Fb2+Ab2(E2+Ab2) is located in Column X−8; Cb3+Eb3 (B2+Eb3) is located in Column X−7; Gb2+Bb2 is located in Column X−6; Db3+F3 is located in Column X−5; Ab2+C3 is located in Column X−4; Eb3+G3 is located in Column X−3; Bb2+D3 is located in Column X−2; F3+A3 is located in Column X−1; C3+E3 is located in Column X (center); G3+B3 is located in Column X+1; D3+F#3 is located in Column X+2; A3+C#4 is located in Column X+3; E3+G#3 is located in Column X+4; B3+D#4 is located in Column X+5; F#3+A#3 is located in Column X+6; C#4+E#4(C#4+F4) is located in Column X+7; G#3+B#3(G#3+C4) is located in Column X+8; D#4+F##4(D#4+G4) is located in Column X+9 and A#3+C##4(Bb3#D4) is located in Column X+10. Db3+F3, Ab2+C3, Eb3+G3, Bb2+D3, F3+A3, C3+E3, G3+B3, D3+F#3, A3+C#4, E3+G#3, B3+D#4 and F#3+A#3 are elements of all patterns, i.e., the first pattern 813 (72 buttons in 12 columns), the second pattern 814 (96 buttons in 16 columns) as well as the last pattern 815 (120 buttons in 20 columns). On the other hand, Cb3+Eb3(B2+Eb3) (Column X−7), Gb2+Bb2 (Column X−6), C#4+E#4 (C#4+F4) (Column X+7) and G#3+B#3(G#3+C4) (Column X+8) are additional notes from the first pattern 813, the second pattern 814 (96 buttons in 16 columns) as well as the last pattern 815 (120 buttons in 20 columns). Similarly, Bbb2+Ebb3(A2+C#3) (Column X−9), Fb2+Ab2(E2+Ab2) (Column X−8), D#4+F##4(D#4+G4) (Column X+9) and A#3+C##4(Bb3#D4) (Column X+10) are additional notes from the second pattern 814 (96 buttons in 16 columns) in the last pattern 815 (120 buttons in 20 columns). As such, there are 12 preset chords (triads) in the first pattern 813 (72 buttons in 12 columns), 16 preset chords (triads) in the second pattern 814 (96 buttons in 16 columns) and 20 preset chords (triads) in the last pattern 815 (120 buttons in 20 columns). The note formulation in 20 columns 810 of Row#5 825 is the Major chord (Root Exclude $5^{th}$ note) $1^{st}$ combines with $3^{rd}$ of Major chord without $5^{th}$ note.

This note layout has the ability to play fundamental chords of diatonic scale. It is very easy to play with Major Arpeggio sound alike by using single note or double notes that belong to Major chord, Minor Arpeggio sound alike by using single note or double notes that belong to minor, Dominant $7^{th}$ Arpeggio sound alike by using Single note or Double Notes that belong to Dominant $7^{th}$ Chord, Diminished Arpeggio Triad sound alike by using Single note or Double Notes that belong to Half Diminished Chord, Full Diminished Arpeggio sound alike by using Single note or Double Notes that belong to Full Diminished Chord, Minor Block Chord or Arpeggio with difference position or difference Column (optional Position).

This note layout has the ability to play extended chord by using only fixed Row1-Row5. It is very easy to play Minor Major $7^{th}$ Arpeggio sound alike by using Single note or Double Notes that belong to Major Chord, Major $7^{th}$ Arpeggio sound alike by using Single note or Double Notes that belong to Major Chord, Major $9^{th}$ Arpeggio sound alike by using Single note or Double Notes that belong to Major Chord, but Difficult to play Minor $7^{th}$ flat $5^{th}$ Triad Arpeggio sound alike by using Single note or Double Notes that belong to Minor $7^{th}$ flat $5^{th}$ Triad Chord.

This note layout can easily play Chord progression by using this note layout, it can also play ii-V(7)-I of Major Scale and I-IV-V and ii, iii, vi of Major Scale. But, ability to play ii7b5-V-I of Minor Scale is moderate since it uses ii Dim (Triad) instead of ii7b5.

The ability to play a variety of Chord forms (Root form and inversion form) by using only fixed row 1-row 5. It is easy to play Major chord by using root form $2^{nd}$ inversion, Minor by using root form (use optional position), Dominant $7^{th}$ by using Root form $2^{nd}$ inversion, Half Diminished by using root form $2^{nd}$ inversion, Major $7^{th}$ by using root form $2^{nd}$ inversion, and Minor $7^{th}$ by using root form $2^{nd}$ inversion.

Figure 9:
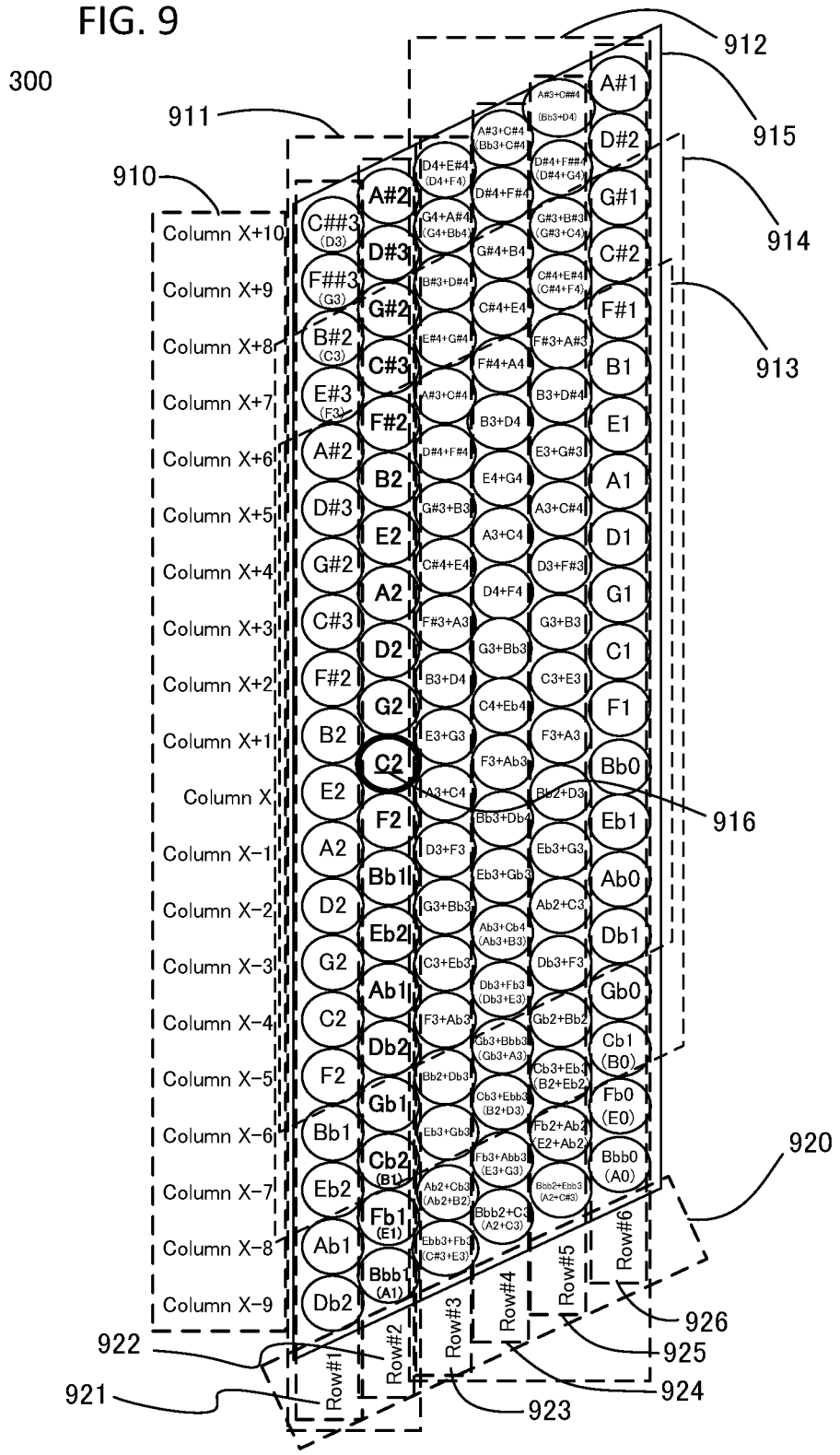
FIG. 9 is a diagram illustrating an example of chord tone pattern which contains double notes, 120 basses layer 1, Row $6^{th}$ has same pattern as row $2^{nd}$ but lower octave.

FIG. 9 illustrates an exploded view of the Chord Tone Pattern with double notes by fixed Row 1-5 by Row#6 is root note with 2 higher octave. As shown in this figure, the Chord Tone Pattern of the present embodiment includes six rows of buttons 920. The six rows of button 920 are arranged in lines in a direction substantially orthogonal to an expansion and contraction direction of the bellow 300. Columns 910 contain from 12 columns 913, 16 columns 914 and 20 columns 915. The six rows of button 920 with 12 columns 913 contain about 72 basses. The six rows of button 920 with 16 columns 914 contain about 96 basses. The six rows of button 920 with 20 columns 915 contain about 120 basses. The six rows of buttons 920 include 12 columns 913 consisting of X−5, X−4, X−3, X−2, X−1, X, X+1, X+2, X+3, X+4, X+5 and X+6. The six rows of buttons 920 include 16 columns 914 consisting of X−7, X−6, X−5, X−4, X−3, X−2, X−1, X, X+1, X+2, X+3, X+4, X+5, X+6, X+7 and X+8. The six rows of buttons 920 include 20 columns 915 consisting of X−9, X−8, X−7, X−6, X−5, X−4, X−3, X−2, X−1, X, X+1, X+2, X+3, X+4, X+5, X+6, X+7, X+8, X+9 and X+10. Row#1 921 and Row#2 922 are assigned to base notes 911. Row#3 923, Row#4 924, Row#5 925 and Row#6 926 are assigned to present chords 912 (triads).

As shown in the embodiment depicted in FIG. 9, for each buttons from the six rows of buttons 920 a number appears after a note. These numbers are octave numbers which are used for identifying the pitches in an octave. The octave number increases or decreases by one. A greater number refers to a higher octave while a smaller number refers to a lower octave. Though a "C4" is normally assigned as a middle C, a "C2" button 916 is a C Root note, which is assigned as a middle C and is located in Row#2 922 and Column X, in order to solve the problem when playing the triad with the close contiguous 3 fingers by arranging 3 notes of major triad or minor triad in the column. This "C2" button 916 allows more extension of directions both following the circle of fifths and the circle of fourths (Moving counter-clockwise in the direction of the circle of fifths).

The Row#1 921 includes up to 20 buttons of bass consisting of four flat notes, seven natural notes, seven sharp notes and two double-sharp notes. As shown in the embodiment depicted in FIG. 9, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X−2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 913 (72 buttons in 12 columns), the second pattern 914 (96 buttons in 16 columns) as well as the last pattern 915 (120 buttons in 20 columns). On the other hand, Eb2 (Column X−7), Bb1 (Column X−6), E#3 (F3) (Column X+7) and B#2(C3) (Column X+8) are additional notes from the first pattern 913, the second pattern 914 (96 buttons in 16 columns) as well as the last pattern 915 (120 buttons in 20 columns). Similarly, Db2 (Column X−9), Ab1 (Column X−8), F##3(G3) (Column X+9) and C##2 (D3) (Column X+10) are additional notes from the second pattern 914 (96 buttons in 16 columns) in the last pattern 915 (120 buttons in 20 columns). As such, there are 12 bass notes in the first pattern 913 (72 buttons in 12 columns), 16 bass notes in the second pattern 914 (96 buttons in 16 columns) and 20 bass notes in the last pattern 915 (120 buttons in 20 columns). The note formulation in 20 columns 910 of Row#1 921 is the 3$^{rd}$ note in Major scale count from root (major third note).

The Row#2 922 includes 20 buttons of bass consisting of one double-flat note, seven flat notes, seven natural notes and five sharp notes. As shown in the embodiment depicted in FIG. 9, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 913 (72 buttons in 12 columns), the second pattern 914 (96 buttons in 16 columns) as well as the last pattern 915 (120 buttons in 20 columns). On the other hand, Cb2(B1) (Column X−7), Gb1(F#1) (Column X−6), C#3 (Column X+7) and G#2 (Column X+8) are additional notes from the first pattern 913, the second pattern 914 (96 buttons in 16 columns) as well as the last pattern 915 (120 buttons in 20 columns). Similarly, Bbb1(A1) (Column X−9), Fb1 (E1) (Column X−8), D#3 (Column X+9) and A#2 (Column X+10) are additional notes from the second pattern 914 (96 buttons in 16 columns) in the last pattern 915 (120 buttons in 20 columns). As such, there are 12 bass notes in the first pattern 913 (72 buttons in 12 columns), 16 bass notes in the second pattern 914 (96 buttons in 16 columns) and 20 bass notes in the last pattern 915 (120 buttons in 20 columns). The note formulation in 20 columns 910 of Row#2 922 is a root of scale and chord.

The Row#3 923 includes 20 buttons of preset chords (triads) consisting of one combination of double flat note with flat note, three combination of flat note with flat note, three combination of flat note with natural note, four combination of natural note with natural note, five combination of natural note with sharp note, four combination of sharp note with sharp note. As shown in the embodiment depicted in FIG. 9, Ebb3+Fb3(C#3+E3) is located in Column X−9; Ab2+Cb3(Ab2+B2) is located in Column X−8; Eb3+Gb3 is located in Column X−7; Bb2+Db3 is located in Column X−6; F3+Ab3 is located in Column X−5; C3+Eb3 is located in Column X−4; G3+Bb3 is located in Column X−3; D3+F3 is located in Column X−2; A3+C4 is located in Column X−1; E3+G3 is located in Column X (center); B3+D4 is located in Column X+1; F#3+A3 is located in Column X+2; C#4+E4 is located in Column X+3; G#3+B3 is located in Column X+4; D#4+F##4 is located in Column X+5; A#3+C#4 is located in Column X+6; E#4+G#4 is located in Column X+7; B#3+D#4 is located in Column X+8; G4+A#4 (G4+Bb4) is located in Column X+9 and D4+E#4(D4+F4) is located in Column X+10. F3+Ab3, C3+Eb3, G3+Bb3, D3+F3, A3+C4, E3+G3, B3+D4, F#3+A3, C#4+E4, G#3+B3 and A#3+C#4 are elements of all patterns, i.e., the first pattern 913 (72 buttons in 12 columns), the second pattern 914 (96 buttons in 16 columns) as well as the last pattern 915 (120 buttons in 20 columns). On the other hand, Eb3+Gb3 (Column X−7), Bb2+Db3 (Column X−6), E#4+G#4 (Column X+7) and B#3+D#4 (Column X+8) are additional notes from the first pattern 913, the second pattern 914 (96 buttons in 16 columns) as well as the last pattern 915 (120 buttons in 20 columns). Similarly, Ebb3+Fb3(C#3+E3) (Column X−9), Ab2+Cb3(Ab2B2) (Column X−8), G4+A#4(G4+Bb4)(Column X+9) and D4+E#4(D4+F4)(Column X+10) are additional notes from the second pattern 914 (96 buttons in 16 columns) in the last pattern 915 (120 buttons in 20 columns). As such, there are 12 preset chords (triads) in the first pattern 913 (72 buttons in 12 columns), 16 preset chords (triads) in the second pattern 914 (96 buttons in 16 columns) and 20 preset chords (triads) in the last pattern 915 (120 buttons in 20 columns). The note formulation in 20 columns 910 of Row#3 923 is the Major Chord (Root form exclude root note), 3$^{rd}$ combines with 5$^{th}$ of Major chord.

The Row#4 924 includes 20 buttons of preset chords (triads) consisting of one combination of double flat note with natural note, three combination of double flat note with flat note, four combination of flat note with flat note, three combination of flat note with natural note, four combination of natural note with natural note, three combination of natural note with flat note, two combination of sharp note with sharp note. As shown in the embodiment depicted in FIG. 9, Bbb2+C3(A2+C3) is located in Column X−9; Fb3+Abb3(E3+G3) is located in Column X−8; Cb3+Ebb3(B2+D3) is located in Column X−7; Gb3+Bbb3(Gb3+A3) is located in Column X−6; Db3+Fb3(Db3+E3) is located in Column X−5; Ab3+Cb4(Ab3+B3) is located in Column X−4; Eb3+Gb3 is located in Column X−3; Bb3+Db4 is located in Column X−2; F3+Ab3 is located in Column X−1; C4+Eb4 is located in Column X (center); G3+Bb3 is located in Column X+1; D4+F4 is located in Column X+2; A3+C4 is located in Column X+3; E4+G4 is located in Column X+4; B3+D4 is located in Column X+5; F#4+A4 is located in Column X+6; C#4+E4 is located in Column X+7; G#4+B4 is located in Column X+8; D#4+F#4 is located in Column X+9 and A#3+C#4(Bb3+C#4) is located in Column X+10. Db3+Fb3(Db3+E3), Ab3+Cb4(Ab3+B3), Eb3+Gb3, Bb3+Db4, F3+Ab3, C4+Eb4, G3+Bb3, D4+F4, A3+C4, E4+G4, B3+D4 and F#4+A4 are elements of all patterns, i.e., the first pattern 913 (72 buttons in 12 columns), the second pattern 914 (96 buttons in 16 columns) as well as the last pattern 915 (120 buttons in 20 columns). On the other hand, Cb3+Ebb3(B2+D3) (Column X−7), Gb3+Bbb3(Gb3+A3) (Column X−6), C#4+E4 (Column X+7) and G#4+B4 (Column X+8) are additional notes from the first pattern 913, the second pattern 914 (96 buttons in 16 columns) as well as the last pattern 915 (120 buttons in 20 columns). Similarly, Bbb2+C3(A2+C3) (Column X−9), Fb3+Abb3(E2+G3) (Column X−8), D#4+F#4 (Column X+9) and A#3+C#4(Bb3+C#4) (Column X+10) are additional notes from the second pattern 914 (96 buttons in 16 columns) in the last pattern 915 (120 buttons in 20 columns). As such, there are 12 preset chords (triads) in the first pattern 913 (72 buttons in 12 columns), 16 preset chords (triads) in the second pattern 914 (96 buttons in 16 columns) and 20 preset chords (triads) in the last pattern 915 (120 buttons in 20 columns). The note formulation in 20 columns 910 of Row#4 924 is Minor chord (Root form exclude 5th) $1^{st}$ combines with $3^{rd}$ of Minor chord.

The Row#5 925 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 9, Bbb2+Ebb3(A2+C#3) is located in Column X−9; Fb2+Ab2(E2+Ab2) is located in Column X−8; Cb3+Eb3(B2+Eb3) is located in Column X−7; Gb2+Bb2 is located in Column X−6; Db3+F3 is located in Column X−5; Ab2+C3 is located in Column X−4; Eb3+G3 is located in Column X−3; Bb2+D3 is located in Column X−2; F3+A3 is located in Column X−1; C3+E3 is located in Column X (center); G3+B3 is located in Column X+1; D3+F#3 is located in Column X+2; A3+C#4 is located in Column X+3; E3+G#3 is located in Column X+4; B3+D#4 is located in Column X+5; F#3+A#3 is located in Column X+6; C#4+E#4(C#4+F4) is located in Column X+7; G#3+B#3(G#3+C4) is located in Column X+8; D#4+F##4(D#4+G4) is located in Column X+9 and A#3+C##4(Bb3#D4) is located in Column X+10. Db3+F3, Ab2+C3, Eb3+G3, Bb2+D3, F3+A3, C3+E3, G3+B3, D3+F#3, A3+C#4, E3+G#3, B3+D#4 and F#3+A#3 are elements of all patterns, i.e., the first pattern 913 (72 buttons in 12 columns), the second pattern 914 (96 buttons in 16 columns) as well as the last pattern 915 (120 buttons in 20 columns). On the other hand, Cb3+Eb3(B2+Eb3) (Column X−7), Gb2+Bb2 (Column X−6), C#4+E#4 (C#4+F4) (Column X+7) and G#3+B#3(G#3+C4) (Column X+8) are additional notes from the first pattern 913, the second pattern 914 (96 buttons in 16 columns) as well as the last pattern 915 (120 buttons in 20 columns). Similarly, Bbb2+Ebb3(A2+C#3) (Column X−9), Fb2+Ab2(E2+Ab2) (Column X−8), D#4+F##4(D#4+G4) (Column X+9) and A#3+C##4(Bb3#D4) (Column X+10) are additional notes from the second pattern 914 (96 buttons in 16 columns) in the last pattern 915 (120 buttons in 20 columns). As such, there are 12 preset chords (triads) in the first pattern 913 (72 buttons in 12 columns), 16 preset chords (triads) in the second pattern 914 (96 buttons in 16 columns) and 20 preset chords (triads) in the last pattern 915 (120 buttons in 20 columns). The note formulation in 20 columns 910 of Row#5 925 is the Major chord (Root Exclude $5^{th}$ note) $1^{st}$ combines with $3^{rd}$ of Major chord without $5^{th}$ note.

The Row#6 926 includes 20 buttons of preset chords (triads) consisting of one double flat note, seven flat note, seven natural note and four sharp note. As shown in the embodiment depicted in FIG. 9, Bbb0(A0) is located in Column X−9; Fb0(E0) is located in Column X−8; Cb1(B0) is located in Column X−7; Gb0 is located in Column X−6; Db1 is located in Column X−5; Ab0 is located in Column X−4; Eb1 is located in Column X−3; Bb0 is located in Column X−2; F1 is located in Column X−1; C1 is located in Column X (center); G1 is located in Column X+1; D1 is located in Column X+2; A1 is located in Column X+3; E1 is located in Column X+4; B1 is located in Column X+5; F#1 is located in Column X+6; C#2 is located in Column X+7; G#1 is located in Column X+8; D#2 is located in Column X+9 and A#1 is located in Column X+10. Db1, Ab0, Eb1, Bb0, F1, C1, G1, D1, A1, E1, B1 and F#1 are elements of all patterns, i.e., the first pattern 913 (72 buttons in 12 columns), the second pattern 914 (96 buttons in 16 columns) as well as the last pattern 915 (120 buttons in 20 columns). On the other hand, Cb1(B0) (Column X−7), Gb0 (Column X−6), C#2 (Column X+7) and G#1 (Column X+8) are additional notes from the first pattern 913, the second pattern 914 (96 buttons in 16 columns) as well as the last pattern 915 (120 buttons in 20 columns). Similarly, Bbb0 (A0) (Column X−9), Fb0(E0) (Column X−8), D#2 (Column X+9) and A#1 (Column X+10) are additional notes from the second pattern 914 (96 buttons in 16 columns) in the last pattern 915 (120 buttons in 20 columns). As such, there are 12 preset chords (triads) in the first pattern 913 (72 buttons in 12 columns), 16 preset chords (triads) in the second pattern 914 (96 buttons in 16 columns) and 20 preset chords (triads) in the last pattern 915 (120 buttons in 20 columns). The note formulation in 20 columns 910 of Row#6 926 is lower octave of root in Row#2 922.

This note layout has the ability to play fundamental chords of diatonic scale. It is very easy to play with Major Arpeggio sound alike by using single note or double notes that belong to Major chord, Very easy to play Minor Arpeggio sound alike by using single note or double notes that belong to minor, Very easy to play Dominant $7^{th}$ Arpeggio sound alike by using Single note or Double Notes that belong to Dominant $7^{th}$ Chord, Very easy to play Diminished Arpeggio Triad sound alike by using Single note or Double Notes that belong to Half Diminished Chord, Very easy to play Full Diminished Arpeggio sound alike by using Single note or Double Notes that belong to Full Diminished Chord, Very easy to play Minor Block Chord or Arpeggio with difference position or difference Column (optional Position).

This note layout has the ability to play extended chord by using only fixed Row1-Row5. It is very easy to play Minor Major $7^{th}$ Arpeggio sound alike by using Single note or Double Notes that belong to Major Chord, Difficult to play Minor $7^{th}$ flat $5^{th}$ Triad Arpeggio sound alike by using Single note or Double Notes that belong to Minor $7^{th}$ flat $5^{th}$ Triad Chord, Very easy to Major $7^{th}$ Arpeggio sound alike by using Single note or Double Notes that belong to Major Chord, Very easy to play Major $9^{th}$ Arpeggio sound alike by using Single note or Double Notes that belong to Major Chord.

This note layout has the ability to play Chord progression by using this note layout, it can also play ii-V(7)-I of Major Scale and I-IV-V and ii, iii, vi of Major Scale. But, its ability to play ii7b5-V-I of Minor Scale is moderate since it uses ii Dim (Triad) instead of ii7b5.

The ability to play a variety of Chord forms (Root form and inversion form) by using only fixed row 1-row 5. It is easy to play Major chord by using root form $2^{nd}$ inversion, Minor by using root form (use optional position), Dominant $7^{th}$ by using Root form $2^{nd}$ inversion, Half Diminished by using root form $2^{nd}$ inversion, Major $7^{th}$ by using root form $2^{nd}$ inversion, and Minor $7^{th}$ by using root form $2^{nd}$ inversion.

This note layout has an additional ability in that by using Row 6 to work with Row 1-Row 5. It can also play Minor chord $2^{nd}$ inversion, disco rhythm by using lower octave root in Row#2 922, and higher octave root in Row#6 926. This layout is good for music style such as Pop, Folk, and Light Classical.

Figure 10:
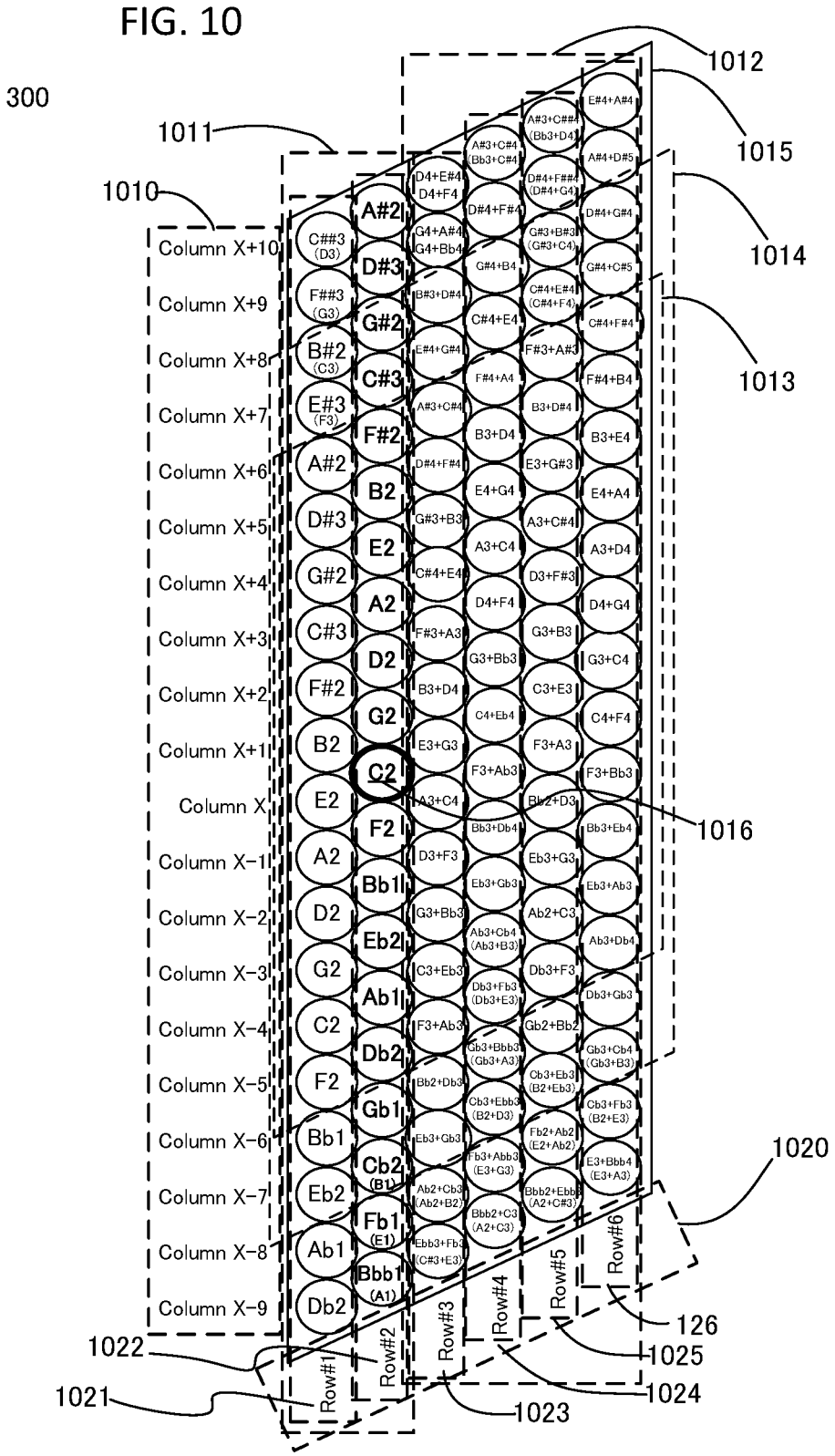
FIG. 10 is a diagram illustrating an example of chord tone pattern which contains double notes, 120 basses layer 2, Row $6^{th}$ has combination of perfect $5^{th}$ note plus higher octave of Row $2^{nd}$ (Perfect $4^{th}$ interval)

FIG. 10 illustrates an exploded view of the Chord Tone Pattern with double notes by fixed Row 1-5 by Row 6 is $5^{th}$ note combines with Root higher octave. As shown in this figure, the Chord Tone Pattern as shown of the present embodiment includes six rows of buttons 1020. The six rows of button 1020 are arranged in lines in a direction substantially orthogonal to an expansion and contraction direction of the bellow 300. Columns 1010 contain from 12 columns 1013, 16 columns 1014 and 20 columns 1015. The six rows of button 1020 with 12 columns 1013 contain about 72 basses. The six rows of button 1020 with 16 columns 1014 contain about 96 basses. The six rows of button 1020 with 20 columns 1015 contain about 120 basses. The six rows of buttons 1020 include 12 columns 1013 consisting of X−5, X−4, X−3, X−2, X−1, X, X+1, X+2, X+3, X+4, X+5 and X+6. The six rows of buttons 1020 include 16 columns 1014 consisting of X−7, X−6, X−5, X−4, X−3, X−2, X−1, X, X+1, X+2, X+3, X+4, X+5, X+6, X+7 and X+8. The six rows of buttons 1020 include 20 columns 1015 consisting of X−9, X−8, X−7, X−6, X−5, X−4, X−3, X−2, X−1, X, X+1, X+2, X+3, X+4, X+5, X+6, X+7, X+8, X+9 and X+10. Row#1 1021 and Row#2 1022 are assigned to base notes 1011. Row#3 1023, Row#4 1024, Row#5 1025 and Row#6 1026 are assigned to present chords 1012 (triads).

As shown in the embodiment depicted in FIG. 10, for each buttons from the six rows of buttons 1020 a number appears after a note. These numbers are octave numbers which are used for identifying the pitches in an octave. The octave number increases or decreases by one. A greater number refers to a higher octave while a smaller number refers to a lower octave. Though a "C4" is normally assigned as a middle C, a "C2" button 1016 is a C Root note, which is assigned as a middle C and located in Row#2 1022 and Column X, in order to solve the problem when playing the triad with the close contiguous 3 fingers by arranging 3 notes of major triad or minor triad in the column. This "C2" button 1016 allows more extension of directions both following the circle of fifths and the circle of fourths (Moving counter-clockwise in the direction of the circle of fifths).

The Row#1 1021 includes up to 20 buttons of bass consisting of four flat notes, seven natural notes, seven sharp notes and two double-sharp notes. As shown in the embodiment depicted in FIG. 10, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X-2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 1013 (72 buttons in 12 columns), the second pattern 1014 (96 buttons in 16 columns) as well as the last pattern 1015 (120 buttons in 20 columns). On the other hand, Eb2 (Column X−7), Bb1 (Column X−6), E#3(F3) (Column X+7) and B#2(C3) (Column X+8) are additional notes from the first pattern 1013, the second pattern 1014 (96 buttons in 16 columns) as well as the last pattern 1015 (120 buttons in 20 columns). Similarly, Db2 (Column X−9), Ab1 (Column X−8), F##3(G3) (Column X+9) and C##2(D3) (Column X+10) are additional notes from the second pattern 1014 (96 buttons in 16 columns) in the last pattern 1015 (120 buttons in 20 columns). As such, there are 12 bass notes in the first pattern 1013 (72 buttons in 12 columns), 16 bass notes in the second pattern 1014 (96 buttons in 16 columns) and 20 bass notes in the last pattern 1015 (120 buttons in 20 columns). The note formulation in 20 columns 1010 of Row#1 1021 is the $3^{rd}$ note in major scale count from root (major third note).

The Row#2 1022 includes 20 buttons of bass consisting of one double-flat note, seven flat notes, seven natural notes and five sharp notes. As shown in the embodiment depicted in FIG. 10, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 1013 (72 buttons in 12 columns), the second pattern 1014 (96 buttons in 16 columns) as well as the last pattern 1015 (120 buttons in 20 columns). On the other hand, Cb2(B1) (Column X−7), Gb1(F#1) (Column X−6), C#3 (Column X+7) and G#2 (Column X+8) are additional notes from the first pattern 1013, the second pattern 1014 (96 buttons in 16 columns) as well as the last pattern 1015 (120 buttons in 20 columns). Similarly, Bbb1(A1) (Column X−9), Fb1(E1) (Column X−8), D#3 (Column X+9) and A#2 (Column X+10) are additional notes from the second pattern 1014 (96 buttons in 16 columns) in the last pattern 1015 (120 buttons in 20 columns). As such, there are 12 bass notes in the first pattern 1013 (72 buttons in 12 columns), 16 bass notes in the second pattern 1014 (96 buttons in 16 columns) and 20 bass notes in the last pattern 1015 (120 buttons in 20 columns). The note formulation in 20 columns 1010 of Row#2 1022 is a root of scale and chord.

The Row#3 1023 includes 20 buttons of preset chords (triads) consisting of one combination of double flat note with flat note, three combination of flat note with flat note, three combination of flat note with natural note, four combination of natural note with natural note, five combination of natural note with sharp note, four combination of sharp note with sharp note. As shown in the embodiment depicted in FIG. 10, Ebb3+Fb3(C#3+E3) is located in Column X−9; Ab2+Cb3(Ab2+B2) is located in Column X−8; Eb3+Gb3 is located in Column X−7; Bb2+Db3 is located in Column X−6; F3+Ab3 is located in Column X−5; C3+Eb3 is located in Column X−4; G3+Bb3 is located in Column X−3; D3+F3 is located in Column X−2; A3+C4 is located in Column X−1; E3+G3 is located in Column X (center); B3+D4 is located in Column X+1; F#3+A3 is located in Column X+2; C#4+E4 is located in Column X+3; G#3+B3 is located in Column X+4; D#4+F##4 is located in Column X+5; A#3+C#4 is located in Column X+6; E#4+G#4 is located in Column X+7; B#3+D#4 is located in Column X+8; G4+A#4 (G4+Bb4) is located in Column X+9 and D4+E#4(D4+F4) is located in Column X+10. F3+Ab3, C3+Eb3, G3+Bb3, D3+F3, A3+C4, E3+G3, B3+D4, F#3+A3, C#4+E4, G#3+B3 and A#3+C#4 are elements of all patterns, i.e., the first pattern 1013 (72 buttons in 12 columns), the second pattern 1014 (96 buttons in 16 columns) as well as the last pattern 1015 (120 buttons in 20 columns). On the other hand, Eb3+Gb3 (Column X−7), Bb2+Db3 (Column X−6), E#4+G#4 (Column X+7) and B#3+D#4 (Column X+8) are additional notes from the first pattern 1013, the second pattern 1014 (96 buttons in 16 columns) as well as the last pattern 1015 (120 buttons in 20 columns). Similarly, Ebb3+Fb3 (C#3+E3) (Column X−9), Ab2+Cb3(Ab2B2) (Column X−8), G4+A#4(G4+Bb4)(Column X+9) and D4+E#4(D4+F4)(Column X+10) are additional notes from the second pattern 1014 (96 buttons in 16 columns) in the last pattern 1015 (120 buttons in 20 columns). As such, there are 12 preset chords (triads) in the first pattern 1013 (72 buttons in 12 columns), 16 preset chords (triads) in the second pattern 1014 (96 buttons in 16 columns) and 20 preset chords (triads) in the last pattern 1015 (120 buttons in 20 columns). The note formulation in 20 columns 1010 of Row#3 1023 is the Major Chord (Root form exclude root note), $3^{rd}$ combines with $5^{th}$ of Major chord.

The Row#4 1024 includes 20 buttons of preset chords (triads) consisting of one combination of double flat note with natural note, three combination of double flat note with flat note, four combination of flat note with flat note, three combination of flat note with natural note, four combination of natural note with natural note, three combination of natural note with flat note, two combination of sharp note with sharp note. As shown in the embodiment depicted in FIG. 10, Bbb2+C3(A2+C3) is located in Column X−9; Fb3+Abb3(E3+G3) is located in Column X−8; Cb3+Ebb3 (B2+D3) is located in Column X−7; Gb3+Bbb3(Gb3+A3) is located in Column X−6; Db3+Fb3(Db3+E3) is located in Column X−5; Ab3+Cb4(Ab3+B3) is located in Column X−4; Eb3+Gb3 is located in Column X−3; Bb3+Db4 is located in Column X−2; F3+Ab3 is located in Column X−1; C4+Eb4 is located in Column X (center); G3+Bb3 is located in Column X+1; D4+F4 is located in Column X+2; A3+C4 is located in Column X+3; E4+G4 is located in Column X+4; B3+D4 is located in Column X+5; F#4+A4 is located in Column X+6; C#4+E4 is located in Column X+7; G#4+B4 is located in Column X+8; D#4+F#4 is located in Column X+9 and A#3+C#4(Bb3+C#4) is located in Column X+10. Db3+Fb3(Db3+E3), Ab3+Cb4(Ab3+B3), Eb3+Gb3, Bb3+Db4, F3+Ab3, C4+Eb4, G3+Bb3, D4+F4, A3+C4, E4+G4, B3+D4 and F#4+A4 are elements of all patterns, i.e., the first pattern 1013 (72 buttons in 12 columns), the second pattern 1014 (96 buttons in 16 columns) as well as the last pattern 1015 (120 buttons in 20 columns). On the other hand, Cb3+Ebb3(B2+D3) (Column X−7), Gb3+Bbb3 (Gb3+A3) (Column X−6), C#4+E4 (Column X+7) and G#4+B4 (Column X+8) are additional notes from the first pattern 1013, the second pattern 1014 (96 buttons in 16 columns) as well as the last pattern 1015 (120 buttons in 20 columns). Similarly, Bbb2+C3(A2+C3) (Column X−9), Fb3+Abb3(E2+G3) (Column X−8), D#4+F#4 (Column X+9) and A#3+C#4(Bb3+C#4) (Column X+10) are additional notes from the second pattern 1014 (96 buttons in 16 columns) in the last pattern 1015 (120 buttons in 20 columns). As such, there are 12 preset chords (triads) in the first pattern 1013 (72 buttons in 12 columns), 16 preset chords (triads) in the second pattern 1014 (96 buttons in 16 columns) and 20 preset chords (triads) in the last pattern 1015 (120 buttons in 20 columns). The note formulation in 20 columns 1010 of Row#4 1024 is Minor chord (Root form exclude 5th) $1^{st}$ combines with $3^{rd}$ of Minor chord.

The Row#5 1025 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 10, Bbb2+Ebb3(A2+C#3) is located in Column X−9; Fb2+Ab2(E2+Ab2) is located in Column X−8; Cb3+Eb3 (B2+Eb3) is located in Column X−7; Gb2+Bb2 is located in Column X−6; Db3+F3 is located in Column X−5; Ab2+C3 is located in Column X−4; Eb3+G3 is located in Column X−3; Bb2+D3 is located in Column X−2; F3+A3 is located in Column X−1; C3+E3 is located in Column X (center); G3+B3 is located in Column X+1; D3+F#3 is located in Column X+2; A3+C#4 is located in Column X+3; E3+G#3 is located in Column X+4; B3+D#4 is located in Column X+5; F#3+A#3 is located in Column X+6; C#4+E#4(C#4+F4) is located in Column X+7; G#3+B#3(G#3+C4) is located in Column X+8; D#4+F##4(D#4+G4) is located in Column X+9 and A#3+C##4(Bb3#D4) is located in Column X+10. Db3+F3, Ab2+C3, Eb3+G3, Bb2+D3, F3+A3, C3+E3, G3+B3, D3+F#3, A3+C#4, E3+G#3, B3+D#4 and F#3+A#3 are elements of all patterns, i.e., the first pattern 1013 (72 buttons in 12 columns), the second pattern 1014 (96 buttons in 16 columns) as well as the last pattern 1015 (120 buttons in 20 columns). On the other hand, Cb3+Eb3 (B2+Eb3) (Column X−7), Gb2+Bb2 (Column X−6), C#4+E#4(C#4+F4) (Column X+7) and G#3+B#3(G#3+C4) (Column X+8) are additional notes from the first pattern 1013, the second pattern 1014 (96 buttons in 16 columns) as well as the last pattern 1015 (120 buttons in 20 columns). Similarly, Bbb2+Ebb3(A2+C#3) (Column X−9), Fb2+Ab2 (E2+Ab2) (Column X−8), D#4+F##4(D#4+G4) (Column X+9) and A#3+C##4(Bb3#D4) (Column X+10) are additional notes from the second pattern 1014 (96 buttons in 16 columns) in the last pattern 1015 (120 buttons in 20 columns). As such, there are 12 preset chords (triads) in the first pattern 1013 (72 buttons in 12 columns), 16 preset chords (triads) in the second pattern 1014 (96 buttons in 16 columns) and 20 preset chords (triads) in the last pattern 1015 (120 buttons in 20 columns). The note formulation in 20 columns 1010 of Row#5 1025 is the Major chord (Root Exclude $5^{th}$ note) $1^{st}$ note combines with $3^{rd}$ note of Major chord without $5^{th}$ note.

The Row#6 1026 includes 20 buttons of preset chords (triads) consisting of one combination of natural note with double flat note, six combination of flat note with flat note, one combination of flat note with natural note, six combination of natural note with natural note, one combination of natural note with flat note, five combination of sharp note with sharp note. As shown in the embodiment depicted in FIG. 10, E3+Bbb4(E3+A3) is located in Column X−9; Cb3+Fb3(B2+E3) is located in Column X−8; Gb3+Cb4 (Gb3+B3) is located in Column X−7; Db3+Gb3 is located in Column X−6; Ab3+Db4 is located in Column X−5; Eb3+Ab3 is located in Column X−4; Bb3+Eb4 is located in Column X−3; F3+Bb3 is located in Column X−2; C4+F4 is located in Column X−1; G3+C4 is located in Column X (center); D4+G4 is located in Column X+1; A3+D4 is located in Column X+2; E4+A4 is located in Column X+3; B3+E4 is located in Column X+4; F#4+B4 is located in Column X+5; C#4+F#4 is located in Column X+6; G#4+C#5 is located in Column X+7; D#4+G#4 is located in Column X+8; A#4+D#5 is located in Column X+9 and E#4+A#4 is located in Column X+10. Ab3+Db4, Eb3+Ab3, Bb3+Eb4, F3+Bb3, C4+F4, G3+C4, D4+G4, A3+D4, E4+A4, B3+E4, F#4+B4 and C#4+F#4 are elements of all patterns, i.e., the first pattern 1013 (72 buttons in 12 columns), the second pattern 1014 (96 buttons in 16 columns) as well as the last pattern 1015 (120 buttons in 20 columns). On the other hand, Gb3+Cb4(Gb3+B3) (Column X−7), Db3+Gb3 (Column X−6), G#4+C#5 (Column X+7) and D#4+G#4 (Column X+8) are additional notes from the first pattern 1013, the second pattern 1014 (96 buttons in 16 columns) as well as the last pattern 1015 (120 buttons in 20 columns). Similarly, E3+Bbb4(E3+A3) (Column X−9), Cb3+Fb3(B2+E3) (Column X−8), A#4+D#5 (Column X+9) and E#4+A#4 (Column X+10) are additional notes from the second pattern 1014 (96 buttons in 16 columns) in the last pattern 1015 (120 buttons in 20 columns). As such, there are 12 preset chords (triads) in the first pattern 1013 (72 buttons in 12 columns), 16 preset chords (triads) in the second pattern 1014 (96 buttons in 16 columns) and 20 preset chords (triads) in the last pattern 1015 (120 buttons in 20 columns). The note formulation in 20 columns 1010 of Row#6 1026 is the $5^{th}$ note combines with 2 higher octave of root note.

This note layout has the ability to play fundamental chords of diatonic scale. It is very easy to play with Major Arpeggio sound alike by using single note or double notes that belong to Major chord, Very easy to play Minor Arpeggio sound alike by using single note or double notes that belong to minor, Very easy to play Dominant $7^{th}$ Arpeggio sound alike by using Single note or Double Notes that belong to Dominant $7^{th}$ Chord, Very easy to play Diminished Arpeggio Triad sound alike by using Single note or Double Notes that belong to Half Diminished Chord, Very easy to play Full Diminished Arpeggio sound alike by using Single note or Double Notes that belong to Full Diminished Chord, Very easy to play Minor Block Chord or Arpeggio with difference position or difference Column (optional Position).

This note layout has the ability to play extended chord by using only fixed Row1-Row5. It is very easy to play Minor Major $7^{th}$ Arpeggio sound alike by using Single note or Double Notes that belong to Major Chord, Difficult to play Minor $7^{th}$ flat $5^{th}$ Triad Arpeggio sound alike by using Single note or Double Notes that belong to Minor $7^{th}$ flat $5^{th}$ Triad Chord, Very easy to Major $7^{th}$ Arpeggio sound alike by using Single note or Double Notes that belong to Major Chord, Very easy to play Major $9^{th}$ Arpeggio sound alike by using Single note or Double Notes that belong to Major Chord. The ability to play Chord progression by using this note layout is easy to play, it can play ii-V(7)-I of Major Scale and I-IV-V and ii, iii, vi of Major Scale. But ability to play ii7b5-V-I of Minor Scale is moderate since it used ii Dim (Triad) instead of ii7b5.

The ability to play a variety of Chord forms (Root form and inversion form) by using only fixed row 1-row 5. It is easy to play Major chord by using root form $2^{nd}$ inversion, Minor by using root form (use optional position), Dominant $7^{th}$ by using Root form $2^{nd}$ inversion, Half Diminished by using root form $2^{nd}$ inversion, Major $7^{th}$ by using root form $2^{nd}$ inversion, and Minor $7^{th}$ by using root form $2^{nd}$ inversion.

This note layout has an additional ability in that by using Row 6 to work with Row 1-Row 5. It can also play 1st inversion of Major Chord, nice Suspended Chord on the left-hand, and Have Major Fourth interval as ingredient to create a new chord or to use as harmony of right hand melody. This layout is good for music style such as Pop, and Light Classical.

Figure 11:
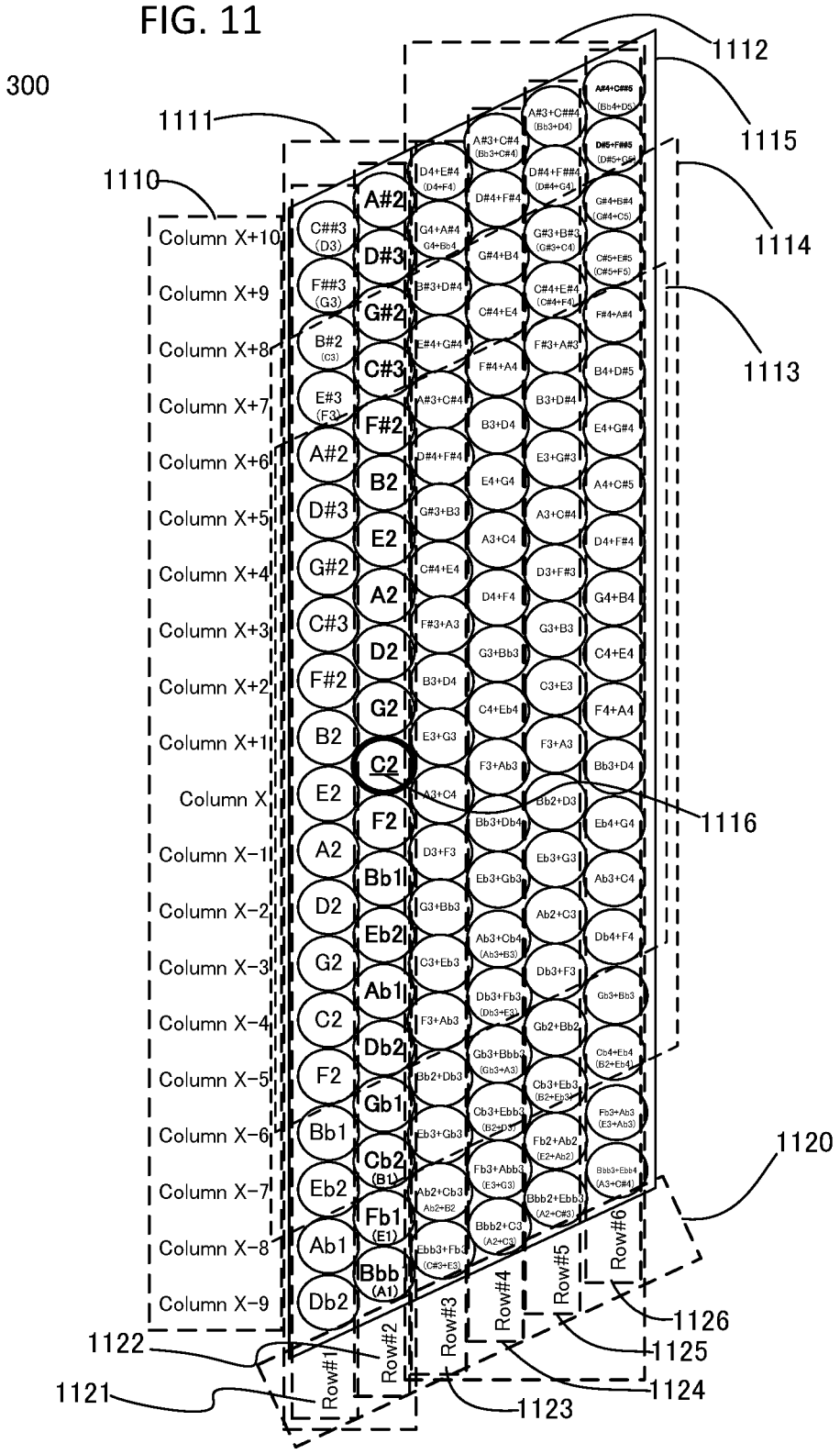
FIG. 11 is a diagram illustrating an example of chord tone pattern which contains double notes, 120 basses layer 3, Row $6^{th}$ has same pattern as row $5^{th}$ with 1 higher octave.

FIG. 11 illustrates an exploded view of the Chord Tone Pattern with double notes by fixed Row 1-5 by Row 6 is higher octave of Row 5. As shown in this figure, the Chord Tone Pattern of the present embodiment includes six rows of buttons 1120. The six rows of button 1120 are arranged in lines in a direction substantially orthogonal to an expansion and contraction direction of the bellow 300. Columns 1110 contain from 12 columns 1113, 16 columns 1114 and 20 columns 1115. The six rows of button 1120 with 12 columns 1113 contain about 72 basses. The six rows of button 1120 with 16 columns 1114 contain about 96 basses. The six rows of button 1120 with 20 columns 1115 contain about 120 basses. The six rows of buttons 1120 include 12 columns 1113 consisting of X−5, X−4, X−3, X−2, X−1, X, X+1, X+2, X+3, X+4, X+5 and X+6. The six rows of buttons 1120 include 16 columns 1114 consisting of X−7, X−6, X−5, X−4, X−3, X−2, X−1, X, X+1, X+2, X+3, X+4, X+5, X+6, X+7 and X+8. The six rows of buttons 1120 include 20 columns 1115 consisting of X−9, X−8, X−7, X−6, X−5, X−4, X−3, X−2, X−1, X, X+1, X+2, X+3, X+4, X+5, X+6, X+7, X+8, X+9 and X+10. Row#1 1121 and Row#2 1122 are assigned to base notes 1110. Row#3 1123, Row#4 1124, Row#5 1125 and Row#6 1126 are assigned to present chords 1112 (triads).

As shown in the embodiment depicted in FIG. 11, for each buttons from the six rows of buttons 1120 a number appears after a note. These numbers are octave numbers which are used for identifying the pitches in an octave. The octave number increases or decreases by one. sA greater number refers to a higher octave while a smaller number refers to a lower octave. Though a "C4" is normally assigned as a middle C, a "C2" button 1116 is a C Root note, which is assigned as a middle C and is located in Row#2 1122 and Column X, in order to solve the problem when playing the triad with the close contiguous 3 fingers by arranging 3 notes of major triad or minor triad in the column. This "C2" button 1116 allows more extension of directions both following the circle of fifths and the circle of fourths (Moving counter-clockwise in the direction of the circle of fifths).

The Row#1 1121 includes up to 20 buttons of bass consisting of four flat notes, seven natural notes, seven sharp notes and two double-sharp notes. As shown in the embodiment depicted in FIG. 11, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X−2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 1113 (72 buttons in 12 columns), the second pattern 1114 (96 buttons in 16 columns) as well as the last pattern 1115 (120 buttons in 20 columns). On the other hand, Eb2 (Column X−7), Bb1 (Column X−6), E#3(F3) (Column X+7) and B#2(C3) (Column X+8) are additional notes from the first pattern 1113, the second pattern 1114 (96 buttons in 16 columns) as well as the last pattern 1115 (120 buttons in 20 columns). Similarly, Db2 (Column X−9), Ab1 (Column X−8), F##3(G3) (Column X+9) and C##2(D3) (Column X+10) are additional notes from the second pattern 1114 (96 buttons in 16 columns) in the last pattern 1115 (120 buttons in 20 columns). As such, there are 12 bass notes in the first pattern 1113 (72 buttons in 12 columns), 16 bass notes in the second pattern 1114 (96 buttons in 16 columns) and 20 bass notes in the last pattern 1115 (120 buttons in 20 columns). The note formulation in 20 columns 1110 of Row#1 1121 is the $3^{rd}$ note in major scale count from root (major third note).

The Row#2 1122 includes 20 buttons of bass consisting of one double-flat note, seven flat notes, seven natural notes and five sharp notes. As shown in the embodiment depicted in FIG. 11, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 1113 (72 buttons in 12 columns), the second pattern 1114 (96 buttons in 16 columns) as well as the last pattern 1115 (120 buttons in 20 columns). On the other hand, Cb2(B1) (Column X−7), Gb1(F#1) (Column X−6), C#3 (Column X+7) and G#2 (Column X+8) are additional notes from the first pattern 1113, the second pattern 1114 (96 buttons in 16 columns) as well as the last pattern 1115 (120 buttons in 20 columns). Similarly, Bbb1(A1) (Column X−9), Fb1(E1) (Column X−8), D#3 (Column X+9) and A#2 (Column X+10) are additional notes from the second pattern 1114 (96 buttons in 16 columns) in the last pattern 1115 (120 buttons in 20 columns). As such, there are 12 bass notes in the first pattern 1113 (72 buttons in 12 columns), 16 bass notes in the second pattern 1114 (96 buttons in 16 columns) and 20 bass notes in the last pattern 1115 (120 buttons in 20 columns). The note formulation in 20 columns 1110 of Row#2 1122 is a root of scale and chord.

The Row#3 1123 includes 20 buttons of preset chords (triads) consisting of one combination of double flat note with flat note, three combination of flat note with flat note, three combination of flat note with natural note, four combination of natural note with natural note, five combination of natural note with sharp note, four combination of sharp note with sharp note. As shown in the embodiment depicted in FIG. 11, Ebb3+Fb3(C#3+E3) is located in Column X−9; Ab2+Cb3(Ab2+B2) is located in Column X−8; Eb3+Gb3 is located in Column X−7; Bb2+Db3 is located in Column X−6; F3+Ab3 is located in Column X−5; C3+Eb3 is located in Column X−4; G3+Bb3 is located in Column X−3; D3+F3 is located in Column X−2; A3+C4 is located in Column X−1; E3+G3 is located in Column X (center); B3+D4 is located in Column X+1; F#3+A3 is located in Column X+2; C#4+E4 is located in Column X+3; G#3+B3 is located in Column X+4; D#4+F##4 is located in Column X+5; A#3+C#4 is located in Column X+6; E#4+G#4 is located in Column X+7; B#3+D#4 is located in Column X+8; G4+A#4 (G4+Bb4) is located in Column X+9 and D4+E#4(D4+F4) is located in Column X+10. F3+Ab3, C3+Eb3, G3+Bb3, D3+F3, A3+C4, E3+G3, B3+D4, F#3+A3, C#4+E4, G#3+B3 and A#3+C#4 are elements of all patterns, i.e., the first pattern 1113 (72 buttons in 12 columns), the second pattern 1114 (96 buttons in 16 columns) as well as the last pattern 1115 (120 buttons in 20 columns). On the other hand, Eb3+Gb3 (Column X−7), Bb2+Db3 (Column X−6), E#4+G#4 (Column X+7) and B#3+D#4 (Column X+8) are additional notes from the first pattern 1113, the second pattern 1114 (96 buttons in 16 columns) as well as the last pattern 1115 (120 buttons in 20 columns). Similarly, Ebb3+Fb3 (C#3+E3) (Column X−9), Ab2+Cb3(Ab2B2) (Column X−8), G4+A#4(G4+Bb4)(Column X+9) and D4+E#4(D4+F4)(Column X+10) are additional notes from the second pattern 1114 (96 buttons in 16 columns) in the last pattern 1115 (120 buttons in 20 columns). As such, there are 12 preset chords (triads) in the first pattern 1113 (72 buttons in 12 columns), 16 preset chords (triads) in the second pattern 1114 (96 buttons in 16 columns) and 20 preset chords (triads) in the last pattern 1115 (120 buttons in 20 columns). The note formulation in 20 columns 1110 of Row#3 1123 is the Major Chord (Root form exclude root note), $3^{rd}$ combines with $5^{th}$ of Major chord.

The Row#4 1124 includes 20 buttons of preset chords (triads) consisting of one combination of double flat note with natural note, three combination of double flat note with flat note, four combination of flat note with flat note, three combination of flat note with natural note, four combination of natural note with natural note, three combination of natural note with flat note, two combination of sharp note with sharp note. As shown in the embodiment depicted in FIG. 11, Bbb2+C3(A2+C3) is located in Column X−9; Fb3+Abb3(E3+G3) is located in Column X−8; Cb3+Ebb3 (B2+D3) is located in Column X−7; Gb3+Bbb3(Gb3+A3) is located in Column X−6; Db3+Fb3(Db3+E3) is located in Column X−5; Ab3+Cb4(Ab3+B3) is located in Column X−4; Eb3+Gb3 is located in Column X−3; Bb3+Db4 is located in Column X−2; F3+Ab3 is located in Column X−1; C4+Eb4 is located in Column X (center); G3+Bb3 is located in Column X+1; D4+F4 is located in Column X+2; A3+C4 is located in Column X+3; E4+G4 is located in Column X+4; B3+D4 is located in Column X+5; F#4+A4 is located in Column X+6; C#4+E4 is located in Column X+7; G#4+B4 is located in Column X+8; D#4+F#4 is located in Column X+9 and A#3+C#4(Bb3+C#4) is located in Column X+10. Db3+Fb3(Db3+E3), Ab3+Cb4(Ab3+B3), Eb3+Gb3, Bb3+Db4, F3+Ab3, C4+Eb4, G3+Bb3, D4+F4, A3+C4, E4+G4, B3+D4 and F#4+A4 are elements of all patterns, i.e., the first pattern 1113 (72 buttons in 12 columns), the second pattern 1114 (96 buttons in 16 columns) as well as the last pattern 1115 (120 buttons in 20 columns). On the other hand, Cb3+Ebb3(B2+D3) (Column X−7), Gb3+Bbb3 (Gb3+A3) (Column X−6), C#4+E4 (Column X+7) and G#4+B4 (Column X+8) are additional notes from the first pattern 1113, the second pattern 1114 (96 buttons in 16 columns) as well as the last pattern 1115 (120 buttons in 20 columns). Similarly, Bbb2+C3(A2+C3) (Column X−9), Fb3+Abb3(E2+G3) (Column X−8), D#4+F#4 (Column X+9) and A#3+C#4(Bb3+C#4) (Column X+10) are additional notes from the second pattern 1114 (96 buttons in 16 columns) in the last pattern 1115 (120 buttons in 20 columns). As such, there are 12 preset chords (triads) in the first pattern 1113 (72 buttons in 12 columns), 16 preset chords (triads) in the second pattern 1114 (96 buttons in 16 columns) and 20 preset chords (triads) in the last pattern 1115 (120 buttons in 20 columns). The note formulation in 20 columns 1110 of Row#4 1124 is Minor chord (Root form exclude 5th) $1^{st}$ combines with $3^{rd}$ of Minor chord.

The Row#5 1125 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 11, Bbb2+Ebb3(A2+C#3) is located in Column X−9; Fb2+Ab2(E2+Ab2) is located in Column X−8; Cb3+Eb3 (B2+Eb3) is located in Column X−7; Gb2+Bb2 is located in Column X−6; Db3+F3 is located in Column X−5; Ab2+C3 is located in Column X−4; Eb3+G3 is located in Column X−3; Bb2+D3 is located in Column X−2; F3+A3 is located in Column X−1; C3+E3 is located in Column X (center); G3+B3 is located in Column X+1; D3+F#3 is located in Column X+2; A3+C#4 is located in Column X+3; E3+G#3 is located in Column X+4; B3+D#4 is located in Column X+5; F#3+A#3 is located in Column X+6; C#4+E#4(C#4+F4) is located in Column X+7; G#3+B#3(G#3+C4) is located in Column X+8; D#4+F##4(D#4+G4) is located in Column X+9 and A#3+C##4(Bb3#D4) is located in Column X+10. Db3+F3, Ab2+C3, Eb3+G3, Bb2+D3, F3+A3, C3+E3, G3+B3, D3+F#3, A3+C#4, E3+G#3, B3+D#4 and F#3+A#3 are elements of all patterns, i.e., the first pattern 1113 (72 buttons in 12 columns), the second pattern 1114 (96 buttons in 16 columns) as well as the last pattern 1115 (120 buttons in 20 columns). On the other hand, Cb3+Eb3(B2+Eb3) (Column X−7), Gb2+Bb2 (Column X−6), C#4+E#4 (C#4+F4) (Column X+7) and G#3+B#3(G#3+C4) (Column X+8) are additional notes from the first pattern 1113, the second pattern 1114 (96 buttons in 16 columns) as well as the last pattern 1115 (120 buttons in 20 columns). Similarly, Bbb2+Ebb3(A2+C#3) (Column X−9), Fb2+Ab2(E2+Ab2) (Column X−8), D#4+F##4(D#4+G4) (Column X+9) and A#3+C##4(Bb3#D4) (Column X+10) are additional notes from the second pattern 1114 (96 buttons in 16 columns) in the last pattern 1115 (120 buttons in 20 columns). As such, there are 12 preset chords (triads) in the first pattern 1113 (72 buttons in 12 columns), 16 preset chords (triads) in the second pattern 1114 (96 buttons in 16 columns) and 20 preset chords (triads) in the last pattern 1115 (120 buttons in 20 columns). The note formulation in 20 columns 1110 of Row#5 1125 is the Major chord (Root Exclude $5^{th}$ note) 1st note combines with $3^{rd}$ note of Major chord without $5^{th}$ note.

The Row#6 1126 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 11, Bbb3+Ebb4(A3+C#4) is located in Column X−9; Fb3+Ab3(E3+Ab3) is located in Column X−8; Cb4+Eb4 (B3+Eb4) is located in Column X−7; Gb3+Bb3 is located in Column X−6; Db4+F4 is located in Column X−5; Ab3+C4 is located in Column X−4; Eb4+G4 is located in Column X−3; Bb3+D4 is located in Column X−2; F4+A4 is located in Column X−1; C4+E4 is located in Column X (center); G4+B4 is located in Column X+1; D4+F#4 is located in Column X+2; A4+C#5 is located in Column X+3; E4+G#4 is located in Column X+4; B4+D#5 is located in Column X+5; F#4+A#4 is located in Column X+6; C#5+E#5(C#5+F5) is located in Column X+7; G#4+B#4(G#4+C5) is located in Column X+8; D#5+F##5(D#5+G5) is located in Column X+9 and A#4+C##5(Bb4+D5) is located in Column X+10. Db4+F4, Ab3+C4, Eb4+G4, Bb3+D4, F4+A4, C4+E4, G4+B4, D4+F#4, A4+C#5, E4+G#4, B4+D#5, F#4+A#4 are elements of all patterns, i.e., the first pattern 1113 (72 buttons in 12 columns), the second pattern 1114 (96 buttons in 16 columns) as well as the last pattern 1115 (120 buttons in 20 columns). On the other hand, Cb4+Eb4(B3+Eb4) (Column X−7), Gb3+Bb3 (Column X−6), C#5+E#5 (C#5+F5) (Column X+7) and G#4+B#4(G#4+C5) (Column X+8) are additional notes from the first pattern 1113, the second pattern 1114 (96 buttons in 16 columns) as well as the last pattern 1115 (120 buttons in 20 columns). Similarly, Bbb3+Ebb4(A3+C#4) (Column X−9), Fb3+Ab3(E3+Ab3) (Column X−8), D#5+F##5(D#5+G5) (Column X+9) and A#4+C##5(Bb4+D5) (Column X+10) are additional notes from the second pattern 1114 (96 buttons in 16 columns) in the last pattern 1115 (120 buttons in 20 columns). As such, there are 12 preset chords (triads) in the first pattern 1113 (72 buttons in 12 columns), 16 preset chords (triads) in the second pattern 1114 (96 buttons in 16 columns) and 20 preset chords (triads) in the last pattern 1115 (120 buttons in 20 columns). The note formulation in 20 columns 1110 of Row#6 1126 is same pattern as Row#5 1125 with 1 higher octave.

This note layout has the ability to play fundamental chords of diatonic scale. It is very easy to play with Major Arpeggio sound alike by using single note or double notes that belong to Major chord, Very easy to play Minor Arpeggio sound alike by using single note or double notes that belong to minor, Very easy to play Dominant $7^{th}$ Arpeggio sound alike by using Single note or Double Notes that belong to Dominant $7^{th}$ Chord, Very easy to play Diminished Arpeggio Triad sound alike by using Single note or Double Notes that belong to Half Diminished Chord, Very easy to play Full Diminished Arpeggio sound alike by using Single note or Double Notes that belong to Full Diminished Chord, Very easy to play Minor Block Chord or Arpeggio with difference position or difference Column (optional Position).

This note layout has the ability to play extended chord by using only fixed Row1-Row5. It is very easy to play Minor Major $7^{th}$ Arpeggio sound alike by using Single note or Double Notes that belong to Major Chord, Difficult to play Minor $7^{th}$ flat $5^{th}$ Triad Arpeggio sound alike by using Single note or Double Notes that belong to Minor $7^{th}$ flat $5^{th}$ Triad Chord, Very easy to Major $7^{th}$ Arpeggio sound alike by using Single note or Double Notes that belong to Major Chord, Very easy to play Major $9^{th}$ Arpeggio sound alike by using Single note or Double Notes that belong to Major Chord.

The ability to play Chord progression by using this note layout is easy to play, it can also play ii-V(7)-I of Major Scale and I-IV-V and ii, iii, vi of Major Scale. But ability to play ii7b5-V-I of Minor Scale is moderate since it used ii Dim (Triad) instead of ii7b5.

The ability to play a variety of Chord forms (Root form and inversion form) by using only fixed row 1-row 5. t is easy to play Major chord by using root form $2^{nd}$ inversion, Minor by using root form (use optional position), Dominant $7^{th}$ by using Root form $2^{nd}$ inversion, Half Diminished by using root form $2^{nd}$ inversion, Major $7^{th}$ by using root form $2^{nd}$ inversion, and Minor $7^{th}$ by using root form $2^{nd}$ inversion.

This note layout has an additional ability in that by using Row 6 to work with Row 1-Row 5. It can also play Major Chord with wider Octave sound. Additionally, it can play Major $7^{th}$ with Root and $2^{nd}$ inversion form for all chords. This layout is good for music style such as Jazz.

Figure 12:
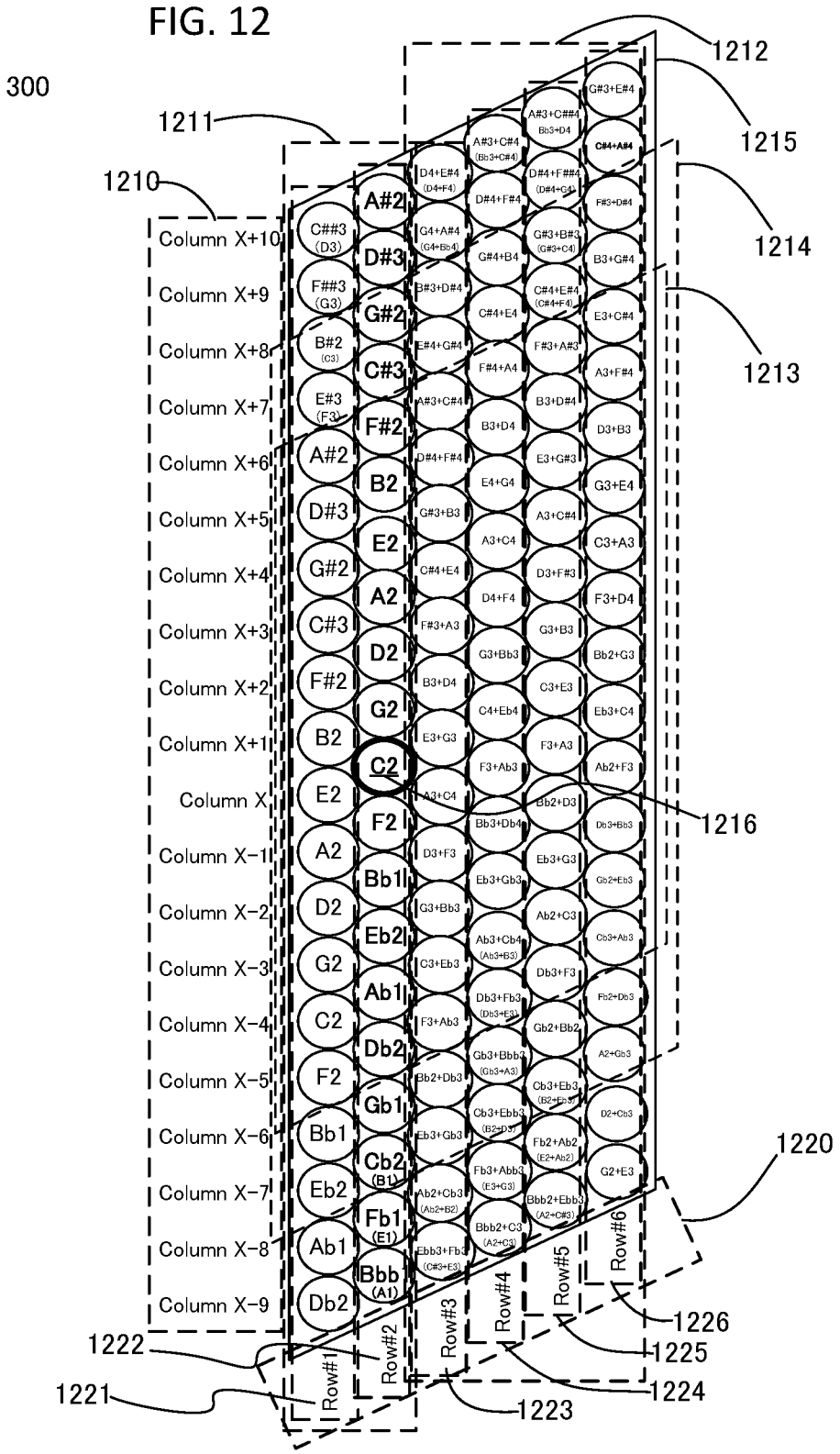
FIG. 12 is a diagram illustrating an example of chord tone pattern which contains double notes, 120 basses layer 4. Row $6^{th}$ contains lower octave minor $7^{th}$ plus $5^{th}$ of root. (Major $6^{th}$ interval)

FIG. 12 illustrates an exploded view of the Chord Tone Pattern with double notes by fixed Row 1-5 by Row 6 is lower octave Minor $7^{th}$ combines with $5^{th}$ of root. As shown in this figure, the Chord Tone Pattern of the present embodiment includes six rows of buttons 1220. The six rows of button 1220 are arranged in lines in a direction substantially orthogonal to an expansion and contraction direction of the bellow 300. Columns 1210 contain from 12 columns 1213, 16 columns 1214 and 20 columns 1215. The six rows of button 1220 with 12 columns 1213 contain about 72 basses. The six rows of button 1220 with 16 columns 1214 contain about 96 basses. The six rows of button 1220 with 20 columns 1215 contain about 120 basses. The six rows of buttons 1220 include 12 columns 1213 consisting of X−5, X−4, X−3, X−2, X−1, X, X+1, X+2, X+3, X+4, X+5 and X+6. The six rows of buttons 1220 include 16 columns 1214 consisting of X−7, X−6, X−5, X−4, X−3, X−2, X−1, X, X+1, X+2, X+3, X+4, X+5, X+6, X+7 and X+8. The six rows of buttons 1220 include 20 columns 1215 consisting of X−9, X−8, X−7, X−6, X−5, X−4, X−3, X−2, X−1, X, X+1, X+2, X+3, X+4, X+5, X+6, X+7, X+8, X+9 and X+10. Row#1 1221 and Row#2 1222 are assigned to base notes 1210. Row#3 1223, Row#4 1224, Row#5 1225 and Row#6 1226 are assigned to present chords 1212 (triads).

As shown in the embodiment depicted in FIG. 12, for each buttons from the six rows of buttons 1220 a number appears after a note. These numbers are octave numbers which are used for identifying the pitches in an octave. The octave number increases or decreases by one. A greater number refers to a higher octave while a smaller number refers to a lower octave. Though a "C4" is normally assigned as a middle C, a "C2" button 1216 is a C Root note, which is assigned as a middle C and is located in Row#2 1222 and Column X, in order to solve the problem when playing the triad with the close contiguous 3 fingers by arranging 3 notes of major triad or minor triad in the column. This "C2" button 1216 allows more extension of directions both following the circle of fifths and the circle of fourths (Moving counter-clockwise in the direction of the circle of fifths).

The Row#1 1221 includes up to 20 buttons of bass consisting of four flat notes, seven natural notes, seven sharp notes and two double-sharp notes. As shown in the embodiment depicted in FIG. 12, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X−2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 1213 (72 buttons in 12 columns), the second pattern 1214 (96 buttons in 16 columns) as well as the last pattern 1215 (120 buttons in 20 columns). On the other hand, Eb2 (Column X−7), Bb1 (Column X−6), E#3(F3) (Column X+7) and B#2(C3) (Column X+8) are additional notes from the first pattern 1213, the second pattern 1214 (96 buttons in 16 columns) as well as the last pattern 1215 (120 buttons in 20 columns). Similarly, Db2 (Column X−9), Ab1 (Column X−8), F##3(G3) (Column X+9) and C##2(D3) (Column X+10) are additional notes from the second pattern 1214 (96 buttons in 16 columns) in the last pattern 1215 (120 buttons in 20 columns). As such, there are 12 bass notes in the first pattern 1213 (72 buttons in 12 columns), 16 bass notes in the second pattern 1214 (96 buttons in 16 columns) and 20 bass notes in the last pattern 1215 (120 buttons in 20 columns). The note formulation in 20 columns 1210 of Row#1 1221 is the $3^{rd}$ note in major scale count from root (major third note).

The Row#2 1222 includes 20 buttons of bass consisting of one double-flat note, seven flat notes, seven natural notes and five sharp notes. As shown in the embodiment depicted in FIG. 12, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 1213 (72 buttons in 12 columns), the second pattern 1214 (96 buttons in 16 columns) as well as the last pattern 1215 (120 buttons in 20 columns). On the other hand, Cb2(B1) (Column X−7), Gb1(F#1) (Column X−6), C#3 (Column X+7) and G#2 (Column X+8) are additional notes from the first pattern 1213, the second pattern 1214 (96 buttons in 16 columns) as well as the last pattern 1215 (120 buttons in 20 columns). Similarly, Bbb1(A1) (Column X−9), Fb1(E1) (Column X−8), D#3 (Column X+9) and A#2 (Column X+10) are additional notes from the second pattern 1214 (96 buttons in 16 columns) in the last pattern 1215 (120 buttons in 20 columns). As such, there are 12 bass notes in the first pattern 1213 (72 buttons in 12 columns), 16 bass notes in the second pattern 1214 (96 buttons in 16 columns) and 20 bass notes in the last pattern 1215 (120 buttons in 20 columns). The note formulation in 20 columns 1210 of Row#2 1222 is a root of scale and chord.

The Row#3 1223 includes 20 buttons of preset chords (triads) consisting of one combination of double flat note with flat note, three combination of flat note with flat note, three combination of flat note with natural note, four combination of natural note with natural note, five combination of natural note with sharp note, four combination of sharp note with sharp note. As shown in the embodiment depicted in FIG. 12, Ebb3+Fb3(C#3+E3) is located in Column X−9; Ab2+Cb3(Ab2+B2) is located in Column X−8; Eb3+Gb3 is located in Column X−7; Bb2+Db3 is located in Column X−6; F3+Ab3 is located in Column X−5; C3+Eb3 is located in Column X−4; G3+Bb3 is located in Column X−3; D3+F3 is located in Column X−2; A3+C4 is located in Column X−1; E3+G3 is located in Column X (center); B3+D4 is located in Column X+1; F#3+A3 is located in Column X+2;

C#4+E4 is located in Column X+3; G#3+B3 is located in Column X+4; D#4+F##4 is located in Column X+5; A#3+C#4 is located in Column X+6; E#4+G#4 is located in Column X+7; B#3+D#4 is located in Column X+8; G4+A#4 (G4+Bb4) is located in Column X+9 and D4+E#4(D4+F4) is located in Column X+10. F3+Ab3, C3+Eb3, G3+Bb3, D3+F3, A3+C4, E3+G3, B3+D4, F#3+A3, C#4+E4, G#3+B3 and A#3+C#4 are elements of all patterns, i.e., the first pattern 1213 (72 buttons in 12 columns), the second pattern 1214 (96 buttons in 16 columns) as well as the last pattern 1215 (120 buttons in 20 columns). On the other hand, Eb3+Gb3 (Column X−7), Bb2+Db3 (Column X−6), E#4+G#4 (Column X+7) and B#3+D#4 (Column X+8) are additional notes from the first pattern 1213, the second pattern 1214 (96 buttons in 16 columns) as well as the last pattern 1215 (120 buttons in 20 columns). Similarly, Ebb3+Fb3 (C#3+E3) (Column X−9), Ab2+Cb3(Ab2B2) (Column X−8), G4+A#4(G4+Bb4)(Column X+9) and D4+E#4(D4+F4)(Column X+10) are additional notes from the second pattern 1214 (96 buttons in 16 columns) in the last pattern 1215 (120 buttons in 20 columns). As such, there are 12 preset chords (triads) in the first pattern 1213 (72 buttons in 12 columns), 16 preset chords (triads) in the second pattern 1214 (96 buttons in 16 columns) and 20 preset chords (triads) in the last pattern 1215 (120 buttons in 20 columns). The note formulation in 20 columns 1210 of Row#3 1223 is the Major Chord (Root form exclude root note), $3^{rd}$ combines with $5^{th}$ of Major chord.

The Row#4 1224 includes 20 buttons of preset chords (triads) consisting of one combination of double flat note with natural note, three combination of double flat note with flat note, four combination of flat note with flat note, three combination of flat note with natural note, four combination of natural note with natural note, three combination of natural note with flat note, two combination of sharp note with sharp note. As shown in the embodiment depicted in FIG. 12, Bbb2+C3(A2+C3) is located in Column X−9; Fb3+Abb3(E3+G3) is located in Column X−8; Cb3+Ebb3 (B2+D3) is located in Column X−7; Gb3+Bbb3(Gb3+A3) is located in Column X−6; Db3+Fb3(Db3+E3) is located in Column X−5; Ab3+Cb4(Ab3+B3) is located in Column X−4; Eb3+Gb3 is located in Column X−3; Bb3+Db4 is located in Column X−2; F3+Ab3 is located in Column X−1; C4+Eb4 is located in Column X (center); G3+Bb3 is located in Column X+1; D4+F4 is located in Column X+2; A3+C4 is located in Column X+3; E4+G4 is located in Column X+4; B3+D4 is located in Column X+5; F#4+A4 is located in Column X+6; C#4+E4 is located in Column X+7; G#4+B4 is located in Column X+8; D#4+F#4 is located in Column X+9 and A#3+C#4(Bb3+C#4) is located in Column X+10. Db3+Fb3(Db3+E3), Ab3+Cb4(Ab3+B3), Eb3+Gb3, Bb3+Db4, F3+Ab3, C4+Eb4, G3+Bb3, D4+F4, A3+C4, E4+G4, B3+D4 and F#4+A4 are elements of all patterns, i.e., the first pattern 1213 (72 buttons in 12 columns), the second pattern 1214 (96 buttons in 16 columns) as well as the last pattern 1215 (120 buttons in 20 columns). On the other hand, Cb3+Ebb3(B2+D3) (Column X−7), Gb3+Bbb3 (Gb3+A3) (Column X−6), C#4+E4 (Column X+7) and G#4+B4 (Column X+8) are additional notes from the first pattern 1213, the second pattern 1214 (96 buttons in 16 columns) as well as the last pattern 1215 (120 buttons in 20 columns). Similarly, Bbb2+C3(A2+C3) (Column X−9), Fb3+Abb3(E2+G3) (Column X−8), D#4+F#4 (Column X+9) and A#3+C#4(Bb3+C#4) (Column X+10) are additional notes from the second pattern 1214 (96 buttons in 16 columns) in the last pattern 1215 (120 buttons in 20 columns). As such, there are 12 preset chords (triads) in the first pattern 1213 (72 buttons in 12 columns), 16 preset chords (triads) in the second pattern 1214 (96 buttons in 16 columns) and 20 preset chords (triads) in the last pattern 1215 (120 buttons in 20 columns). The note formulation in 20 columns 1210 of Row#4 1224 is Minor chord (Root form exclude $5^{th}$) $1^{st}$ combines with $3^{rd}$ of Minor chord.

The Row#5 1225 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 12, Bbb2+Ebb3(A2+C#3) is located in Column X−9; Fb2+Ab2(E2+Ab2) is located in Column X−8; Cb3+Eb3 (B2+Eb3) is located in Column X−7; Gb2+Bb2 is located in Column X−6; Db3+F3 is located in Column X−5; Ab2+C3 is located in Column X−4; Eb3+G3 is located in Column X−3; Bb2+D3 is located in Column X−2; F3+A3 is located in Column X−1; C3+E3 is located in Column X (center); G3+B3 is located in Column X+1; D3+F#3 is located in Column X+2; A3+C#4 is located in Column X+3; E3+G#3 is located in Column X+4; B3+D#4 is located in Column X+5; F#3+A#3 is located in Column X+6; C#4+E#4(C#4+F4) is located in Column X+7; G#3+B#3(G#3+C4) is located in Column X+8; D#4+F##4(D#4+G4) is located in Column X+9 and A#3+C##4(Bb3#D4) is located in Column X+10. Db3+F3, Ab2+C3, Eb3+G3, Bb2+D3, F3+A3, C3+E3, G3+B3, D3+F#3, A3+C#4, E3+G#3, B3+D#4 and F#3+A#3 are elements of all patterns, i.e., the first pattern 1213 (72 buttons in 12 columns), the second pattern 1214 (96 buttons in 16 columns) as well as the last pattern 1215 (120 buttons in 20 columns). On the other hand, Cb3+Eb3 (B2+Eb3) (Column X−7), Gb2+Bb2 (Column X−6), C#4+E#4(C#4+F4) (Column X+7) and G#3+B#3(G#3+C4) (Column X+8) are additional notes from the first pattern 1213, the second pattern 1214 (96 buttons in 16 columns) as well as the last pattern 1215 (120 buttons in 20 columns). Similarly, Bbb2+Ebb3(A2+C#3) (Column X−9), Fb2+Ab2 (E2+Ab2) (Column X−8), D#4+F##4(D#4+G4) (Column X+9) and A#3+C##4(Bb3#D4) (Column X+10) are additional notes from the second pattern 1214 (96 buttons in 16 columns) in the last pattern 1215 (120 buttons in 20 columns). As such, there are 12 preset chords (triads) in the first pattern 1213 (72 buttons in 12 columns), 16 preset chords (triads) in the second pattern 1214 (96 buttons in 16 columns) and 20 preset chords (triads) in the last pattern 1215 (120 buttons in 20 columns). The note formulation in 20 columns 1210 of Row#5 1225 is the Major chord (Root Exclude $5^{th}$ note) $1^{st}$ note combines with $3^{rd}$ note of Major chord without $5^{th}$ note.

The Row#6 1226 includes 20 buttons of preset chords (triads) consisting of four combination of flat note with flat note, five combination of natural note with natural note, five combination of natural note with flat note, three combination of natural note with sharp note, three combination of natural note with sharp note. As shown in the embodiment depicted in FIG. 12, G2+E3 is located in Column X−9; D2+Cb3 is located in Column X−8; A2+Gb3 is located in Column X−7; Fb2+Db3 is located in Column X−6; Cb3+Ab3 is located in Column X−5; Gb2+Eb3 is located in Column X−4; Db3+Bb3 is located in Column X−3; Ab2+F3 is located in Column X−2; Eb3+C4 is located in Column X−1; Bb2+G3 is located in Column X (center); F3+D4 is located in Column X+1; C3+A3 is located in Column X+2; G3+E4 is located in Column X+3; D3+B3 is located in Column X+4;

A3+F#4 is located in Column X+5; E3+C#4 is located in Column X+6; B3+G#4 is located in Column X+7; F#3+D#4 is located in Column X+8; C#4+A#4 is located in Column X+9 and G#3+E#4 is located in Column X+10. Cb3+Ab3, Gb2+Eb3, Db3+Bb3, Ab2+F3, Eb3+C4, Bb2+G3, F3+D4, C3+A3, G3+E4, D3+B3, A3+F#4, E3+C#4 are elements of all patterns, i.e., the first pattern 1213 (72 buttons in 12 columns), the second pattern 814 (96 buttons in 16 columns) as well as the last pattern 1215 (120 buttons in 20 columns). On the other hand, A2+Gb3 (Column X−7), Fb2+Db3 (Column X−6), B3+G#4 (Column X+7) and F#3+D#4 (Column X+8) are additional notes from the first pattern 1213, the second pattern 1214 (96 buttons in 16 columns) as well as the last pattern 1215 (120 buttons in 20 columns). Similarly, G2+E3 (Column X−9), D2+Cb3 (Column X−8), C#4+A#4 (Column X+9) and G#3+E#4 Column X+10) are additional notes from the second pattern 1214 (96 buttons in 16 columns) in the last pattern 1215 (120 buttons in 20 columns). As such, there are 12 preset chords (triads) in the first pattern 1213 (72 buttons in 12 columns), 16 preset chords (triads) in the second pattern 1214 (96 buttons in 16 columns) and 20 preset chords (triads) in the last pattern 1215 (120 buttons in 20 columns). The note formulation in 20 columns 1210 of Row#6 1226 is lower octave minor $7^{th}$ combining with $5^{th}$ of root note.

This note layout has the ability to play fundamental chords of diatonic scale. It is very easy to play with Major Arpeggio sound alike by using single note or double notes that belong to Major chord, Very easy to play Minor Arpeggio sound alike by using single note or double notes that belong to minor, Very easy to play Dominant $7^{th}$ Arpeggio sound alike by using Single note or Double Notes that belong to Dominant $7^{th}$ Chord, Very easy to play Diminished Arpeggio Triad sound alike by using Single note or Double Notes that belong to Half Diminished Chord, Very easy to play Full Diminished Arpeggio sound alike by using Single note or Double Notes that belong to Full Diminished Chord, Very easy to play Minor Block Chord or Arpeggio with difference position or difference Column (optional Position).

This note layout has the ability to play extended chord by using only fixed Row1-Row5. It is very easy to play Minor Major $7^{th}$ Arpeggio sound alike by using Single note or Double Notes that belong to Major Chord, Difficult to play Minor $7^{th}$ flat $5^{th}$ Triad Arpeggio sound alike by using Single note or Double Notes that belong to Minor $7^{th}$ flat $5^{th}$ Triad Chord, Very easy to Major $7^{th}$ Arpeggio sound alike by using Single note or Double Notes that belong to Major Chord, Very easy to play Major $9^{th}$ Arpeggio sound alike by using Single note or Double Notes that belong to Major Chord.

This note layout can easily play Chord progression by using this note layout, it can also play ii-V(7)-I of Major Scale and I-IV-V and ii, iii, vi of Major Scale. But, the ability to play ii7b5-V-I of Minor Scale is moderate since it used ii Dim (Triad) instead of ii7b5.

The ability to play a variety Chord forms (Root form and inversion form) by using only fixed row 1-row 5. It is easy to play Major chord by using root form $2^{nd}$ inversion, Minor by using root form (use optional position), Dominant $7^{th}$ by using Root form $2^{nd}$ inversion, Half Diminished by using root form $2^{nd}$ inversion, Major $7^{th}$ by using root form $2^{nd}$ inversion, and Minor $7^{th}$ by using root form $2^{nd}$ inversion.

This note layout has an additional ability in that by using Row 6 to work with Row 1-Row 5. It can Play Dominant $7^{th}$ Chord with 2 Inversions (forms) for all chord, and half of that can play Dominant $7^{th}$ with 3 Inversions (forms), It has Major Sixth interval as ingredient to create new chord or to use as harmony of right hand melody. This layout is good for music style such as Pop, Jazz and Blues.

Figure 13:
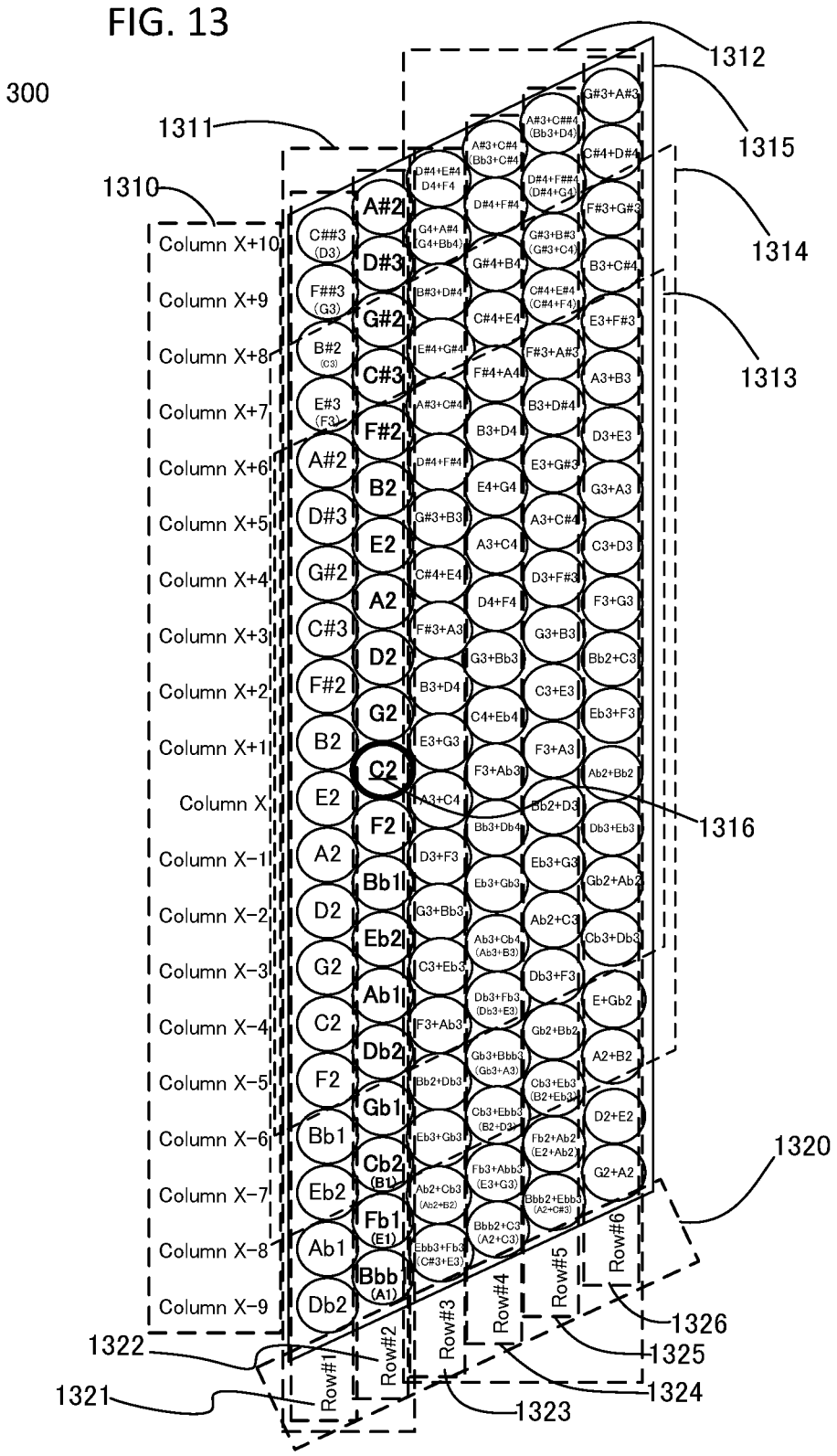
FIG. 13 is a diagram illustrating an example of chord tone pattern which contains double notes, 120 basses layer 5. Row $6^{th}$ contains lower octave minor $7^{th}$ plus root note. (Major $2^{nd}$ interval)

FIG. 13 illustrates an exploded view of the Chord Tone Pattern with double notes by fixed Row 1-5 by Row 6 is lower octave of Minor $7^{th}$ combines with root note. As shown in this figure, the Chord Tone Pattern of the present embodiment includes six rows of buttons 1320. The six rows of button 1320 are arranged in lines in a direction substantially orthogonal to an expansion and contraction direction of the bellow 300. Columns 1310 contain from 12 columns 1313, 16 columns 1314 and 20 columns 1315. The six rows of button 1320 with 12 columns 1313 contain about 72 basses. The six rows of button 1320 with 16 columns 1314 contain about 96 basses. The six rows of button 1320 with 20 columns 1315 contain about 120 basses. The six rows of buttons 1320 include 12 columns 1313 consisting of X−5, X−4, X−3, X−2, X−1, X, X+1, X+2, X+3, X+4, X+5 and X+6. The six rows of buttons 1320 include 16 columns 1314 consisting of X−7, X−6, X−5, X−4, X−3, X−2, X−1, X, X+1, X+2, X+3, X+4, X+5, X+6, X+7 and X+8. The six rows of buttons 1320 include 20 columns 1315 consisting of X−9, X−8, X−7, X−6, X−5, X−4, X−3, X−2, X−1, X, X+1, X+2, X+3, X+4, X+5, X+6, X+7, X+8, X+9 and X+10. Row#1 1321 and Row#2 1322 are assigned to base notes 1310. Row#3 1323, Row#4 1324, Row#5 1325 and Row#6 1326 are assigned to present chords 1312 (triads).

As shown in the embodiment depicted in FIG. 13, for each buttons from the six rows of buttons 1320 a number appears after a note. These numbers are octave numbers which are used for identifying the pitches in an octave. The octave number increases or decreases by one. A greater number refers to a higher octave while a smaller number refers to a lower octave. Though a "C4" is normally assigned as a middle C, a "C2" button 1316 is a C Root note, which is assigned as a middle C and is located in Row#2 1322 and Column X, in order to solve the problem when playing the triad with the close contiguous 3 fingers by arranging 3 notes of major triad or minor triad in the column. This "C2" button 1316 allows more extension of directions both following the circle of fifths and the circle of fourths (Moving counter-clockwise in the direction of the circle of fifths).

The Row#1 1321 includes up to 20 buttons of bass consisting of four flat notes, seven natural notes, seven sharp notes and two double-sharp notes. As shown in the embodiment depicted in FIG. 13, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X−2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 1313 (72 buttons in 12 columns), the second pattern 1314 (96 buttons in 16 columns) as well as the last pattern 1315 (120 buttons in 20 columns). On the other hand, Eb2 (Column X−7), Bb1 (Column X−6), E#3(F3) (Column X+7) and B#2(C3) (Column X+8) are additional notes from the first pattern 1313, the second pattern 1314 (96 buttons in 16 columns) as well as the last pattern 1315 (120 buttons in 20 columns). Similarly, Db2 (Column X−9), Ab1 (Column X−8), F##3(G3) (Column X+9) and C##2(D3) (Column X+10) are additional notes from the second pattern 1314 (96 buttons in 16 columns) in the last pattern 1315 (120 buttons in 20 columns). As such, there are 12 bass notes in the first pattern 1313 (72 buttons in 12 columns), 16 bass notes in the second pattern 1314 (96 buttons in 16 columns) and 20 bass notes in the last pattern 1315 (120 buttons in 20 columns). The note formulation in 20 columns 1310 of Row#1 1321 is the 3$^{rd}$ note in major scale count from root (major third note).

The Row#2 1322 includes 20 buttons of bass consisting of one double-flat note, seven flat notes, seven natural notes and five sharp notes. As shown in the embodiment depicted in FIG. 13, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 1313 (72 buttons in 12 columns), the second pattern 1314 (96 buttons in 16 columns) as well as the last pattern 1315 (120 buttons in 20 columns). On the other hand, Cb2(B1) (Column X−7), Gb1(F#1) (Column X−6), C#3 (Column X+7) and G#2 (Column X+8) are additional notes from the first pattern 1313, the second pattern 1314 (96 buttons in 16 columns) as well as the last pattern 1315 (120 buttons in 20 columns). Similarly, Bbb1(A1) (Column X−9), Fb1(E1) (Column X−8), D#3 (Column X+9) and A#2 (Column X+10) are additional notes from the second pattern 1314 (96 buttons in 16 columns) in the last pattern 1315 (120 buttons in 20 columns). As such, there are 12 bass notes in the first pattern 1313 (72 buttons in 12 columns), 16 bass notes in the second pattern 1314 (96 buttons in 16 columns) and 20 bass notes in the last pattern 1315 (120 buttons in 20 columns). The note formulation in 20 columns 1310 of Row#2 1322 is a root of scale and chord.

The Row#3 1323 includes 20 buttons of preset chords (triads) consisting of one combination of double flat note with flat note, three combination of flat note with flat note, three combination of flat note with natural note, four combination of natural note with natural note, five combination of natural note with sharp note, four combination of sharp note with sharp note. As shown in the embodiment depicted in FIG. 13, Ebb3+Fb3(C#3+E3) is located in Column X−9; Ab2+Cb3(Ab2+B2) is located in Column X−8; Eb3+Gb3 is located in Column X−7; Bb2+Db3 is located in Column X−6; F3+Ab3 is located in Column X−5; C3+Eb3 is located in Column X−4; G3+Bb3 is located in Column X−3; D3+F3 is located in Column X−2; A3+C4 is located in Column X−1; E3+G3 is located in Column X (center); B3+D4 is located in Column X+1; F#3+A3 is located in Column X+2; C#4+E4 is located in Column X+3; G#3+B3 is located in Column X+4; D#4+F##4 is located in Column X+5; A#3+C#4 is located in Column X+6; E#4+G#4 is located in Column X+7; B#3+D#4 is located in Column X+8; G4+A#4 (G4+Bb4) is located in Column X+9 and D4+E#4(D4+F4) is located in Column X+10. F3+Ab3, C3+Eb3, G3+Bb3, D3+F3, A3+C4, E3+G3, B3+D4, F#3+A3, C#4+E4, G#3+B3 and A#3+C#4 are elements of all patterns, i.e., the first pattern 1313 (72 buttons in 12 columns), the second pattern 1314 (96 buttons in 16 columns) as well as the last pattern 1315 (120 buttons in 20 columns). On the other hand, Eb3+Gb3 (Column X−7), Bb2+Db3 (Column X−6), E#4+G#4 (Column X+7) and B#3+D#4 (Column X+8) are additional notes from the first pattern 1313, the second pattern 1314 (96 buttons in 16 columns) as well as the last pattern 1315 (120 buttons in 20 columns). Similarly, Ebb3+Fb3 (C#3+E3) (Column X−9), Ab2+Cb3(Ab2B2) (Column X−8), G4+A#4(G4+Bb4)(Column X+9) and D4+E#4(D4+F4)(Column X+10) are additional notes from the second pattern 1314 (96 buttons in 16 columns) in the last pattern 1315 (120 buttons in 20 columns). As such, there are 12 preset chords (triads) in the first pattern 1313 (72 buttons in 12 columns), 16 preset chords (triads) in the second pattern 1314 (96 buttons in 16 columns) and 20 preset chords (triads) in the last pattern 1315 (120 buttons in 20 columns). The note formulation in 20 columns 1310 of Row#3 1323 is the Major Chord (Root form exclude root note), 3$^{rd}$ combines with 5$^{th}$ of Major chord.

The Row#4 1324 includes 20 buttons of preset chords (triads) consisting of one combination of double flat note with natural note, three combination of double flat note with flat note, four combination of flat note with flat note, three combination of flat note with natural note, four combination of natural note with natural note, three combination of natural note with flat note, two combination of sharp note with sharp note. As shown in the embodiment depicted in FIG. 13, Bbb2+C3(A2+C3) is located in Column X−9; Fb3+Abb3(E3+G3) is located in Column X−8; Cb3+Ebb3 (B2+D3) is located in Column X−7; Gb3+Bbb3(Gb3+A3) is located in Column X−6; Db3+Fb3(Db3+E3) is located in Column X−5; Ab3+Cb4(Ab3+B3) is located in Column X−4; Eb3+Gb3 is located in Column X−3; Bb3+Db4 is located in Column X−2; F3+Ab3 is located in Column X−1; C4+Eb4 is located in Column X (center); G3+Bb3 is located in Column X+1; D4+F4 is located in Column X+2; A3+C4 is located in Column X+3; E4+G4 is located in Column X+4; B3+D4 is located in Column X+5; F#4+A4 is located in Column X+6; C#4+E4 is located in Column X+7; G#4+B4 is located in Column X+8; D#4+F#4 is located in Column X+9 and A#3+C#4(Bb3+C#4) is located in Column X+10. Db3+Fb3(Db3+E3), Ab3+Cb4(Ab3+B3), Eb3+Gb3, Bb3+Db4, F3+Ab3, C4+Eb4, G3+Bb3, D4+F4, A3+C4, E4+G4, B3+D4 and F#4+A4 are elements of all patterns, i.e., the first pattern 1313 (72 buttons in 12 columns), the second pattern 1314 (96 buttons in 16 columns) as well as the last pattern 1315 (120 buttons in 20 columns). On the other hand, Cb3+Ebb3(B2+D3) (Column X−7), Gb3+Bbb3 (Gb3+A3) (Column X−6), C#4+E4 (Column X+7) and G#4+B4 (Column X+8) are additional notes from the first pattern 1313, the second pattern 1314 (96 buttons in 16 columns) as well as the last pattern 1315 (120 buttons in 20 columns). Similarly, Bbb2+C3(A2+C3) (Column X−9), Fb3+Abb3(E2+G3) (Column X−8), D#4+F#4 (Column X+9) and A#3+C#4(Bb3+C#4) (Column X+10) are additional notes from the second pattern 1314 (96 buttons in 16 columns) in the last pattern 1315 (120 buttons in 20 columns). As such, there are 12 preset chords (triads) in the first pattern 1313 (72 buttons in 12 columns), 16 preset chords (triads) in the second pattern 1314 (96 buttons in 16 columns) and 20 preset chords (triads) in the last pattern 1315 (120 buttons in 20 columns). The note formulation in 20 columns 1310 of Row#4 1324 is Minor chord (Root form exclude 5$^{th}$) 1$^{st}$ combines with 3$^{rd}$ of Minor chord.

The Row#5 1325 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 13, Bbb2+Ebb3(A2+C#3) is located in Column X−9; Fb2+Ab2(E2+Ab2) is located in Column X−8; Cb3+Eb3 (B2+Eb3) is located in Column X−7; Gb2+Bb2 is located in Column X−6; Db3+F3 is located in Column X−5; Ab2+C3 is located in Column X−4; Eb3+G3 is located in Column X−3; Bb2+D3 is located in Column X−2; F3+A3 is located in Column X−1; C3+E3 is located in Column X (center); G3+B3 is located in Column X+1; D3+F#3 is located in Column X+2; A3+C#4 is located in Column X+3; E3+G#3 is located in Column X+4; B3+D#4 is located in Column X+5; F#3+A#3 is located in Column X+6; C#4+E#4(C#4+F4) is located in Column X+7; G#3+B#3(G#3+C4) is located in Column X+8; D#4+F##4(D#4+G4) is located in Column X+9 and A#3+C##4(Bb3#D4) is located in Column X+10. Db3+F3, Ab2+C3, Eb3+G3, Bb2+D3, F3+A3, C3+E3, G3+B3, D3+F#3, A3+C#4, E3+G#3, B3+D#4 and F#3+A#3 are elements of all patterns, i.e., the first pattern 1313 (72 buttons in 12 columns), the second pattern 1314 (96 buttons in 16 columns) as well as the last pattern 1315 (120 buttons in 20 columns). On the other hand, Cb3+Eb3 (B2+Eb3) (Column X−7), Gb2+Bb2 (Column X−6), C#4+E#4(C#4+F4) (Column X+7) and G#3+B#3(G#3+C4) (Column X+8) are additional notes from the first pattern 1313, the second pattern 1314 (96 buttons in 16 columns) as well as the last pattern 1315 (120 buttons in 20 columns). Similarly, Bbb2+Ebb3(A2+C#3) (Column X−9), Fb2+Ab2 (E2+Ab2) (Column X−8), D#4+F##4(D#4+G4) (Column X+9) and A#3+C##4(Bb3#D4) (Column X+10) are additional notes from the second pattern 1314 (96 buttons in 16 columns) in the last pattern 1315 (120 buttons in 20 columns). As such, there are 12 preset chords (triads) in the first pattern 1313 (72 buttons in 12 columns), 16 preset chords (triads) in the second pattern 1314 (96 buttons in 16 columns) and 20 preset chords (triads) in the last pattern 1315 (120 buttons in 20 columns). The note formulation in 20 columns 1310 of Row#5 1325 is the Major chord (Root Exclude $5^{th}$ note) $1^{st}$ note combines with $3^{rd}$ note of Major chord without $5^{th}$ note.

The Row#6 1326 includes 20 buttons of preset chords (triads) consisting of eight combination of natural note with natural note, three combination of natural note with flat note, four combination of flat note with flat note, two combination of natural note with sharp note and three combination of sharp note with sharp note. As shown in the embodiment depicted in FIG. 13, G2+A2 is located in Column X−9; D2+E2 is located in Column X−8; A2+B2 is located in Column X−7; (E+Bb2) is located in Column X−6; Cb3+Db3 is located in Column X−5; Gb2+Ab2 is located in Column X−4; Db3+Eb3 is located in Column X−3; Ab2+Bb2 is located in Column X−2; Eb3+F3 is located in Column X−1; Bb2+C3 is located in Column X (center); F3+G3 is located in Column X+1; C3+D5 is located in Column X+2; G3+A3 is located in Column X+3; D3+E3 is located in Column X+4; A3+B3 is located in Column X+5; E3+F#3 is located in Column X+6; B3+C#4 is located in Column X+7; F#3+G#3 is located in Column X+8; C#4+D#4 is located in Column X+9 and G#3+A#3 is located in Column X+10. Cb3+Db3, Gb2+Ab2, Db3+Eb3, Ab2+Bb2, Eb3+F3, Bb2+C3, F3+G3, C3+D5, G3+A3, D3+E3, A3+B3 and E3+F#3 are elements of all patterns, i.e., the first pattern 1313 (72 buttons in 12 columns), the second pattern 1314 (96 buttons in 16 columns) as well as the last pattern 1315 (120 buttons in 20 columns). On the other hand, A2+B2 (Column X−7), (E+Gb2) (Column X−6), B3+C#4 (Column X+7) and F#3+G#3 (Column X+8) are additional notes from the first pattern 1313, the second pattern 1314 (96 buttons in 16 columns) as well as the last pattern 1315 (120 buttons in 20 columns). Similarly, G2+A2 (Column X−9), D2+E2 (Column X−8), C#4+D#4 (Column X+9) and G#3+A#3 (Column X+10) are additional notes from the second pattern 1314 (96 buttons in 16 columns) in the last pattern 1315 (120 buttons in 20 columns). As such, there are 12 preset chords (triads) in the first pattern 1313 (72 buttons in 12 columns), 16 preset chords (triads) in the second pattern 1314 (96 buttons in 16 columns) and 20 preset chords (triads) in the last pattern 1315 (120 buttons in 20 columns). The note formulation in 20 columns 1310 of Row#6 1326 is the lower octave of minor $7^{th}$ combining with root note.

This note layout has the ability to play fundamental chords of diatonic scale. It is very easy to play with Major Arpeggio sound alike by using single note or double notes that belong to Major chord, Very easy to play Minor Arpeggio sound alike by using single note or double notes that belong to minor, Very easy to play Dominant $7^{th}$ Arpeggio sound alike by using Single note or Double Notes that belong to Dominant $7^{th}$ Chord, Very easy to play Diminished Arpeggio Triad sound alike by using Single note or Double Notes that belong to Half Diminished Chord, Very easy to play Full Diminished Arpeggio sound alike by using Single note or Double Notes that belong to Full Diminished Chord, Very easy to play Minor Block Chord or Arpeggio with difference position or difference Column (optional Position).

This note layout has the ability to play extended chord by using only fixed Row1-Row5. It is very easy to play Minor Major $7^{th}$ Arpeggio sound alike by using Single note or Double Notes that belong to Major Chord, Difficult to play Minor $7^{th}$ flat $5^{th}$ Triad Arpeggio sound alike by using Single note or Double Notes that belong to Minor $7^{th}$ flat $5^{th}$ Triad Chord, Very easy to Major $7^{th}$ Arpeggio sound alike by using Single note or Double Notes that belong to Major Chord, Very easy to play Major $9^{th}$ Arpeggio sound alike by using Single note or Double Notes that belong to Major Chord.

This note layout can easily play Chord progression by using this note layout, it can play ii-V(7)-I of Major Scale and I-IV-V and ii, iii, vi of Major Scale. But, the ability to play ii7b5-V-I of Minor Scale is moderate since it used ii Dim (Triad) instead of ii7b5.

The ability to play a variety of Chord forms (Root form and inversion form) by using only fixed row 1-row 5. It is easy to play Major chord by using root form $2^{nd}$ inversion, Minor by using root form (use optional position), Dominant $7^{th}$ by using Root form $2^{nd}$ inversion, Half Diminished by using root form $2^{nd}$ inversion, Major $7^{th}$ by using root form $2^{nd}$ inversion, and Minor $7^{th}$ by using root form $2^{nd}$ inversion.

This note layout has an additional ability in that by using Row 6 to work with Row 1-Row 5. It can play Dominant $7^{th}$ Chord with 2 Inversions (forms) for all chord, and half of that can play Dominant $7^{th}$ with 3 Inversions (forms), also have Major $2^{nd}$ interval as ingredient to create new chord or to use as harmony of right hand melody. This layout is good for music style such as Pop, Jazz and Blues.

Figure 14:
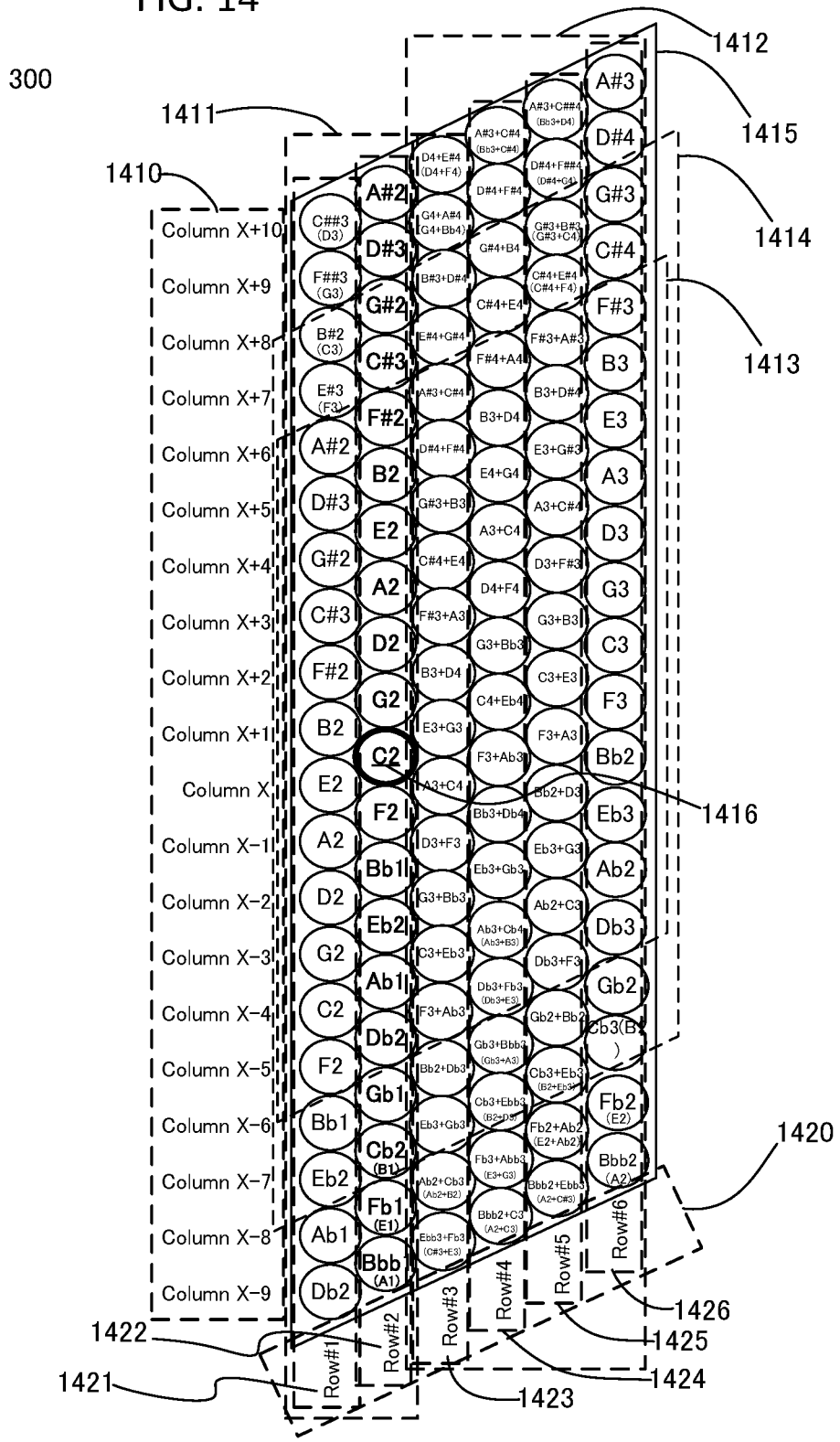
FIG. 14 is a diagram illustrating an example of chord tone pattern which contains double notes, 120 basses layer 1, Row $6^{th}$ has same pattern as row $2^{nd}$ but higher octave. (Eighth or Octave note interval)

FIG. 14 illustrates an exploded view of the Chord Tone Pattern with double notes by fixed Row 1-5 by Row 6 is Root in Row with 1 higher octave. As shown in this figure, the Chord Tone Pattern of the present embodiment includes six rows of buttons 1420. The six rows of button 1420 are arranged in lines in a direction substantially orthogonal to an expansion and contraction direction of the bellow 300. Columns 1410 contain from 12 columns 1413, 16 columns 1414 and 20 columns 1415. The six rows of button 1420 with 12 columns 1413 contain about 72 basses. The six rows of button 1420 with 16 columns 1414 contain about 96 basses. The six rows of button 1420 with 20 columns 1415 contain about 120 basses. The six rows of buttons 1420 include 12 columns 1413 consisting of X−5, X−4, X−3, X−2, X−1, X, X+1, X+2, X+3, X+4, X+5 and X+6. The six rows of buttons 1420 include 16 columns 1414 consisting of X−7, X−6, X−5, X−4, X−3, X−2, X−1, X, X+1, X+2, X+3, X+4, X+5, X+6, X+7 and X+8. The six rows of buttons 1420 include 20 columns 1415 consisting of X−9, X−8, X−7, X−6, X−5, X−4, X−3, X−2, X−1, X, X+1, X+2, X+3, X+4, X+5, X+6, X+7, X+8, X+9 and X+10. Row#1 1421 and Row#2 1422 are assigned to base notes 1410. Row#3 1423, Row#4 1424, Row#5 1425 and Row#6 1426 are assigned to present chords 1412 (triads).

As shown in the embodiment depicted in FIG. 14, for each buttons from the six rows of buttons 1420 a number appears after a note. These numbers are octave numbers which are used for identifying the pitches in an octave. The octave number increases or decreases by one. A greater number refers to a higher octave while a smaller number refers to a lower octave. Though a "C4" is normally assigned as a middle C, a "C2" button 1416 is a C Root note, which is assigned as a middle C and is located in Row#2 1422 and Column X, in order to solve the problem when playing the triad with the close contiguous 3 fingers by arranging 3 notes of major triad or minor triad in the column. This "C2" button 1416 allows more extension of directions both following the circle of fifths and the circle of fourths (Moving counter-clockwise in the direction of the circle of fifths).

The Row#1 1421 includes up to 20 buttons of bass consisting of four flat notes, seven natural notes, seven sharp notes and two double-sharp notes. As shown in the embodiment depicted in FIG. 14, Db2 is located in Column X−9; Ab1 is located in Column X−8; Eb2 is located in Column X−7; Bb1 is located in Column X−6; F2 is located in Column X−5; C2 is located in Column X−4; G2 is located in Column X−3; D2 is located in Column X−2; A2 is located in Column X−1; E2 is located in Column X (center); B2 is located in Column X+1; F#2 is located in Column X+2; C#3 is located in Column X+3; G#2 is located in Column X+4; D#3 is located in Column X+5; A#2 is located in Column X+6; E#3(F3) is located in Column X+7; B#2(C3) is located in Column X+8; F##3(G3) is located in Column X+9 and C##2(D3) is located in Column X+10. F2, C2, G2, D2, A2, E2, B2, F#2, C#3, G#2, D#3 and A#2 are elements of all patterns, i.e., the first pattern 1413 (72 buttons in 12 columns), the second pattern 1414 (96 buttons in 16 columns) as well as the last pattern 1415 (120 buttons in 20 columns). On the other hand, Eb2 (Column X−7), Bb1 (Column X−6), E#3(F3) (Column X+7) and B#2(C3) (Column X+8) are additional notes from the first pattern 1413, the second pattern 1414 (96 buttons in 16 columns) as well as the last pattern 1415 (120 buttons in 20 columns). Similarly, Db2 (Column X−9), Ab1 (Column X−8), F##3(G3) (Column X+9) and C##2(D3) (Column X+10) are additional notes from the second pattern 1414 (96 buttons in 16 columns) in the last pattern 1415 (120 buttons in 20 columns). As such, there are 12 bass notes in the first pattern 1413 (72 buttons in 12 columns), 16 bass notes in the second pattern 1414 (96 buttons in 16 columns) and 20 bass notes in the last pattern 1415 (120 buttons in 20 columns). The note formulation in 20 columns 1410 of Row#1 1421 is the $3^{rd}$ note in major scale count from root (major third note).

The Row#2 1422 includes 20 buttons of bass consisting of one double-flat note, seven flat notes, seven natural notes and five sharp notes. As shown in the embodiment depicted in FIG. 14, Bbb1(A1) is located in Column X−9; Fb1(E1) is located in Column X−8; Cb2(B1) is located in Column X−7; Gb1(F#1) is located in Column X−6; Db2(C#2) is located in Column X−5; Ab1 is located in Column X−4; Eb2 is located in Column X−3; Bb1 is located in Column X−2; F2 is located in Column X−1; C2 is located in Column X (center); G2 is located in Column X+1; D2 is located in Column X+2; A2 is located in Column X+3; E2 is located in Column X+4; B2 is located in Column X+5; F#2 is located in Column X+6; C#3 is located in Column X+7; G#2 is located in Column X+8; D#3 is located in Column X+9 and A#2 is located in Column X+10. Db2(C#2), Ab1, Eb2, Bb1, F2, C2, G2, D2, A2, E2, B2 and F#2 are elements of all patterns, i.e., the first pattern 1413 (72 buttons in 12 columns), the second pattern 1414 (96 buttons in 16 columns) as well as the last pattern 1415 (120 buttons in 20 columns). On the other hand, Cb2(B1) (Column X−7), Gb1(F#1) (Column X−6), C#3 (Column X+7) and G#2 (Column X+8) are additional notes from the first pattern 1413, the second pattern 1414 (96 buttons in 16 columns) as well as the last pattern 1415 (120 buttons in 20 columns). Similarly, Bbb1(A1) (Column X−9), Fb1(E1) (Column X−8), D#3 (Column X+9) and A#2 (Column X+10) are additional notes from the second pattern 1414 (96 buttons in 16 columns) in the last pattern 1415 (120 buttons in 20 columns). As such, there are 12 bass notes in the first pattern 1413 (72 buttons in 12 columns), 16 bass notes in the second pattern 1414 (96 buttons in 16 columns) and 20 bass notes in the last pattern 1415 (120 buttons in 20 columns). The note formulation in 20 columns 1410 of Row#2 1422 is a root of scale and chord.

The Row#3 1423 includes 20 buttons of preset chords (triads) consisting of one combination of double flat note with flat note, three combination of flat note with flat note, three combination of flat note with natural note, four combination of natural note with natural note, five combination of natural note with sharp note, four combination of sharp note with sharp note. As shown in the embodiment depicted in FIG. 14, Ebb3+Fb3(C#3+E3) is located in Column X−9; Ab2+Cb3(Ab2+B2) is located in Column X−8; Eb3+Gb3 is located in Column X−7; Bb2+Db3 is located in Column X−6; F3+Ab3 is located in Column X−5; C3+Eb3 is located in Column X−4; G3+Bb3 is located in Column X−3; D3+F3 is located in Column X−2; A3+C4 is located in Column X−1; E3+G3 is located in Column X (center); B3+D4 is located in Column X+1; F#3+A3 is located in Column X+2; C#4+E4 is located in Column X+3; G#3+B3 is located in Column X+4; D#4+F##4 is located in Column X+5; A#3+C#4 is located in Column X+6; E#4+G#4 is located in Column X+7; B#3+D#4 is located in Column X+8; G4+A#4 (G4+Bb4) is located in Column X+9 and D4+E#4(D4+F4) is located in Column X+10. F3+Ab3, C3+Eb3, G3+Bb3, D3+F3, A3+C4, E3+G3, B3+D4, F#3+A3, C#4+E4, G#3+B3 and A#3+C#4 are elements of all patterns, i.e., the first pattern 1413 (72 buttons in 12 columns), the second pattern 1414 (96 buttons in 16 columns) as well as the last pattern 1415 (120 buttons in 20 columns). On the other hand, Eb3+Gb3 (Column X−7), Bb2+Db3 (Column X−6), E#4+G#4 (Column X+7) and B#3+D#4 (Column X+8) are additional notes from the first pattern 1413, the second pattern 1414 (96 buttons in 16 columns) as well as the last pattern 1415 (120 buttons in 20 columns). Similarly, Ebb3+Fb3 (C#3+E3) (Column X−9), Ab2+Cb3(Ab2B2) (Column X−8), G4+A#4(G4+Bb4)(Column X+9) and D4+E#4(D4+F4)(Column X+10) are additional notes from the second pattern 1414 (96 buttons in 16 columns) in the last pattern 1415 (120 buttons in 20 columns). As such, there are 12 preset chords (triads) in the first pattern 1413 (72 buttons in 12 columns), 16 preset chords (triads) in the second pattern 1414 (96 buttons in 16 columns) and 20 preset chords (triads) in the last pattern 1415 (120 buttons in 20 columns). The note formulation in 20 columns 1410 of Row#3 1423 is the Major Chord (Root form exclude root note), $3^{rd}$ combines with $5^{th}$ of Major chord.

The Row#4 1424 includes 20 buttons of preset chords (triads) consisting of one combination of double flat note with natural note, three combination of double flat note with flat note, four combination of flat note with flat note, three combination of flat note with natural note, four combination of natural note with natural note, three combination of natural note with flat note, two combination of sharp note with sharp note. As shown in the embodiment depicted in FIG. 14, Bbb2+C3(A2+C3) is located in Column X−9; Fb3+Abb3(E3+G3) is located in Column X−8; Cb3+Ebb3 (B2+D3) is located in Column X−7; Gb3+Bbb3(Gb3+A3) is located in Column X−6; Db3+Fb3(Db3+E3) is located in Column X-5; Ab3+Cb4(Ab3+B3) is located in Column X−4; Eb3+Gb3 is located in Column X−3; Bb3+Db4 is located in Column X−2; F3+Ab3 is located in Column X−1; C4+Eb4 is located in Column X (center); G3+Bb3 is located in Column X+1; D4+F4 is located in Column X+2; A3+C4 is located in Column X+3; E4+G4 is located in Column X+4; B3+D4 is located in Column X+5; F#4+A4 is located in Column X+6; C#4+E4 is located in Column X+7; G#4+B4 is located in Column X+8; D#4+F#4 is located in Column X+9 and A#3+C#4(Bb3+C#4) is located in Column X+10. Db3+Fb3(Db3+E3), Ab3+Cb4(Ab3+B3), Eb3+Gb3, Bb3+Db4, F3+Ab3, C4+Eb4, G3+Bb3, D4+F4, A3+C4, E4+G4, B3+D4 and F#4+A4 are elements of all patterns, i.e., the first pattern 1413 (72 buttons in 12 columns), the second pattern 1414 (96 buttons in 16 columns) as well as the last pattern 1415 (120 buttons in 20 columns). On the other hand, Cb3+Ebb3(B2+D3) (Column X−7), Gb3+Bbb3 (Gb3+A3) (Column X−6), C#4+E4 (Column X+7) and G#4+B4 (Column X+8) are additional notes from the first pattern 1413, the second pattern 1414 (96 buttons in 16 columns) as well as the last pattern 1415 (120 buttons in 20 columns). Similarly, Bbb2+C3 (A2+C3) (Column X−9), Fb3+Abb3 (E2+G3) (Column X−8), D#4+F#4 (Column X+9) and A#3+C#4 (Bb3+C#4) (Column X+10) are additional notes from the second pattern 1414 (96 buttons in 16 columns) in the last pattern 1415 (120 buttons in 20 columns). As such, there are 12 preset chords (triads) in the first pattern 1413 (72 buttons in 12 columns), 16 preset chords (triads) in the second pattern 1414 (96 buttons in 16 columns) and 20 preset chords (triads) in the last pattern 1415 (120 buttons in 20 columns). The note formulation in 20 columns 1410 of Row#4 1424 is Minor chord (Root form exclude $5^{th}$) 1st combines with $3^{rd}$ of Minor chord.

The Row#5 1425 includes 20 buttons of preset chords (triads) consisting of one combination of double flat note with double flat note, three combination of flat note with flat note, four combination of flat note with natural note, three combination of natural note with natural note, four combination of natural note with flat note, three combination of sharp note with sharp note, two combination of double flat note with flat note. As shown in the embodiment depicted in FIG. 14, Bbb2+Ebb3(A2+C#3) is located in Column X−9; Fb2+Ab2(E2+Ab2) is located in Column X−8; Cb3+Eb3 (B2+Eb3) is located in Column X−7; Gb2+Bb2 is located in Column X−6; Db3+F3 is located in Column X−5; Ab2+C3 is located in Column X−4; Eb3+G3 is located in Column X−3; Bb2+D3 is located in Column X−2; F3+A3 is located in Column X−1; C3+E3 is located in Column X (center); G3+B3 is located in Column X+1; D3+F#3 is located in Column X+2; A3+C#4 is located in Column X+3; E3+G#3 is located in Column X+4; B3+D#4 is located in Column X+5; F#3+A#3 is located in Column X+6; C#4+E#4(C#4+F4) is located in Column X+7; G#3+B#3(G#3+C4) is located in Column X+8; D#4+F##4(D#4+G4) is located in Column X+9 and A#3+C##4(Bb3#D4) is located in Column X+10. Db3+F3, Ab2+C3, Eb3+G3, Bb2+D3, F3+A3, C3+E3, G3+B3, D3+F#3, A3+C#4, E3+G#3, B3+D#4 and F#3+A#3 are elements of all patterns, i.e., the first pattern 1413 (72 buttons in 12 columns), the second pattern 1414 (96 buttons in 16 columns) as well as the last pattern 1415 (120 buttons in 20 columns). On the other hand, Cb3+Eb3 (B2+Eb3) (Column X−7), Gb2+Bb2 (Column X−6), C#4+E#4(C#4+F4) (Column X+7) and G#3+B#3(G#3+C4) (Column X+8) are additional notes from the first pattern 1413, the second pattern 1414 (96 buttons in 16 columns) as well as the last pattern 1415 (120 buttons in 20 columns). Similarly, Bbb2+Ebb3(A2+C#3) (Column X−9), Fb2+Ab2 (E2+Ab2) (Column X−8), D#4+F##4(D#4+G4) (Column X+9) and A#3+C##4(Bb3#D4) (Column X+10) are additional notes from the second pattern 1414 (96 buttons in 16 columns) in the last pattern 1415 (120 buttons in 20 columns). As such, there are 12 preset chords (triads) in the first pattern 1413 (72 buttons in 12 columns), 16 preset chords (triads) in the second pattern 1414 (96 buttons in 16 columns) and 20 preset chords (triads) in the last pattern 1415 (120 buttons in 20 columns). The note formulation in 20 columns 1410 of Row#5 1425 is the Major chord (Root Exclude $5^{th}$ note) $1^{st}$ note combines with $3^{rd}$ note of Major chord without $5^{th}$ note.

The Row#6 1426 includes 20 buttons of preset chords (triads) consisting of one double flat note, seven flat note, seven natural note, and five sharp note. As shown in the embodiment depicted in FIG. 14, Bbb2(A2) is located in Column X−9; Fb2(E2) is located in Column X−8; Cb3(B2) is located in Column X−7; Gb2 is located in Column X−6; Db3 is located in Column X−5; Ab2 is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; F#3 is located in Column X+6; C#4 is located in Column X+7; G#3 is located in Column X+8; D#4 is located in Column X+9 and A#3 is located in Column X+10. Db3, Ab2, Eb3, Bb2, F3, C3, G3, D3, A3, E3, B3, and F#3 are elements of all patterns, i.e., the first pattern 1413 (72 buttons in 12 columns), the second pattern 1414 (96 buttons in 16 columns) as well as the last pattern 1415 (120 buttons in 20 columns). On the other hand, Cb3(B2) (Column X−7), Gb2 (Column X−6), C#4 (Column X+7) and G#3 (Column X+8) are additional notes from the first pattern 1413, the second pattern 1414 (96 buttons in 16 columns) as well as the last pattern 1415 (120 buttons in 20 columns). Similarly, Bbb2(A2) (Column X−9), Fb2(E2) (Column X−8), D#4 (Column X+9) and A#3 (Column X+10) are additional notes from the second pattern 1414 (96 buttons in 16 columns) in the last pattern 1415 (120 buttons in 20 columns). As such, there are 12 preset chords (triads) in the first pattern 1413 (72 buttons in 12 columns), 16 preset chords (triads) in the second pattern 1414 (96 buttons in 16 columns) and 20 preset chords (triads) in the last pattern 1415 (120 buttons in 20 columns). The note formulation in 20 columns 1410 of Row#6 1426 is containing same pattern with Row#2 1422 but 1 higher octave.

This note layout has the ability to play fundamental chords of diatonic scale. It is very easy to play with Major Arpeggio sound alike by using single note or double notes that belong to Major chord, Very easy to play Minor Arpeggio sound alike by using single note or double notes that belong to minor, Very easy to play Dominant $7^{th}$ Arpeggio sound alike by using Single note or Double Notes that belong to Dominant $7^{th}$ Chord, Very easy to play Diminished Arpeggio Triad sound alike by using Single note or Double Notes that belong to Half Diminished Chord, Very easy to play Full Diminished Arpeggio sound alike by using Single note or Double Notes that belong to Full Diminished Chord, Very easy to play Minor Block Chord or Arpeggio with difference position or difference Column (optional Position).

This note layout has the ability to play extended chord by using only fixed Row1-Row5. It is very easy to play Minor Major $7^{th}$ Arpeggio sound alike by using Single note or Double Notes that belong to Major Chord, Difficult to play Minor $7^{th}$ flat $5^{th}$ Triad Arpeggio sound alike by using Single note or Double Notes that belong to Minor $7^{th}$ flat $5^{th}$ Triad Chord, Very easy to Major $7^{th}$ Arpeggio sound alike by using Single note or Double Notes that belong to Major Chord, Very easy to play Major $9^{th}$ Arpeggio sound alike by using Single note or Double Notes that belong to Major Chord.

The ability to play Chord progression by using this note layout is easy, it can also play ii-V(7)-I of Major Scale and I-IV-V and ii, iii, vi of Major Scale. But, the ability to play ii7b5-V-I of Minor Scale is moderate since it used ii Dim (Triad) instead of ii7b5.

The ability to play a variety of Chord forms (Root form and inversion form) by using only fixed row 1-row 5. It is easy to play Major chord by using root form $2^{nd}$ inversion, Minor by using root form (use optional position), Dominant $7^{th}$ by using Root form $2^{nd}$ inversion, Half Diminished by using root form $2^{nd}$ inversion, Major $7^{th}$ by using root form $2^{nd}$ inversion, and Minor $7^{th}$ by using root form $2^{nd}$ inversion.

This note layout has an additional ability in that by using Row 6 to work with Row 1-Row 5. It can play Minor Chord in $2^{nd}$ Inversion and play Disco Rhythm by using lower Octave of Root in Row 2 and Higher Octave Root in Row 6.

Figure 15:
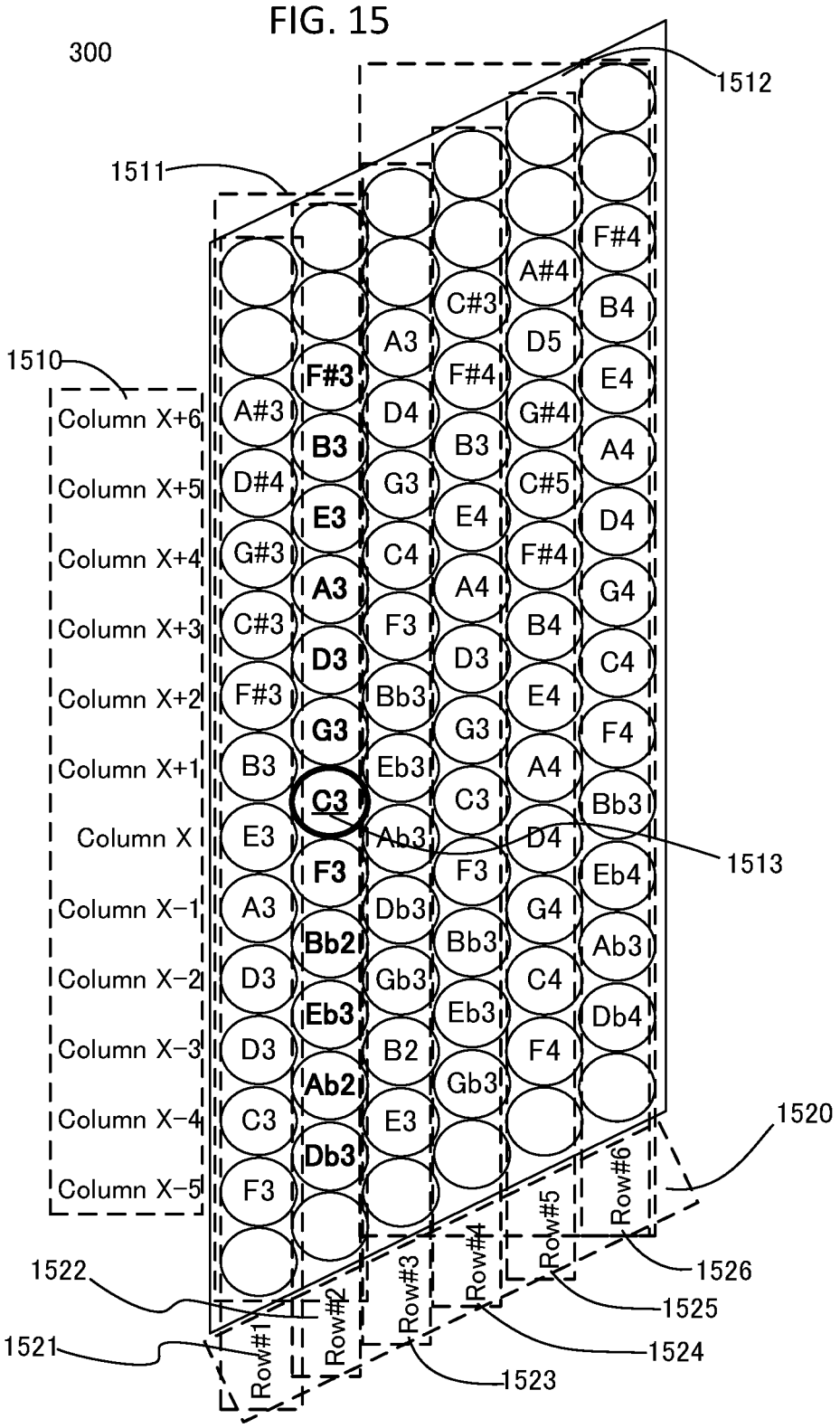
FIG. 15 is a diagram illustrating an example of chord tone pattern which contains Major and Minor scale of the present invention.

FIG. 15 illustrates an exploded view of the Chord Tone Pattern. As shown in this figure, the Chord Tone Pattern of the present embodiment includes six rows of buttons 1520. The six rows of button 1520 are arranged in lines in a direction substantially orthogonal to an expansion and contraction direction of the bellow 300. Columns 1510 contain 12 columns 1510 about 72 basses. The six rows of buttons 1520 include 12 columns 1510 consisting of X−5, X−4, X−3, X−2, X−1, X, X+1, X+2, X+3, X+4, X+5 and X+6. Row#1 1521 and Row#2 1522 are assigned to bass notes 1511. Row#3 1523, Row#4 1524, Row#5 1525 and Row#6 1526 are assigned to present cords 1512 (triads).

As shown in the embodiment depicted in FIG. 15, for each buttons from the six rows of buttons 1520 a number appears after a note. These numbers are octave numbers which are used for identifying the pitches in an octave. The octave number increases by one upon an ascension from B to C. A greater number refers to a higher note while a smaller number refers to a lower note. Though a "C4" is normally assigned as a middle C, a "C3" button 1513 is a C Root note, which is assigned as a middle C and is located in Row#2 1522 and Column X, in order to solve the problem when playing the triad with the close contiguous 3 fingers by arranging 3 notes of major triad or minor triad in the column. This "C3" 1513 allows more extension of directions both following the circle of fifths and the circle of fourths (Moving counterclockwise in the direction of the circle of fifths).

The Row#1 1521 includes up to 12 buttons of bass consisting of seven natural notes and five sharp notes. As shown in the embodiment depicted in FIG. 15, F3 is located in Column X−5; C3 is located in Column X−4; D3 is located in Column X−3; D3 is located in Column X−2; A3 is located in Column X−1; E3 is located in Column X (center); B3 is located in Column X+1; F#3 is located in Column X+2; C#3 is located in Column X+3; G#3 is located in Column X+4; D#4 is located in Column X+5; and A#3 is located in Column X+6. F3, C3, D3, D3, A3, E3, B3, F#3, C#3, G#3, D#4 and A#3 are elements of this pattern. The note formulation in 12 columns 1510 of Row#1 1521 is the 3rd note in major scale count from root (major third note).

The Row#2 1522 includes up to 12 buttons of bass consisting of four flat notes, seven natural notes and one sharp notes. As shown in the embodiment depicted in FIG. 15, Db3 is located in Column X−5; Ab2 is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; and F#3 is located in Column X+6. Db3, Ab2, Eb3, Bb2, F3, C3, G3, D3, A3, E3, B3 and F#3 are elements of this pattern. The note formulation in 12 columns 1510 of Row#2 1522 is the root of scale and chord.

The Row#3 1523 includes up to 12 buttons of bass consisting of five flat notes and seven natural notes. As shown in the embodiment depicted in FIG. 15, E3 is located in Column X−5; B2 is located in Column X−4; Gb3 is located in Column X−3; Db2 is located in Column X−2; Ab3 is located in Column X−1; Eb3 is located in Column X (center); Bb3 is located in Column X+1; F3 is located in Column X+2; C4 is located in Column X+3; G3 is located in Column X+4; D4 is located in Column X+5; and A3 is located in Column X+6. E3, B2, Gb3, Db2, Ab3, Eb3, Bb3, F3, C4, G3, D4 and A3 are elements of this pattern. The note formulation in 12 columns 1510 of Row#3 1523 is the $3^{rd}$ note in minor scale count from root (Minor third note).

The Row#4 1524 includes up to 12 buttons of bass consisting of three flat notes, seven natural notes and two sharp notes. As shown in the embodiment depicted in FIG. 15, Gb3 is located in Column X−5; Eb3 is located in Column X−4; Bb3 is located in Column X−3; F3 is located in Column X−2; C3 is located in Column X−1; G3 is located in Column X (center); D3 is located in Column X+1; A4 is located in Column X+2; E4 is located in Column X+3; B3 is located in Column X+4; F#4 is located in Column X+5; and C#3 is located in Column X+6. Gb3, Eb3, Bb3, F3, C3, G3, D3, A4, E4, B3, F#4 and C#3 are elements of this pattern. The note formulation in 12 columns 1510 of Row#4 1524 is the $5^{th}$ common note in major and minor scale count from root (Perfect fifth note).

The Row#5 1525 includes up to 12 buttons of bass consisting of eight natural notes and four sharp notes. As shown in the embodiment depicted in FIG. 15, F4 is located in Column X−5; C4 is located in Column X−4; G4 is located in Column X−3; D4 is located in Column X−2; A4 is located in Column X−1; E4 is located in Column X (center); B4 is located in Column X+1; F#4 is located in Column X+2; C#5 is located in Column X+3; G#4 is located in Column X+4; D5 is located in Column X+5; and A#4 is located in Column X+6. F4, C4, G4, D4, A4, E4, B4, F#4, C#5, G#4, D5 and A#4 are elements of this pattern. The note formulation in 12 columns 1510 of Row#5 1525 is the $10^{th}$ note in major scale count from root (Major third of next octave).

The Row#6 1526 includes up to 12 buttons of bass consisting of four flat notes, seven natural notes and one sharp notes. As shown in the embodiment depicted in FIG. 15, Db4 is located in Column X−5; Ab3 is located in Column X−4; Eb4 is located in Column X−3; Bb3 is located in Column X−2; F4 is located in Column X−1; C4 is located in Column X (center); G4 is located in Column X+1; D4 is located in Column X+2; A4 is located in Column X+3; E4 is located in Column X+4; B4 is located in Column X+5; and F#4 is located in Column X+6. Db4, Ab3, Eb4, Bb3, F4, C4, G4, D4, A4, E4, B4 and F#4 are elements of this pattern. The note formulation in 12 columns 1510 of Row#6 1526 is the $8^{th}$ common note in major and minor scale count from root (octaved note).

In the Note layout of FIG. 15, most of the notes are compatible with this note layout in case of accordion designs shutters that can switch from standard chord note chart into a new note chart by using a sound register switch. This individual notes or set of notes in each rows belong to set of notes in preset chord standard system. This note layout is very easy to play with many fingering patterns and can help beginners to learn the accordion easier. First, the Major chord in Arpeggio style (Wide Octave Arpeggio Scale) i.e.; the fingering of 1-5-8-5-10-5-8-5-1, if the starting note is C3. The pattern will be C3-G3-C4-G3-E4-G3-C4-G3-C3. If the starting note is D3, the pattern will be D3-A3-D4-A3-F#4-A3-D4-A3-D3. Or if the starting note is E3, the pattern will be E3-B3-E4-B3-G#4-B3-E3-B3-E3. Second, the Major and Minor Chords in Arpeggio Style (ignore $3^{rd}$ or $10^{th}$ Note that can identify chord quality of Major or Minor) with the following pattern; 1-5-8-5-1. If the starting note is C3. The pattern will be C3-G3-C4-G3-C3. If the starting note is D3, the pattern will be D3-A3-D4-A3-D3. Or if the starting note is E3, the pattern will be E3-B3-E4-B3-E3. Third, the Arpeggio style of Major $7^{th}$ chord by fingering of pattern 1-3-5-7. Fourth, the Arpeggio style on the $9^{th}$, $11^{th}$ extended chords. Fifth, 3 Notes (Pattern of 1-b3-5 or b3-5-8) of Minor Triad are contiguously arranged in the column (easy to play Triad Minor Block Chord with close contiguous 3 fingers).

Ability to play Diminished Block Chord (1, b3, b5) is easy to play with. This note layout can fairly play with the following pattern and style; First, Arpeggio style of Dominant $7^{th}$ Chord 1-3-5-b7, 1-5-b7-8. Second, Arpeggio style of Diminished Chord [1, b3, b5] or [1, b3, b5, bb7 (or 6)] or [1, b3, bb7 (6)] and having alternative notes in adjacent columns to create Dim Chord. Third, Arpeggio style of Diminished Chord [1, b3, b5, bb7 (or 6)] for 2 Octaves and having alternative notes in adjacent columns to create Dim Chord). Fourth, 3 Notes Block Chord (1-3-5 or 3-5-8 or 5-8-10) of Major Triad or The shape of 3 notes are contiguously arranged in the same column.

The difficulty of pattern or style to play with this note layout are the following; Chromatic Scale 12 Notes, Major of Minor Scale with 1.5-2 Octave, and Compatible or Adaptable to use 5-Line Notation to communicate or record how to play notes in a song. (Solmization). It is very difficult to play using this note layout for Minor Chord in Arpeggio Style (or Arpeggio Scale), Arpeggio style of Minor Chord by pattern of (1-b3-5-8-5-b3-1), and Major $9^{th}$, Major $11^{th}$ block chord by using only 2-3 buttons combination.

Figure 16:
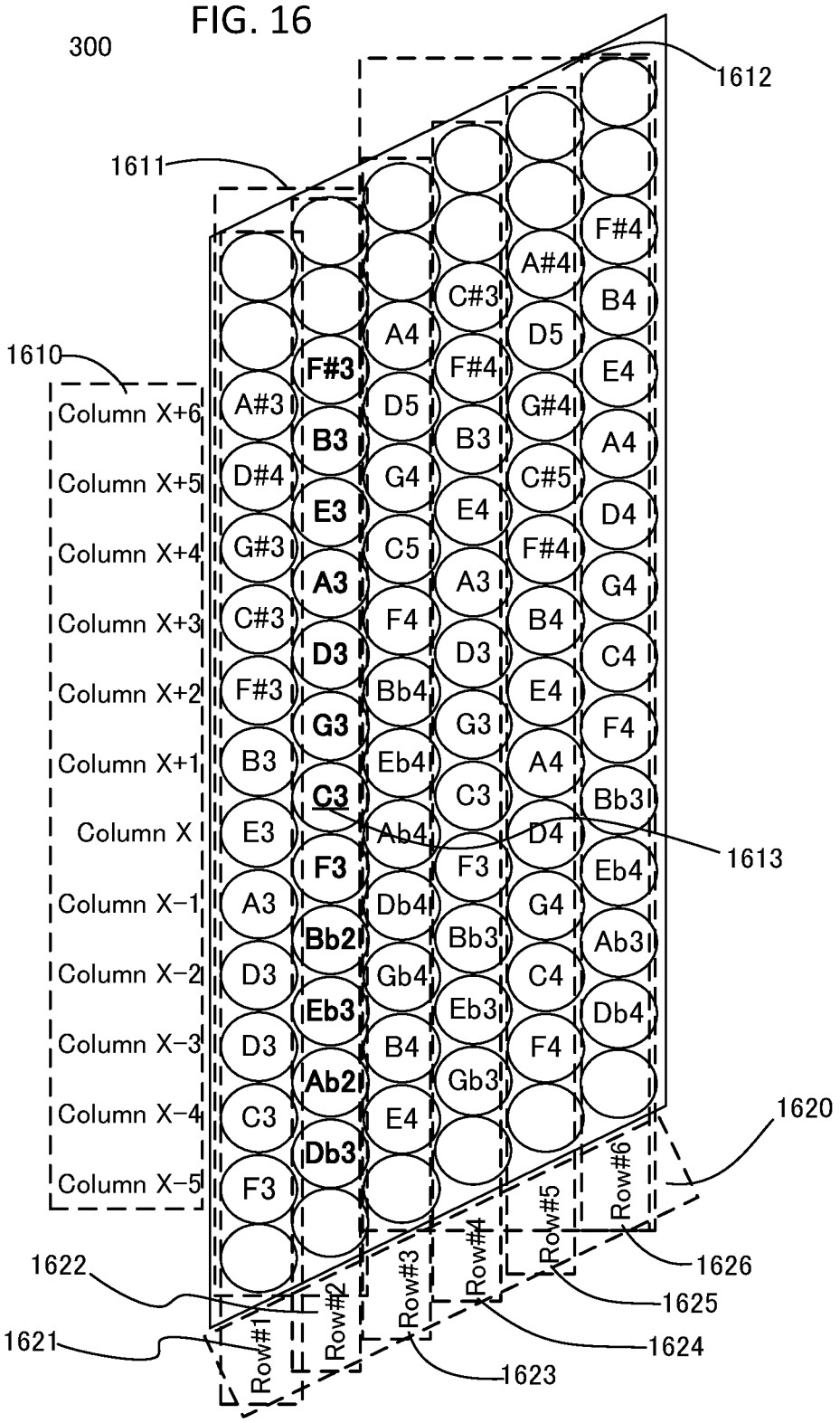
FIG. 16 is a diagram illustrating an example of chord tone pattern which contains Major and Minor scale in the higher octave of the present invention.

FIG. 16 illustrates an exploded view of the Chord Tone Pattern. As shown in this figure, the Chord Tone Pattern of the present embodiment includes six rows of buttons 1620. The six rows of button 1620 are arranged in lines in a direction substantially orthogonal to an expansion and contraction direction of the bellow 300. Columns 1610 contain 12 columns 1610 about 72 basses. The six rows of buttons 1620 include 12 columns 1610 consisting of X−5, X−4, X−3, X−2, X−1, X, X+1, X+2, X+3, X+4, X+5 and X+6. Row#1 1621 and Row#2 1622 are assigned to bass notes 1611. Row#3 1623, Row#4 1624, Row#5 1625 and Row#6 1626 are assigned to present cords 1612 (triads).

As shown in the embodiment depicted in FIG. 16, for each buttons from the six rows of buttons 1620 a number appears after a note. These numbers are octave numbers which are used for identifying the pitches in an octave. The octave number increases by one upon an ascension from B to C. A greater number refers to a higher note while a smaller number refers to a lower note. Though a "C4" is normally assigned as a middle C, a "C3" button 1613 is a C Root note, which is assigned as a middle C and is located in Row#2 1622 and Column X, in order to solve the problem when playing the triad with the close contiguous 3 fingers by arranging 3 notes of major triad or minor triad in the column. This "C3" button 1613 allows more extension of directions both following the circle of fifths and the circle of fourths (Moving counterclockwise in the direction of the circle of fifths).

The Row#1 1621 includes up to 12 buttons of bass consisting of seven natural notes and five sharp notes. As shown in the embodiment depicted in FIG. 16, F3 is located in Column X−5; C3 is located in Column X−4; D3 is located in Column X−3; D3 is located in Column X−2; A3 is located in Column X−1; E3 is located in Column X (center); B3 is located in Column X+1; F#3 is located in Column X+2; C#3 is located in Column X+3; G#3 is located in Column X+4; D#4 is located in Column X+5; and A#3 is located in Column X+6. F3, C3, D3, D3, A3, E3, B3, F#3, C#3, G#3, D#4 and A#3 are elements of this pattern. The note formulation in 12 columns 1610 of Row#1 1621 is the $3^{rd}$ note in major scale count from root (major third note).

The Row#2 1622 includes up to 12 buttons of bass consisting of four flat notes, seven natural notes and one sharp notes. As shown in the embodiment depicted in FIG. 16, Db3 is located in Column X−5; Ab2 is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; and F#3 is located in Column X+6. Db3, Ab2, Eb3, Bb2, F3, C3, G3, D3, A3, E3, B3 and F#3 are elements of this pattern. The note formulation in 12 columns 1610 of Row#2 1622 is the root of scale and chord.

The Row#3 1623 includes up to 12 buttons of bass consisting of five flat notes and seven natural notes. As shown in the embodiment depicted in FIG. 16, E4 is located in Column X−5; B4 is located in Column X−4; Gb4 is located in Column X−3; Db4 is located in Column X−2; Ab4 is located in Column X−1; Eb4 is located in Column X (center); Bb4 is located in Column X+1; F4 is located in Column X+2; C5 is located in Column X+3; G4 is located in Column X+4; D5 is located in Column X+5; and A4 is located in Column X+6. E4, B4, Gb4, Db4, Ab4, Eb4, Bb4, F4, C5, G4, D5 and A4 are elements of this pattern. The note formulation in 12 columns 1610 of Row#3 1623 is the $3^{rd}$ note in minor scale count from root (Minor third note).

The Row#4 1624 includes up to 12 buttons of bass consisting of three flat notes, seven natural notes and two sharp notes. As shown in the embodiment depicted in FIG.

16, Gb3 is located in Column X−5; Eb3 is located in Column X−4; Bb3 is located in Column X−3; F3 is located in Column X−2; C3 is located in Column X−1; G3 is located in Column X (center); D3 is located in Column X+1; A3 is located in Column X+2; E4 is located in Column X+3; B3 is located in Column X+4; F#4 is located in Column X+5; and C#3 is located in Column X+6. Gb3, Eb3, Bb3, F3, C3, G3, D3, A3, E4, B3, F#4 and C#3 are elements of this pattern. The note formulation in 12 columns 1610 of Row#4 1624 is the $5^{th}$ common note in major and minor scale count from root (Perfect fifth note).

The Row#5 1625 includes up to 12 buttons of bass consisting of eight natural notes and four sharp notes. As shown in the embodiment depicted in FIG. 16, F4 is located in Column X−5; C4 is located in Column X−4; G4 is located in Column X−3; D4 is located in Column X−2; A4 is located in Column X−1; E4 is located in Column X (center); B4 is located in Column X+1; F#4 is located in Column X+2; C#5 is located in Column X+3; G#4 is located in Column X+4; D5 is located in Column X+5; and A#4 is located in Column X+6. F4, C4, G4, D4, A4, E4, B4, F#4, C#5, G#4, D5 and A#4 are elements of this pattern. The note formulation in 12 columns 1610 of Row#5 1625 is the $10^{th}$ note in major scale count from root (Major third of next octave).

The Row#6 1626 includes up to 12 buttons of bass consisting of four flat notes, seven natural notes and one sharp notes. As shown in the embodiment depicted in FIG. 16, Db4 is located in Column X−5; Ab3 is located in Column X−4; Eb4 is located in Column X−3; Bb3 is located in Column X−2; F4 is located in Column X−1; C4 is located in Column X (center); G4 is located in Column X+1; D4 is located in Column X+2; A4 is located in Column X+3; E4 is located in Column X+4; B4 is located in Column X+5; and F#4 is located in Column X+6. Db4, Ab3, Eb4, Bb3, F4, C4, G4, D4, A4, E4, B4 and F#4 are elements of this pattern. The note formulation in 12 columns 1610 of Row#6 1626 is the $8^{th}$ common note in major and minor scale count from root (octaved note).

In the Note layout of FIG. 16, the individual notes are fairly compatible with this note layout in case of accordion designs shutters that can switch from a standard chord note chart into new note chart by using sound register switch. This individual notes or set of notes in each rows belong to set of notes in preset chord standard system. This note layout is very easy to play with many fingering patterns and can help beginners to learn the accordion easier. First, the Major chord in Arpeggio style (Wide Octave Arpeggio Scale) i.e.; the fingering of 1-5-8-5-10-5-8-5-1, if the starting note is C3. The pattern will be C3-G3-C4-G3-E4-G3-C4-G3-C3. If the starting note is D3, the pattern will be D3-A3-D4-A3-F#4-A3-D4-A3-D3. Or, if the starting note is E3, the pattern will be E3-B3-E4-B3-G#4-B3-E3-B3-E3. Second, the Major and Minor Chords in Arpeggio Style (ignore 3rd or $10^{th}$ Note that can identify chord quality of Major or Minor) with the following pattern; 1-5-8-5-1. If the starting note is C3, the pattern will be C3-G3-C4-G3-C3. If the starting note is D3, the pattern will be D3-A3-D4-A3-D3. Or, if the starting note is E3, the pattern will be E3-B3-E4-B3-E3. Third, the Arpeggio style of Major $7^{th}$ chord by the fingering of pattern 1-3-5-7. Fourth, the Arpeggio style on the $9^{th}$, $11^{th}$ extended chords.

This note layout can fairly play with the following pattern and style; First, Arpeggio Style of Minor Chord with the pattern of 1-b3-5-8-5-b3-1. Second, Arpeggio style of Dominant $7^{th}$ Chord 1-3-5-b7, 1-5-b7-8. Third, Arpeggio style of Diminished Chord [1, b3, b5] or [1, b3, b5, bb7(or 6)] or [1, b3, bb7(6)] and having alternative notes in beside columns to create Dim Chord. Fourth, 3 Notes (Pattern of 1-b3-5 or b3-5-8) of Minor Triad are contiguous arranged in the column (easy to play Triad Minor Block Chord with close contiguous 3 fingers). Fifth, 3 Notes Block Chord (1-3-5 or 3-5-8 or 5-8-10) of Major Triad or The shape of 3 notes are contiguous arranged in the same column.

The difficulty of pattern or style to play with this note layout are the following; Arpeggio style of Diminished Chord [1, b3, b5, bb7 (or 6)] for 2 Octaves and having alternative notes in beside columns to create Dim Chord), Diminished Block Chord [1, b3, b5], Chromatic Scale 12 Notes, Major of Minor Scale for 1.5-2 Octave, and compatible to use 5-Line Notation to communicate or record how to play notes in a song. (Solmization).

Figure 17:
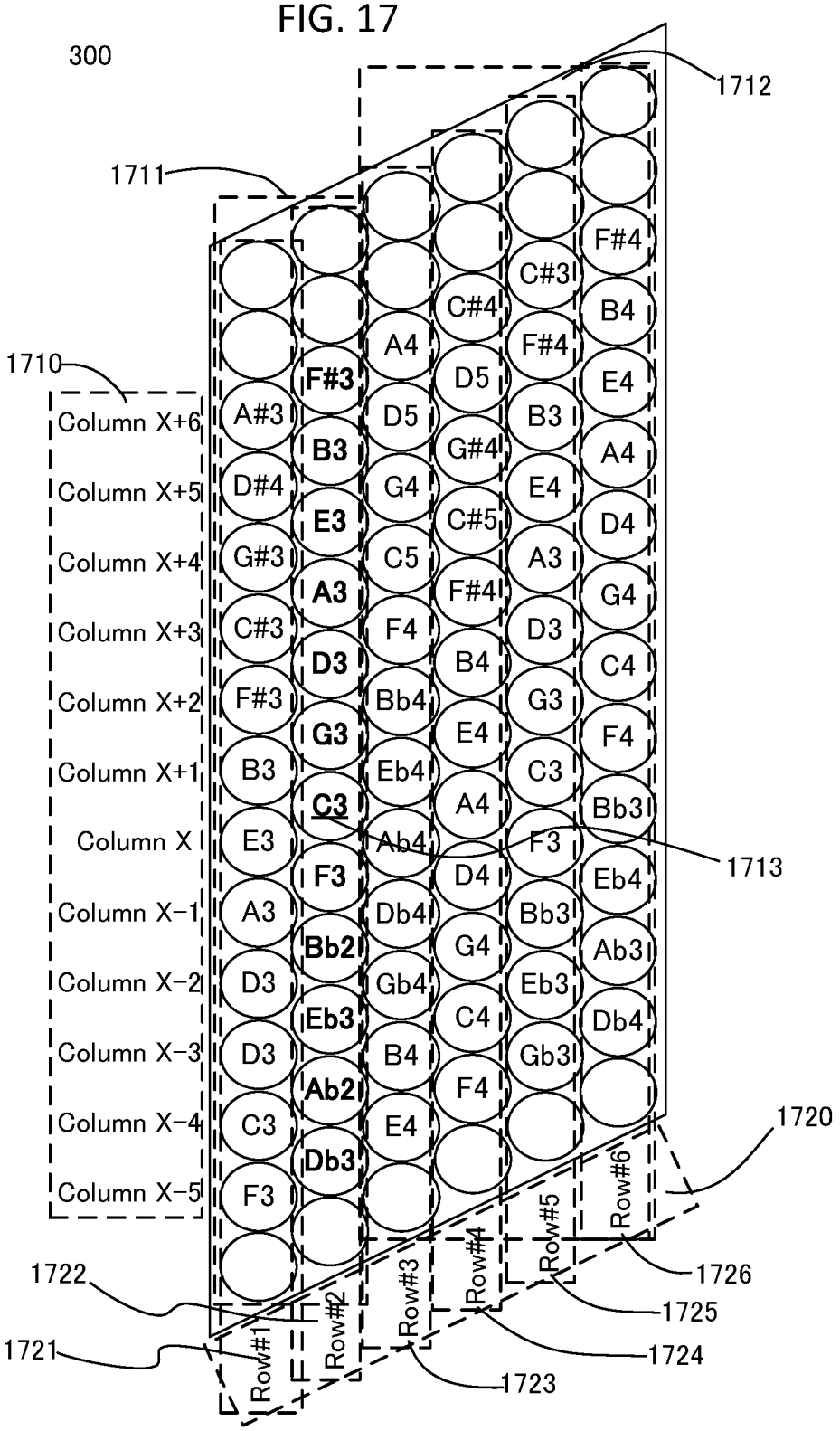
FIG. 17 is a diagram illustrating an example of chord tone pattern which contains Major and Minor scale (minor change in row 4, 5 and 6 from FIG. 16) of the present invention.

FIG. 17 illustrates an exploded view of the Chord Tone Pattern. As shown in this figure, the Chord Tone Pattern of the present embodiment includes six rows of buttons 1720. The six rows of button 1720 are arranged in lines in a direction substantially orthogonal to an expansion and contraction direction of the bellow 300. Columns 1710 contain 12 columns 1710 about 72 basses. The six rows of buttons 1720 include 12 columns 1710 consisting of X−5, X−4, X−3, X−2, X−1, X, X+1, X+2, X+3, X+4, X+5 and X+6. Row#1 1721 and Row#2 1722 are assigned to bass notes 1711. Row#3 1723, Row#4 1724, Row#5 1725 and Row#6 1726 are assigned to present cords 1712 (triads).

As shown in the embodiment depicted in FIG. 17, for each buttons from the six rows of buttons 1720 a number appears after a note. These numbers are octave numbers which are used for identifying the pitches in an octave. The octave number increases by one upon an ascension from B to C. A greater number refers to a higher note while a smaller number refers to a lower note. Though a "C4" is normally assigned as a middle C, a "C3" button 1713 is a C Root note, which is assigned as a middle C and is located in Row#2 1722 and Column X, in order to solve the problem when playing the triad with the close contiguous 3 fingers by arranging 3 notes of major triad or minor triad in the column. This "C3" button 1713 allows more extension of directions both following the circle of fifths and the circle of fourths (Moving counterclockwise in the direction of the circle of fifths).

The Row#1 1721 includes up to 12 buttons of bass consisting of seven natural notes and five sharp notes. As shown in the embodiment depicted in FIG. 17, F3 is located in Column X−5; C3 is located in Column X−4; D3 is located in Column X−3; D3 is located in Column X−2; A3 is located in Column X−1; E3 is located in Column X (center); B3 is located in Column X+1; F#3 is located in Column X+2; C#3 is located in Column X+3; G#3 is located in Column X+4; D#4 is located in Column X+5; and A#3 is located in Column X+6. F3, C3, D3, D3, A3, E3, B3, F#3, C#3, G#3, D#4 and A#3 are elements of this pattern. The note formulation in 12 columns 1710 of Row#1 1721 is the $3^{rd}$ note in major scale count from root (major third note).

The Row#2 1722 includes up to 12 buttons of bass consisting of four flat notes, seven natural notes and one sharp notes. As shown in the embodiment depicted in FIG. 17, Db3 is located in Column X−5; Ab2 is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; and F#3 is located in Column X+6. Db3, Ab2, Eb3, Bb2, F3, C3, G3, D3, A3, E3, B3 and F#3 are elements of this pattern. The note formulation in 12 columns 1710 of Row#2 1722 is the root of scale and chord.

The Row#3 1723 includes up to 12 buttons of bass consisting of five flat notes and seven natural notes. As shown in the embodiment depicted in FIG. 17, E4 is located in Column X−5; B4 is located in Column X−4; Gb4 is located in Column X−3; Db4 is located in Column X−2; Ab4 is located in Column X−1; Eb4 is located in Column X (center); Bb4 is located in Column X+1; F4 is located in Column X+2; C5 is located in Column X+3; G4 is located in Column X+4; D5 is located in Column X+5; and A4 is located in Column X+6. E4, B4, Gb4, Db4, Ab4, Eb4, Bb4, F4, C5, G4, D5 and A4 are elements of this pattern. The note formulation in 12 columns 1710 of Row#3 1723 is the $10^{th}$ note in minor scale count from root (Minor tenth note).

The Row#4 1724 includes up to 12 buttons of bass consisting of eight natural notes and four sharp notes. As shown in the embodiment depicted in FIG. 17, F4 is located in Column X−5; C4 is located in Column X−4; G4 is located in Column X−3; D4 is located in Column X−2; A4 is located in Column X−1; E4 is located in Column X (center); B4 is located in Column X+1; F#4 is located in Column X+2; C#5 is located in Column X+3; G#4 is located in Column X+4; D5 is located in Column X+5; and C#4 is located in Column X+6. F4, C4, G4, D4, A4, E4, B4, F#4, C#5, G#4, D5 and C#4 are elements of this pattern. The note formulation in 12 columns 1710 of Row#4 1724 is the $10^{th}$ note in Major scale count from root (Major tenth note).

The Row#5 1725 includes up to 12 buttons of bass consisting of three flat notes, seven natural notes and two sharp notes. As shown in the embodiment depicted in FIG. 17, Gb3 is located in Column X−5; Eb3 is located in Column X−4; Bb3 is located in Column X−3; F3 is located in Column X−2; C3 is located in Column X−1; G3 is located in Column X (center); D3 is located in Column X+1; A3 is located in Column X+2; E4 is located in Column X+3; B3 is located in Column X+4; F#4 is located in Column X+5; and C#3 is located in Column X+6. Gb3, Eb3, Bb3, F3, C3, G3, D3, A3, E4, B3, F#4 and C#3 are elements of this pattern. The note formulation in 12 columns 1710 of Row#4 1725 is the $5^{th}$ common note in major and minor scale count from root (Perfect fifth note).

The Row#6 1726 includes up to 12 buttons of bass consisting of four flat notes, seven natural notes and one sharp notes. As shown in the embodiment depicted in FIG. 17, Db4 is located in Column X−5; Ab3 is located in Column X−4; Eb4 is located in Column X−3; Bb3 is located in Column X−2; F4 is located in Column X−1; C4 is located in Column X (center); G4 is located in Column X+1; D4 is located in Column X+2; A4 is located in Column X+3; E4 is located in Column X+4; B4 is located in Column X+5; and F#4 is located in Column X+6. Db4, Ab3, Eb4, Bb3, F4, C4, G4, D4, A4, E4, B4 and F#4 are elements of this pattern. The note formulation in 12 columns 1710 of Row#6 1726 is the $8^{th}$ common note in major and minor scale count from root (octaved note).

The Note layout of FIG. 17 is very easy to play with many fingering patterns and can help beginners to learn the accordion easier. First, the Major and Minor Chords in Arpeggio Style (ignore 3rd or $10^{th}$ Note that can identify chord quality of Major or Minor) with the following pattern; 1-5-8-5-1. If the starting note is C3, the pattern will be C3-G3-C4-G3-C3. If the starting note is D3, the pattern will be D3-A3-D4-A3-D3. Or, if the starting note is E3, the pattern will be E3-B3-E4-B3-E3. Second, the Arpeggio style of Major $7^{th}$ chord by the fingering pattern of 1-3-5-7. Third, 3 Notes Block Chord (1-3-5 or 3-5-8 or 5-8-10) of Major Triad or The shape of 3 notes are contiguously arranged in the same column.

This note layout can easy play with the following pattern and style; First, Major chord in Arpeggio style (Wide Octave Arpeggio Scale) i.e.; the fingering of 1-5-8-5-10-5-8-5-1, if the starting note is C3, the pattern will be C3-G3-C4-G3-E4-G3-C4-G3-C3. If the starting note is D3, the pattern will be D3-A3-D4-A3-F#4-A3-D4-A3-D3. Or, if the starting note is E3, the pattern will be E3-B3-E4-B3-G#4-B3-E3-B3-E3. Second, Minor Chord in Arpeggio Style (or Arpeggio Scale) with the pattern of 1-5-8-5-b10-5-8-5-1. Third, Arpeggio style of $9^{th}$ or $11^{th}$ extension chords. Fourth, Arpeggio style of Dominant $7^{th}$ Chord 1-3-5-b7, 1-5-b7-8.

Arpeggio style of Diminished Chord [1, b3, b5] or [1, b3, b5, bb7(or 6)] or [1, b3, bb7(6)] and having alternative notes in adjacent columns to create Dim Chord, and 3 Notes (Pattern of 1-b3-5 or b3-5-8) of Minor Triad are contiguous arranged in the column (easy to play Triad Minor Block Chord with close contiguous 3 fingers) can be fairly play with this note layout.

The difficulty of pattern or style to play with this note layout are the following; Arpeggio style of Minor Chord with pattern of (1-b3-5-8-5-b3-1), Arpeggio style of Diminished Chord [1, b3, b5, bb7 (or 6)] for 2 Octaves and having alternative notes in beside columns to create Dim Chord), Diminished Block Chord [1, b3, b5], Chromatic Scale 12 Notes, Major of Minor Scale for 1.5-2 Octave, and compatible to use 5-Line Notation to communicate or record how to play notes in a song. (Solmization). It is very difficult to play Major $9^{th}$, Major $11^{th}$ block chord by using only 2-3 buttons combination.

Figure 18:
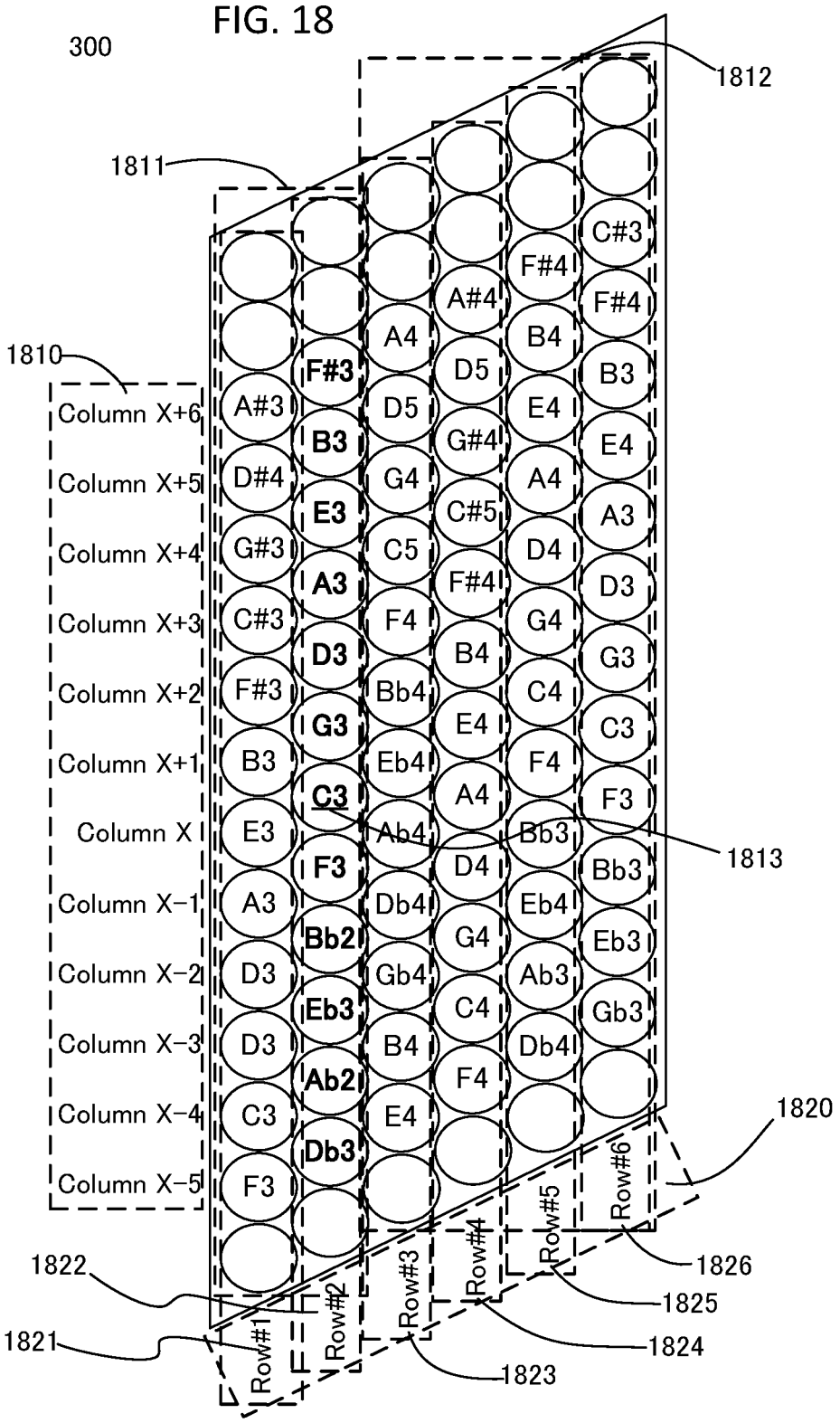
FIG. 18 is a diagram illustrating an example of chord tone pattern which contains Major and Minor scale (minor change in row 5 and 6 from FIG. 17) of the present invention.

FIG. 18 illustrates an exploded view of the Chord Tone Pattern. As shown in this figure, the Chord Tone Pattern of the present embodiment includes six rows of buttons 1820. The six rows of button 1820 are arranged in lines in a direction substantially orthogonal to an expansion and contraction direction of the bellow 300. Columns 1810 contain 12 columns 1810 about 72 basses. The six rows of buttons 1820 include 12 columns 1810 consisting of X−5, X−4, X−3, X−2, X−1, X, X+1, X+2, X+3, X+4, X+5 and X+6. Row#1 1821 and Row#2 1822 are assigned to bass notes 1811. Row#3 1823, Row#4 1824, Row#5 1825 and Row#6 1826 are assigned to present cords 1812 (triads).

As shown in the embodiment depicted in FIG. 18, for each buttons from the six rows of buttons 1820 a number appears after a note. These numbers are octave numbers which are used for identifying the pitches in an octave. The octave number increases by one upon an ascension from B to C. A greater number refers to a higher note while a smaller number refers to a lower note. Though a "C4" is normally assigned as a middle C, a "C3" button 1813 is a C Root note, which is assigned as a middle C and is located in Row#2 1822 and Column X, in order to solve the problem when playing the triad with the close contiguous 3 fingers by arranging 3 notes of major triad or minor triad in the column. This "C3" button 1813 allows more extension of directions both following the circle of fifths and the circle of fourths (Moving counterclockwise in the direction of the circle of fifths).

The Row#1 1821 includes up to 12 buttons of bass consisting of seven natural notes and five sharp notes. As shown in the embodiment depicted in FIG. 18, F3 is located in Column X−5; C3 is located in Column X−4; D3 is located in Column X−3; D3 is located in Column X−2; A3 is located in Column X−1; E3 is located in Column X (center); B3 is located in Column X+1; F#3 is located in Column X+2; C#3 is located in Column X+3; G#3 is located in Column X+4; D#4 is located in Column X+5; and A#3 is located in Column X+6. F3, C3, D3, D3, A3, E3, B3, F#3, C#3, G#3, D#4 and A#3 are elements of this pattern. The note formulation in 12 columns 1810 of Row#1 1821 is the 3$^{rd}$ note in major scale count from root (major third note).

The Row#2 1822 includes up to 12 buttons of bass consisting of four flat notes, seven natural notes and one sharp notes. As shown in the embodiment depicted in FIG. 18, Db3 is located in Column X−5; Ab2 is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; and F#3 is located in Column X+6. Db3, Ab2, Eb3, Bb2, F3, C3, G3, D3, A3, E3, B3 and F#3 are elements of this pattern. The note formulation in 12 columns 1810 of Row#2 1822 is the root of scale and chord.

The Row#3 1823 includes up to 12 buttons of bass consisting of five flat notes and seven natural notes. As shown in the embodiment depicted in FIG. 18, E4 is located in Column X−5; B4 is located in Column X−4; Gb4 is located in Column X−3; Db4 is located in Column X−2; Ab4 is located in Column X−1; Eb4 is located in Column X (center); Bb4 is located in Column X+1; F4 is located in Column X+2; C5 is located in Column X+3; G4 is located in Column X+4; D5 is located in Column X+5; and A4 is located in Column X+6. E4, B4, Gb4, Db4, Ab4, Eb4, Bb4, F4, C5, G4, D5 and A4 are elements of this pattern. The note formulation in 12 columns 1810 of Row#3 1823 is the 3$^{rd}$ note in minor scale count from root (Minor third note).

The Row#4 1824 includes up to 12 buttons of bass consisting of eight natural notes and four sharp notes. As shown in the embodiment depicted in FIG. 18, F4 is located in Column X−5; C4 is located in Column X−4; G4 is located in Column X−3; D4 is located in Column X−2; A4 is located in Column X−1; E4 is located in Column X (center); B4 is located in Column X+1; F#4 is located in Column X+2; C#5 is located in Column X+3; G#4 is located in Column X+4; D5 is located in Column X+5; and A#4 is located in Column X+6. F4, C4, G4, D4, A4, E4, B4, F#4, C#5, G#4, D5 and A#4 are elements of this pattern. The note formulation in 12 columns 1810 of Row#4 1824 is the 10$^{th}$ note in minor scale count from root (minor third note).

The Row#5 1825 includes up to 12 buttons of bass consisting of four flat notes, seven natural notes and one sharp notes. As shown in the embodiment depicted in FIG. 18, Db4 is located in Column X−5; Ab3 is located in Column X−4; Eb4 is located in Column X−3; Bb3 is located in Column X−2; F4 is located in Column X−1; C4 is located in Column X (center); G4 is located in Column X+1; D4 is located in Column X+2; A4 is located in Column X+3; E4 is located in Column X+4; B4 is located in Column X+5; and F#4 is located in Column X+6. Db4, Ab3, Eb4, Bb3, F4, C4, G4, D4, A4, E4, B4 and F#4 are elements of this pattern. The note formulation in 12 columns 1810 of Row#5 1825 is the 8$^{th}$ common note in major and minor scale count from root (octaved note).

The Row#6 1826 includes up to 12 buttons of bass consisting of three flat notes, seven natural notes and two sharp notes. As shown in the embodiment depicted in FIG. 18, Gb3 is located in Column X−5; Eb3 is located in Column X−4; Bb3 is located in Column X−3; F3 is located in Column X−2; C3 is located in Column X−1; G3 is located in Column X (center); D3 is located in Column X+1; A3 is located in Column X+2; E4 is located in Column X+3; B3 is located in Column X+4; F#4 is located in Column X+5; and C#3 is located in Column X+6. Gb3, Eb3, Bb3, F3, C3, G3, D3, A3, E4, B3, F#4 and C#3 are elements of this pattern. The note formulation in 12 columns 1810 of Row#6 1826 is the 5$^{th}$ common note in major and minor scale count from root (Perfect fifth note).

In the Note layout of FIG. 18, the individual notes are slightly difficult to be compatible with this note layout in case of accordion designs shutters that can switch from a standard chord note chart into a new note chart by using a sound register switch. This individual notes or set of notes in each rows belong to set of notes in preset chord standard system. This note layout is very easy to play with many fingering patterns and can help beginners to learn the accordion easier. First, the Major chord in Arpeggio style (Wide Octave Arpeggio Scale) i.e.; the fingering of 1-5-8-5-10-5-8-5-1, if the starting note is C3, the pattern will be C3-G3-C4-G3-E4-G3-C4-G3-C3. If the starting note is D3, the pattern will be D3-A3-D4-A3-F#4-A3-D4-A3-D3. Or, if the starting note is E3, the pattern will be E3-B3-E4-B3-G#4-B3-E3-B3-E3. Second, the Minor Chord in Arpeggio Style (or Arpeggio Scale). Third, the Major and the Minor Chord in Arpeggio Style (ignore 3$^{rd}$ or 10$^{th}$ Note that can identify chord quality of Major or Minor) with the following pattern; 1-5-8-5-1. If the starting note is C3, the pattern will be C3-G3-C4-G3-C3. If the starting note is D3, the pattern will be D3-A3-D4-A3-D3. Or, if the starting note is E3, the pattern will be E3-B3-E4-B3-E3. Fourth, the Arpeggio style of Major 7$^{th}$ chord by the fingering of pattern 1-3-5-7. Fifth, the Arpeggio style on the 9$^{th}$, 11$^{th}$ extended chord. Sixth, 3 Notes Block Chord (1-3-5 or 3-5-8 or 5-8-10) of Major Triad or The shape of 3 notes are contiguously arranged in the same column.

Arpeggio style of Dominant 7$^{th}$ Chord by the pattern of (1-3-5-b7, 1-5-b7-8) and Arpeggio style of Diminished Chord [1, b3, b5] or [1, b3, b5, bb7(or 6)] or [1, b3, bb7(6)] and having alternative notes in adjacent columns to create Dim Chord are easy to play with this note layout. Arpeggio style of Diminished Chord [1, b3, b5, bb7 (or 6)] for 2 Octaves and having alternative notes in beside columns to create Dim Chord) and Diminished Block's Chord (1, b3, b5) are fairly difficult to play with this note layout.

It is difficult to play with Arpeggio style of Minor Chord with pattern of (1-b3-5-8-5-b3-1), 3 Notes (Pattern of 1-b3-5 or b3-5-8) of Minor Triad are contiguous arranged in the column (easy to play Triad Minor Block Chord with close contiguous 3 fingers), Chromatic Scale 12 Notes, Major of Minor Scale with 1.5-2 Octave, and Compatible or Adaptable to use 5-Line Notation to communicate or record how to play notes in a song (Solmization). Major 9$^{th}$, Major 11$^{th}$ block chord by using only 2-3 buttons combination is very difficult to play with this note layout.

Figure 19:
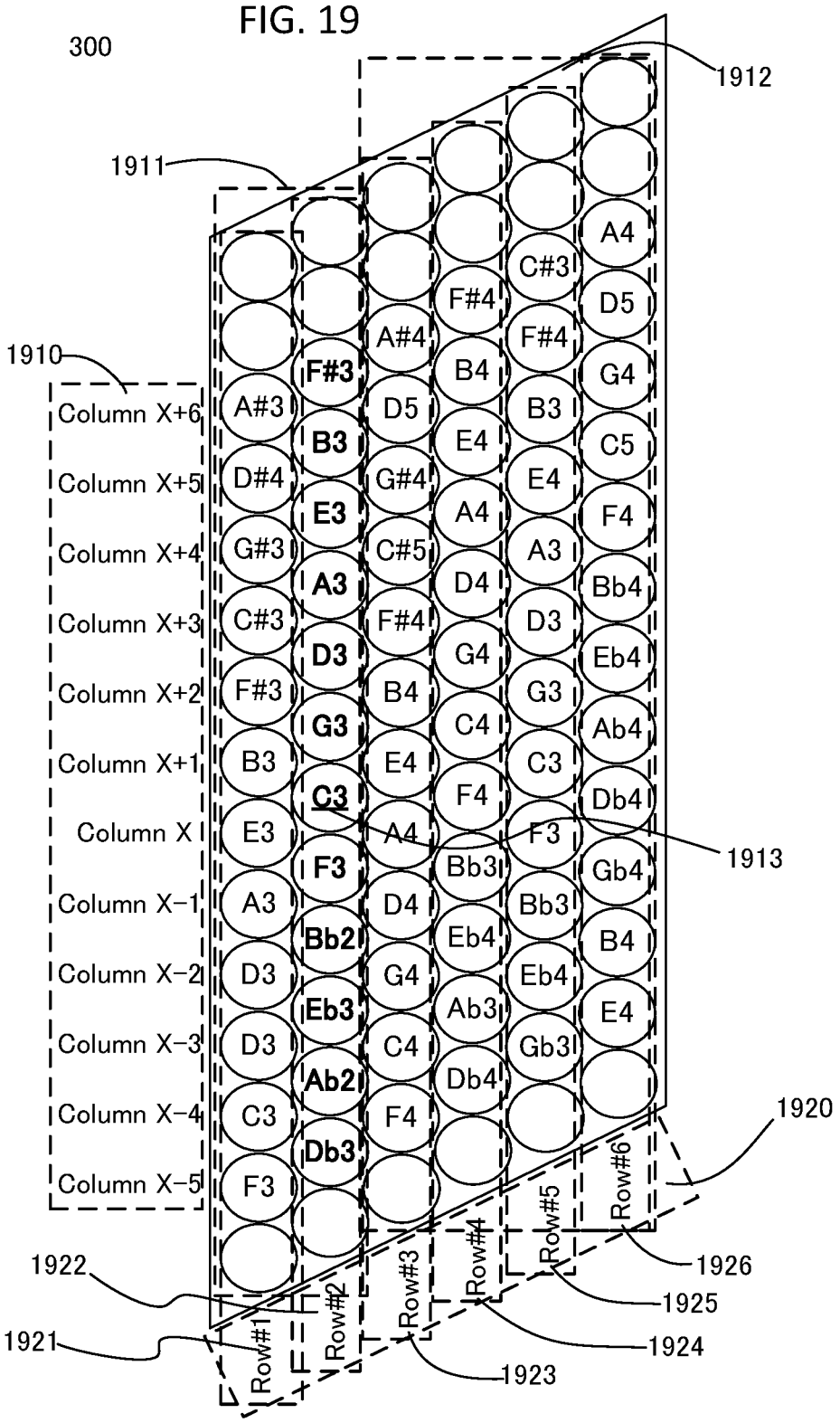
FIG. 19 is a diagram illustrating an example of chord tone pattern which contains Major and Minor scale (minor change in row 3, 4, 5 and 6 from FIG. 18) of the present invention.

FIG. 19 illustrates an exploded view of the Chord Tone Pattern. As shown in this figure, the Chord Tone Pattern of the present embodiment includes six rows of buttons 1920. The six rows of button 1920 are arranged in lines in a direction substantially orthogonal to an expansion and contraction direction of the bellow 300. Columns 11910 contain 12 columns 1910 about 72 basses. The six rows of buttons 1920 include 12 columns 1910 consisting of X−5, X−4, X−3, X−2, X−1, X, X+1, X+2, X+3, X+4, X+5 and X+6. Row#1 1921 and Row#2 1922 are assigned to bass notes 1911. Row#3 1923, Row#4 1924, Row#5 1925 and Row#6 1926 are assigned to present cords 1912 (triads).

As shown in the embodiment depicted in FIG. 19, for each buttons from the six rows of buttons 620 a number appears after a note. These numbers are octave numbers which are used for identifying the pitches in an octave. The octave number increases by one upon an ascension from B to C. A greater number refers to a higher note while a smaller number refers to a lower note. Though a "C4" is normally assigned as a middle C, a "C3" button 1913 is a C Root note, which is assigned as a middle C and is located in Row#2 1922 and Column X, in order to solve the problem when playing the triad with the close contiguous 3 fingers by arranging 3 notes of major triad or minor triad in the column. This "C3" button 1913 allows more extension of directions both following the circle of fifths and the circle of fourths (Moving counterclockwise in the direction of the circle of fifths).

The Row#1 1921 includes up to 12 buttons of bass consisting of seven natural notes and five sharp notes. As shown in the embodiment depicted in FIG. 19, F3 is located in Column X−5; C3 is located in Column X−4; D3 is located in Column X−3; D3 is located in Column X−2; A3 is located in Column X−1; E3 is located in Column X (center); B3 is located in Column X+1; F#3 is located in Column X+2; C#3 is located in Column X+3; G#3 is located in Column X+4; D#4 is located in Column X+5; and A#3 is located in Column X+6. F3, C3, D3, D3, A3, E3, B3, F#3, C#3, G#3, D#4 and A#3 are elements of this pattern. The note formulation in 12 columns 1910 of Row#1 1921 is the $3^{rd}$ note in major scale count from root (major third note).

The Row#2 1922 includes up to 12 buttons of bass consisting of four flat notes, seven natural notes and one sharp notes. As shown in the embodiment depicted in FIG. 19, Db3 is located in Column X−5; Ab2 is located in Column X−4; Eb3 is located in Column X−3; Bb2 is located in Column X−2; F3 is located in Column X−1; C3 is located in Column X (center); G3 is located in Column X+1; D3 is located in Column X+2; A3 is located in Column X+3; E3 is located in Column X+4; B3 is located in Column X+5; and F#3 is located in Column X+6. Db3, Ab2, Eb3, Bb2, F3, C3, G3, D3, A3, E3, B3 and F#3 are elements of this pattern. The note formulation in 12 columns 1910 of Row#2 1922 is the root of scale and chord.

The Row#3 1923 includes up to 12 buttons of bass consisting of eight natural notes and four sharp notes. As shown in the embodiment depicted in FIG. 19, F4 is located in Column X−5; C4 is located in Column X−4; G4 is located in Column X−3; D4 is located in Column X−2; A4 is located in Column X−1; E4 is located in Column X (center); B4 is located in Column X+1; F#4 is located in Column X+2; C#5 is located in Column X+3; G#4 is located in Column X+4; D5 is located in Column X+5; and A#4 is located in Column X+6. F4, C4, G4, D4, A4, E4, B4, F#4, C#5, G#4, D5 and A#4 are elements of this pattern. The note formulation in 12 columns 1910 of Row#3 1923 is the $10^{th}$ note in major scale count from root (major third of next octave).

The Row#4 1924 includes up to 12 buttons of bass consisting of four flat notes, seven natural notes and one sharp notes. As shown in the embodiment depicted in FIG. 19, Db4 is located in Column X−5; Ab3 is located in Column X−4; Eb4 is located in Column X−3; Bb3 is located in Column X−2; F4 is located in Column X−1; C4 is located in Column X (center); G4 is located in Column X+1; D4 is located in Column X+2; A4 is located in Column X+3; E4 is located in Column X+4; B4 is located in Column X+5; and F#4 is located in Column X+6. Db4, Ab3, Eb4, Bb3, F4, C4, G4, D4, A4, E4, B4 and F#4 are elements of this pattern. The note formulation in 12 columns 1910 of Row#4 1924 is the $8^{th}$ common note in major and minor scale count from root (octaved note).

The Row#5 1925 includes up to 12 buttons of bass consisting of three flat notes, seven natural notes and two sharp notes. As shown in the embodiment depicted in FIG. 19, Gb3 is located in Column X−5; Eb3 is located in Column X−4; Bb3 is located in Column X−3; F3 is located in Column X−2; C3 is located in Column X−1; G3 is located in Column X (center); D3 is located in Column X+1; A3 is located in Column X+2; E4 is located in Column X+3; B3 is located in Column X+4; F#4 is located in Column X+5; and C#3 is located in Column X+6. Gb3, Eb3, Bb3, F3, C3, G3, D3, A3, E4, B3, F#4 and C#3 are elements of this pattern. The note formulation in 12 columns 1910 of Row#5 1925 is the $5^{th}$ common note in major and minor scale count from root (Perfect fifth note).

The Row#6 1926 includes up to 12 buttons of bass consisting of five flat notes and seven natural notes. As shown in the embodiment depicted in FIG. 19, E4 is located in Column X−5; B4 is located in Column X−4; Gb4 is located in Column X−3; Db4 is located in Column X−2; Ab4 is located in Column X−1; Eb4 is located in Column X (center); Bb4 is located in Column X+1; F4 is located in Column X+2; C5 is located in Column X+3; G4 is located in Column X+4; D5 is located in Column X+5; and A4 is located in Column X+6. E4, B4, Gb4, Db4, Ab4, Eb4, Bb4, F4, C5, G4, D5 and A4 are elements of this pattern. The note formulation in 12 columns 1910 of Row#6 1926 is the $10^{th}$ note in minor scale count from root (Minor tenth note).

In the Note layout of FIG. 19, the individual notes are slightly difficult to be compatible with this note layout in case of accordion designs shutters that can switch from a standard chord note chart into a new note chart by using a sound register switch. This individual notes or set of notes in each rows belong to set of notes in preset chord standard system. This note layout is very easy to play with many fingering patterns and can help beginners to learn the accordion easier. First, the Major chord in Arpeggio style (Wide Octave Arpeggio Scale) i.e.; the fingering of 1-5-8-5-10-5-8-5-1, if the starting note is C3, the pattern will be C3-G3-C4-G3-E4-G3-C4-G3-C3. If the starting note is D3, the pattern will be D3-A3-D4-A3-F#4-A3-D4-A3-D3. Or, if the starting note is E3, the pattern will be E3-B3-E4-B3-G#4-B3-E3-B3-E3. Second, the Major and Minor Chords in Arpeggio Style (ignore 3rd or $10^{th}$ Note that can identify chord quality of Major or Minor) with the following pattern; 1-5-8-5-1. If the starting note is C1, the pattern will be C1-G1-C2-G1-C1. If the starting note is C3, the pattern will be C3-G3-C4-G3-C3. If the starting note is D3, the pattern will be D3-A3-D4-A3-D3. Or if the starting note is E3, the pattern will be E3-B3-E4-B3-E3. Third, the Arpeggio style of Major $7^{th}$ chord by the fingering pattern of 1-3-5-7. Fourth, the Arpeggio style on the $9^{th}$, $11^{th}$ extended chord. Fifth, the Arpeggio style of Dominant $7^{th}$ Chord by the pattern of (1-3-5-b7, 1-5-b7-8). Sixth, the Arpeggio style of Diminished Chord [1, b3, b5] or [1, b3, b5, bb7(or 6)] or [1, b3, bb7(6)] and having alternative notes in adjacent columns to create Dim Chord. Seventh, 3 Notes Block Chord (1-3-5 or 3-5-8 or 5-8-10) of Major Triad or The shape of 3 notes are contiguously arranged in the same column.

Arpeggio style of Diminished Chord [1, b3, b5, bb7 (or 6)] for 2 Octaves and having alternative notes in adjacent columns to create Dim Chord), Diminished Block's Chord (1, b3, b5), 3 Notes (Pattern of 1-b3-5 or b3-5-8) of Minor Triad are contiguously arranged in the column (easy to play Triad Minor Block Chord with close contiguous 3 fingers), Chromatic Scale 12 Notes, Major of Minor Scale with 1.5-2 Octave are fairly difficult to play with this note layout.

It is difficult to play with Minor Chord in Arpeggio Style (or Arpeggio Scale), Arpeggio style of Minor Chord with pattern of (1-b3-5-8-5-b3-1) and Adaptable to use 5-Line Notation to communicate or record how to play notes in a song (Solmization). Major $9^{th}$, Major $11^{th}$ block chord by using only 2-3 buttons combination is very difficult to play with this note layout.

Figure 20:
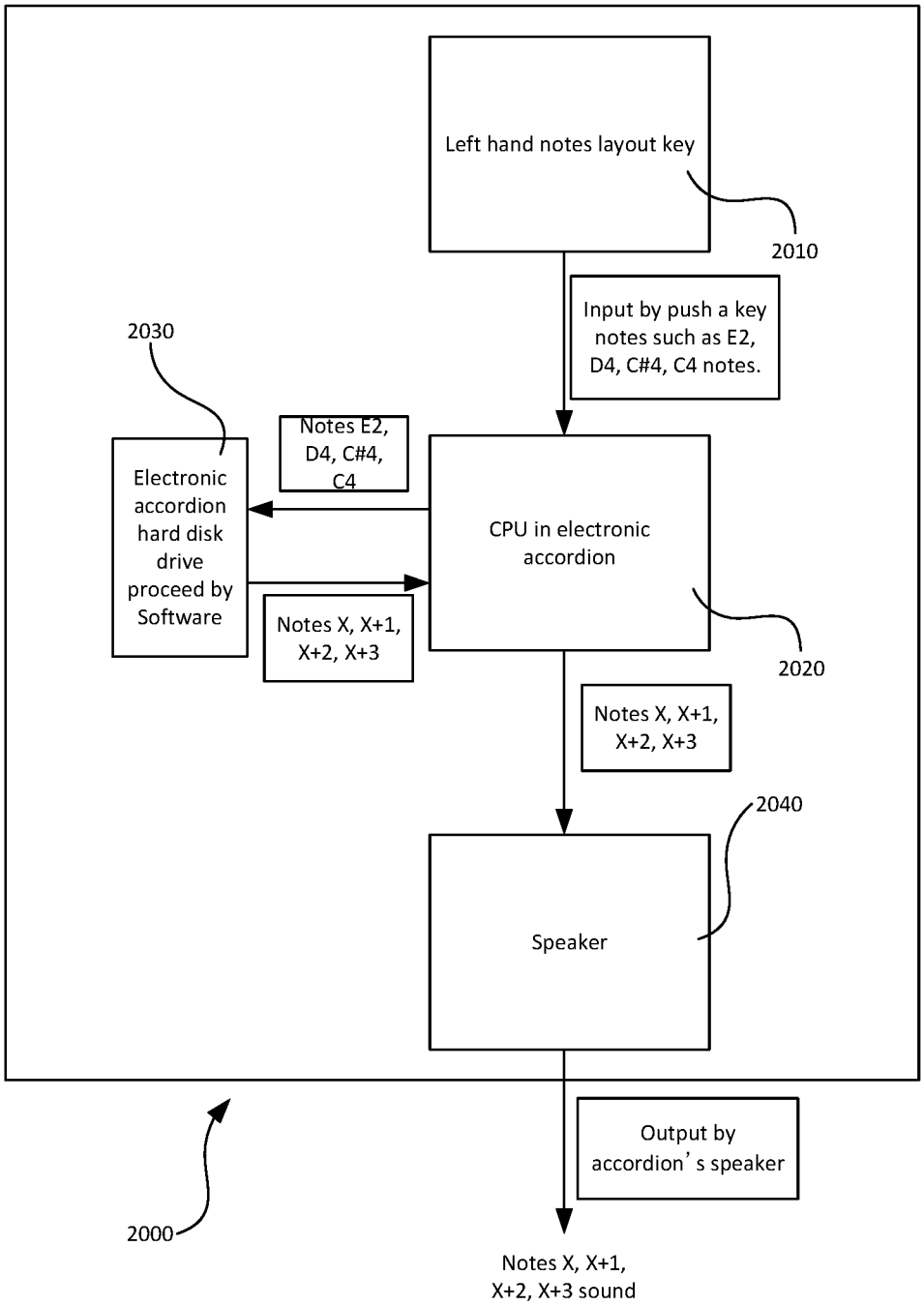
FIG. 20 is a diagram illustrating an example of an electronic accordion process without external device.

FIG. 20 illustrates a block diagram of an embodiment of an electronic accordion 2000 without external device. As shown in the drawing, the electronic accordion 2000 of this embodiment may include a left hand notes layout key 2010, a central processing unit (CPU) 2020, a memory 2030 in which a Software is stored, and a speaker 2040. The left hand notes layout key 2010 includes four to six rows of buttons and/or two rows of buttons. The input of the CPU 2020 is a channel for importing data from the left hand notes layout key 2010 to the CPU (controller) 2020 using a wire or a cable or circuit on board (main board or mother board). The CPU (controller) 2020 and the Software 2030 constitute a core of the electronic accordion 2000 to process the data input from the left hand notes layout key 2010. The CPU (controller) 2020 will process the data by the Software 2030 to analyze the data from the left hand notes layout key 2010. The CPU (controller) 2020 is configured to assign a plurality of pitches to the buttons of left hand play side such that the note layout pattern of the electronic accordion 2000 becomes as the note layout pattern described in FIG. 4 through FIG. 18. That is, the CPU (controller) 2020 is configured to assign a first continuous four pitches (for example, X, X+1, X+2, X+3) to a first column of the four rows of buttons. The CPU (controller) 2020 is further configured to assign a second continuous four pitches (for example, X+4, X+5, X+6, X+7) to a second column of the four rows of buttons. The second continuous four pitches are adjacent to the first continuous four pitches. The second column is provided adjacent to the first column.

The CPU (controller) 2020 is further configured to assign a third continuous four pitches (for example, X+8, X+9, X+10, X+11) to a third column of the four rows of buttons. Third continuous four pitches are adjacent to the second continuous pitches. The third column is provided adjacent to the second column. In addition, the CPU (controller) 2020 is configured to assign the first continuous four pitches such that the first continuous four pitches become higher in order in a direction approaching to the bellow 300 or away from the bellow 300. The CPU (controller) 2020 is further configured to assign the second continuous four pitches such that the second continuous four pitches become higher in order in a direction approaching to the bellow 300 or away from the bellow 300. The CPU (controller) 2020 is further configured to assign the third continuous four pitches such that the third continuous four pitches become higher in order in a direction approaching to the bellow or away from the bellow 300.

In addition, the CPU (controller) 2020 is further configured to assign a plurality of octaves (for example, octave 2 to octave 6) to a plurality of columns of the four rows of buttons such that the plurality of octaves become gradually higher or lower from a top side of the electronic accordion 2000 to a bottom side of the electronic accordion 2000. Each of the plurality of octaves has twelve pitches. The twelve pitches are assigned in the same manner as the first, second, and third continuous four pitches. However, the twelve pitches have different octave from the first, second, and third continuous four pitches.

Moreover, the CPU (controller) 2020 is further configured to assign a first continuous two pitches to a first column of the two rows of buttons. The CPU (controller) 2020 is then configured to assign a second continuous two pitches to a second column of the two rows of buttons. The second continuous two pitches are adjacent to the first continuous two pitches. The second column of the two rows of buttons is provided adjacent to the first column of the two rows of buttons. The CPU (controller) 2020 is further configured to assign a third continuous two pitches to a third column of the two rows of buttons. The third continuous two pitches are adjacent to the second continuous two pitches. The third column of the two rows of buttons is provided adjacent to the second column of the two rows of buttons. The CPU (controller) 2020 is further configured to assign a fourth continuous two pitches to a fourth column of the two rows of buttons. The fourth continuous two pitches are adjacent to the third continuous two pitches. The fourth column of the two rows of buttons is provided adjacent to the third column of the two rows of buttons. The CPU (controller) 2020 is further configured to assign a fifth continuous two pitches to a fifth column of the two rows of buttons. The fifth continuous two pitches are adjacent to the fourth continuous two pitches. The fifth column of the two rows of buttons is provided adjacent to the fourth column of the two rows of buttons. The CPU (controller) 2020 is further configured to assign a sixth continuous two pitches to a sixth column of the two rows of buttons. The sixth continuous two pitches are adjacent to the fifth continuous two pitches. The sixth column of the two rows of buttons is provided adjacent to the fifth column of the two rows of buttons.

Additionally, the CPU (controller) 2020 is further configured to assign a plurality of octaves to a plurality of columns of the two rows of buttons such that the plurality of octaves become gradually higher from a top side of the electronic accordion 2000 to a bottom side of the electronic accordion 2000. Each of the plurality of octaves has twelve pitches. The twelve pitches are assigned in the same manner as the first, second, third, fourth, fifth, and sixth continuous two pitches. However, the twelve pitches have different octave from the first, second, third, fourth, fifth, and sixth continuous two pitches.

The Speaker 2040 produces sound from a signal which is transferred from the CPU (controller) 2020. When the CPU (controller) 2020 has already analyzed the data by the Software 2030, the CPU (controller) 2020 will select a sound from the Software 2030. If the accordionist would like to change the note sound, the accordionist can change the note sound by the CPU 2020.

Figure 21:
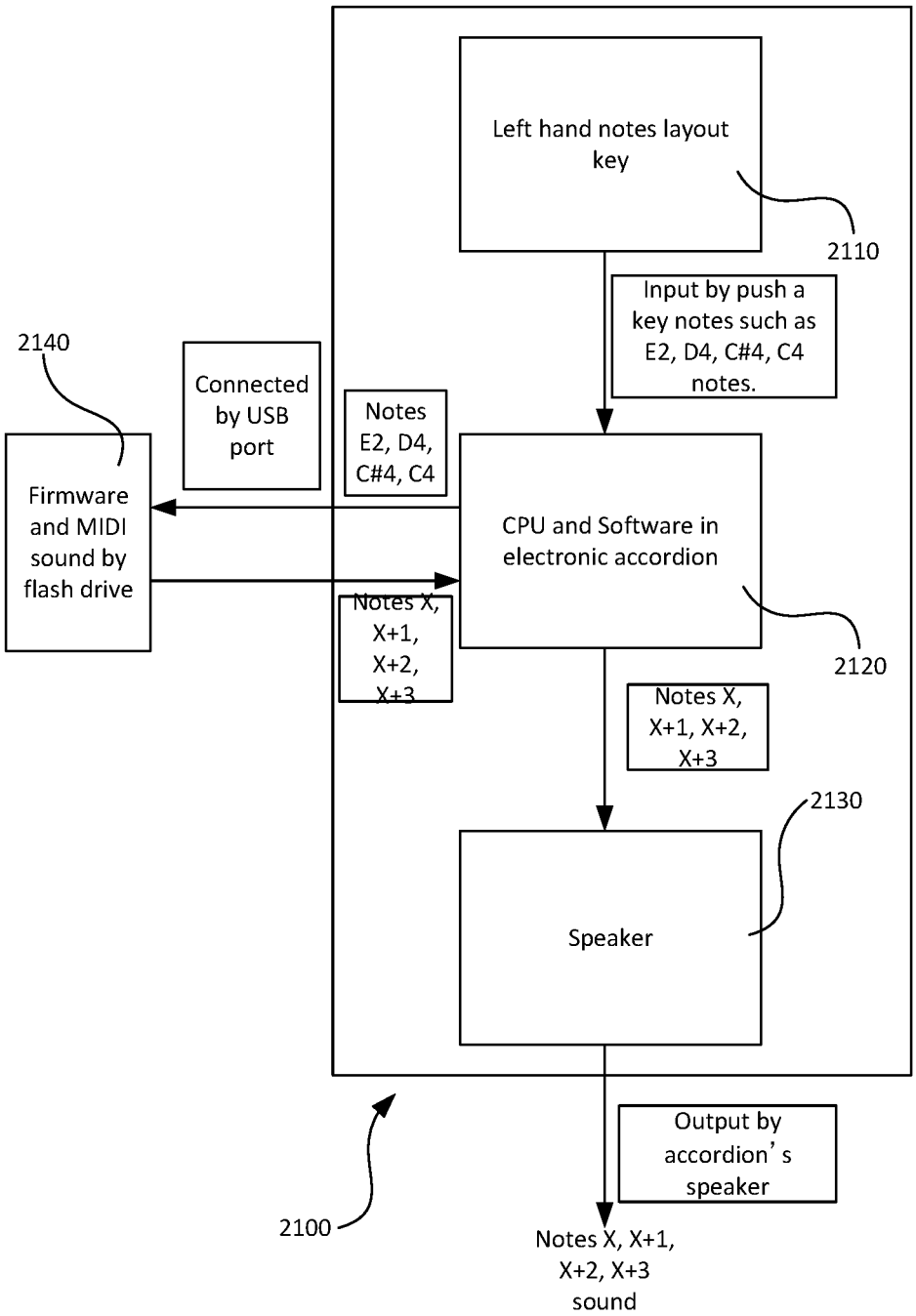
FIG. 21 is a diagram illustrating an example of an electronic accordion process within external device.

FIG. 21 illustrates a block diagram of an embodiment of an electronic accordion 2100 with external device 2140. As shown in the drawing, the electronic accordion 2100 of this embodiment may include a left hand notes layout key 2110, a central processing unit (CPU) and a memory 2120 in which a Software is stored, and a speaker 2130. The left hand notes layout key 2110 includes four to six rows of buttons and/or two rows of buttons. The input of the CPU and the memory 2120 is a channel for importing data from the left hand notes layout key 2110 to the central processing unit (CPU) and a memory 2120 using a wire or a cable or circuit on board (main board or mother board). The CPU (controller) and Software 2120 constitute a core of the electronic accordion 2100 to process the data input from the left hand notes layout key 2110. The CPU (controller) 2120 will process the data by the Software 2120 to analyze the data from the left hand notes layout key 2110. Flash drive 2140 is an external device that has a sound data to connect with the electronic accordion 2100 by USB port (Universal Serial Bus). The Speaker 2130 produces sound from a signal which is transferred from the CPU (controller) 2120.

When the CPU (controller) 2120 has already analyzed the data by the Software 2120, the CPU (controller) 2120 will select a sound from the Flash drive 2140. If the accordionist would like to change the note sound, the accordionist can change the note sound by the CPU 2120.

Figure 22:
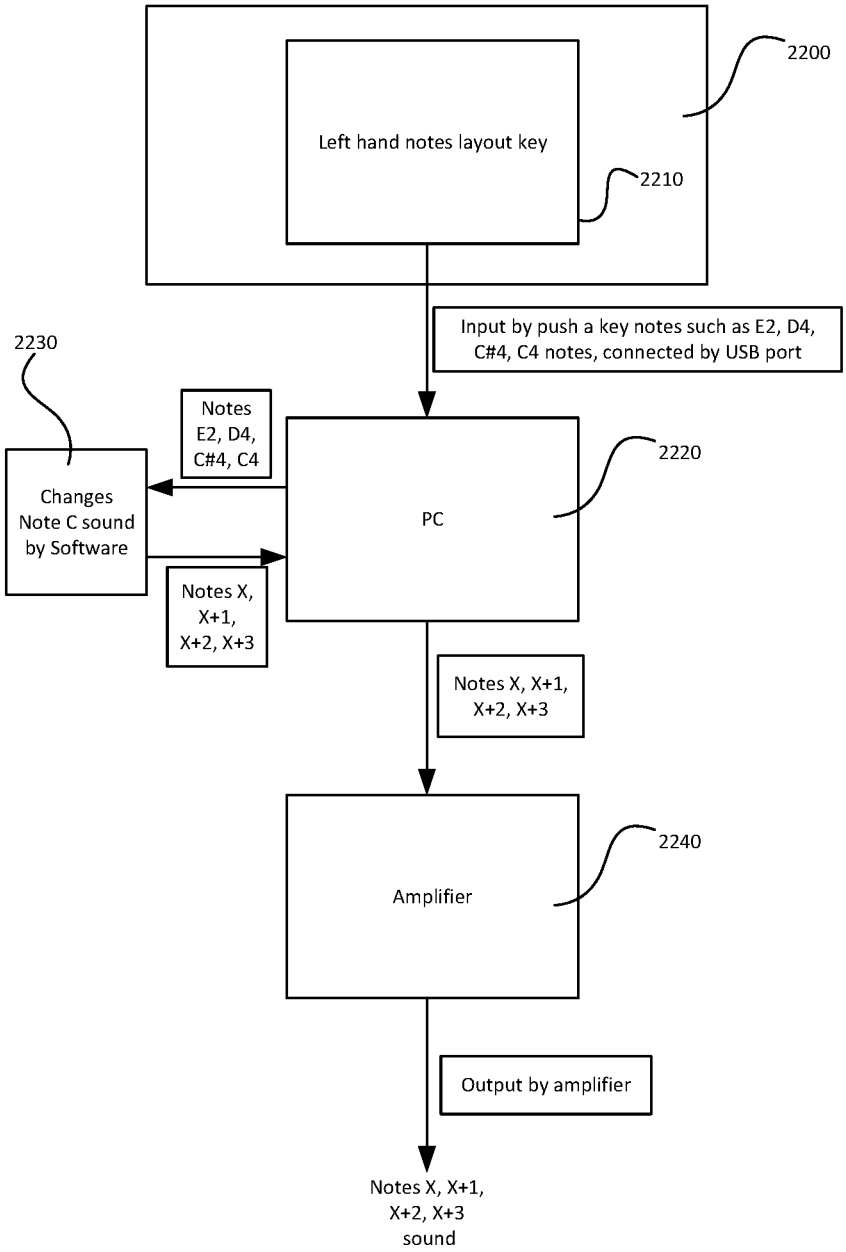
FIG. 22 is a diagram illustrating an example of an electronic accordion process is connected with a personal computer.

FIG. 22 illustrates a block diagram of an embodiment of an electronic accordion 2200 and a personal computer (PC) 2220. As shown in the drawing, the electronic accordion 2200 is connected to a personal computer (PC) 2220. The electronic accordion 2200 includes a left hand notes layout key 2210. The personal computer (PC) 2220 includes a Software 2230 installed in the personal computer (PC) 2220 and an amplifier 2240. The input of the PC 2220 is a channel for importing data from the left hand notes layout key 2210 of the electronic accordion 2200 to a USB port (Universal Serial Bus) of the PC 2220 via a wire or a cable. The PC 2220 is a general-purpose computer which is intended to be operated directly by an end-user with no intervening computer operator. The Software 2230 (a computer program product) is a collection of instructions that enable the user to interact with the computer to perform specific tasks for the PC 2220 to process the data input from the left hand notes layout key 2210. The PC 2220 will process the data by the Software 2230 to analyze the data input from the left hand notes layout key 2210 of the electronic accordion 2200.

The Software 2230 (computer program) is configured to cause the PC 2220 (CPU) to perform operation of assigning a plurality of pitches to the buttons of left hand play side of the electronic accordion 2200 such that the note layout pattern of the electronic accordion 2200 becomes as the note layout patterns described in FIG. 6 through FIG. 14. That is, the software 2230 is configured to cause the PC 2220 to assign a plurality of pitches to the buttons of left hand play side as well as an performing an assigning process executed by the CPU 2020. The Amplifier 2240 is configured to increase the voltage, current, or power of the electrical signal, e.g., produced sound, which is transferred from the PC 2220. When the PC 2220 has already analyzed the data by the Software 2230, the PC 2220 will select a sound from the Software 2230. If the accordionist would like to change the note sound, the accordionist can change the note sound by the PC 2220.

What is claimed is:

1. An accordion comprising:

a right hand play side;

a left hand play side;

a bellow provided between the right hand play side and the left hand play side; and a plurality of columns of buttons are provided on at least one of the right hand play side and the left hand play side, wherein:

(a) each of the plurality of columns has at least three buttons to which three single pitches are assigned, the three single pitches constituting a triad major chord; and (b) said plurality of columns of buttons consist of single note buttons and/or double note buttons only; and (c) a circle of fourth and a circle of fifths comprise a spiral path while moving either up or down a scale where a pitch of a starting scale or a pitch of an ending scale are different alongside said spiral path; and (d) each button of said plurality of columns of buttons do not follow a chromatic scale.

2. The accordion according to claim 1, wherein:

the plurality of columns includes at least eight columns having a first column to an eighth column, and the first column to the eighth column has first three buttons to eighth three buttons, to which first three single pitches to eighth three single pitches are assigned, the first three single pitches to the eighth three single pitches constituting a first triad major chord to an eighth major chord, wherein:

the first triad major chord to the eighth triad major chord include a first root pitch to an eighth root pitch, the first root pitch to the eighth root pitch are different pitches from each other.

3. The accordion according to claim 2, wherein each of the first column to the eighth column further has a button to which chord pitches are assigned, each of the chord pitches of the first column to the eighth column being a major eighth (an octave) pitch from each of the first root pitch to the eighth root pitch.

4. The accordion according to claim 2, wherein each of the first column to the eighth column further has a button to which chord pitches are assigned, each of the chord pitches of the first column to the eighth column being a minor third pitch from each of the first root pitch to the eighth root pitch.

5. The accordion according to claim 2, wherein each of the first column to the eighth column further has a button to which chord pitches are assigned, each of the chord pitches of the first column to the eighth column being a major tenth pitch from each of the first root pitch to the eighth root pitch.

6. The accordion according to claim 2, wherein each of the first column to the eighth column further has a button to which chord pitches are assigned, each of the chord pitches having each of the first root pitch to the eighth root pitch, a major third pitch from each of the first root pitch to the eighth root pitch, and a perfect fifth pitch from each of the first root pitch to the eighth root pitch.

7. The accordion according to claim 2, wherein each of the first column to the eighth column further has a button to which chord pitches are assigned, each of the chord pitches having each of the first root pitch to the eighth root pitch, and $3^{rd}$ and $5^{th}$ of major chord (excluding the root) pitch from each of the first root pitch to the eighth root pitch.

8. The accordion according to claim 2, wherein each of the first column to the eighth column further has a button to which chord pitches are assigned, each of the chord pitches having each of the first root pitch to the eighth root pitch, and a $1^{st}$ and $3^{rd}$ of minor chord pitch from each of the first root pitch to the eighth root pitch.

9. The accordion according to claim 2, wherein each of the first column to the eighth column further has a button to which chord pitches are assigned, each of the chord pitches having each of the first root pitch to the eighth root pitch, and a $1^{st}$ and $3^{rd}$ of major chord (excluding the $5^{th}$ root) pitch from each of the first root pitch to the eighth root pitch.

10. The accordion according to claim 2, wherein each of the first column to the eighth column further has a button to which chord pitches are assigned, each of the chord pitches having each of the first root pitch to the eighth root pitch, and a minor $7^{th}$ pitch combined with a $5^{th}$ of root pitch from each of the first root pitch to the eighth root pitch.

11. The accordion according to claim 2, wherein each of the first column to the eighth column further has a button to which chord pitches are assigned, each of the chord pitches having each of the first root pitch to the eighth root pitch, and a minor $7^{th}$ pitch combined with a root pitch from each of the first root pitch to the eighth root pitch.

12. The accordion according to claim 2, wherein the first root pitch to the eighth root pitch are assigned in line in a direction substantially orthogonal to an expansion and contraction direction of the bellow.

13. The accordion according to claim 12, wherein the first root pitch to the eighth root pitch are assigned such that adjacent pitches of the first root pitch to the eighth root pitch become perfect fifth pitches from each other.

14. The accordion according to claim 1, wherein the plurality of columns of buttons are arranged in lines in a direction substantially parallel to an expansion and contraction direction of the bellow.

15. An electronic accordion comprising:

a right hand play side;

a left hand play side;

a bellow provided between the right hand play side and the left hand play side;

a plurality of columns of buttons provided on at least one of the right hand play side and the left hand play side; and a controller configured to execute:

assigning three single pitches to at least three buttons of each of the plurality of columns, the three single pitches constituting a triad major chord;

wherein:

(a) said plurality of columns of buttons consist of single note buttons and/or double note buttons only; and (b) a circle of fourth and a circle of fifths comprise a spiral path while moving either up or down a scale where a pitch of a starting scale or a pitch of an ending scale are different alongside said spiral path; and (c) each button of said plurality of columns of buttons do not follow a chromatic scale.

16. The electronic accordion according to claim 15, wherein:

the plurality of columns includes at least a first column to an eighth column, and the controller is further configured to execute:

assigning first three single pitches to eighth three single pitches to first three buttons to eighth three buttons of the first column to the eighth column, the first three single pitches to the eighth three single pitches constituting a first triad major chord having a first root pitch to an eighth major chord having an eighth root pitch, the first root pitch to the eighth root pitch being different pitches from each other.

17. The electronic accordion according to claim 16, wherein the controller is further configured to execute:

assigning chord pitches to a button of each of the first column to the eighth column, each of the single pitch of the first column to the eighth column being a major eighth (an octave) pitch from each of the first root pitch to the eighth root pitch.

18. The electronic accordion according to claim 16, wherein the controller is further configured to execute:

assigning chord pitches to a button of each of the first column to the eighth column, each of the single pitch of the first column to the eighth column being a minor third pitch from each of the first root pitch to the eighth root pitch.

19. The electronic accordion according to claim 16, wherein the controller is further configured to execute:

assigning chord pitches to a button of each of the first column to the eighth column, each of the single pitch of the first column to the eighth column being a major tenth pitch from each of the first root pitch to the eighth root pitch.

20. The electronic accordion according to claim 16, wherein the controller is further configured to execute:

assigning chord pitches to a button of each of the first column to the eighth column, each of the chord pitches of the first column to the eighth column having each of the first root pitch to the eighth root pitch, a major third pitch from each of the first root pitch to the eighth root pitch, and a perfect fifth pitch from each of the first root pitch to the eighth root pitch.

21. The electronic accordion according to claim 16, wherein the controller is further configured to execute:

assigning chord pitches to a button of each of the first column to the eighth column, each of the chord pitches of the first column to the eighth column having each of the first root pitch to the eighth root pitch, a major third pitch from each of the first root pitch to the eighth root pitch, and a $3^{rd}$ and $5^{th}$ of major chord (excluding the root) pitch from each of the first root pitch to the eighth root pitch.

22. The electronic accordion according to claim 16, wherein the controller is further configured to execute:

assigning chord pitches to a button of each of the first column to the eighth column, each of the chord pitches of the first column to the eighth column having each of the first root pitch to the eighth root pitch, a major third pitch from each of the first root pitch to the eighth root pitch, and $1^{st}$ and $3^{rd}$ of minor chord pitch from each of the first root pitch to the eighth root pitch.

23. The electronic accordion according to claim 16, wherein the controller is further configured to execute:

assigning chord pitches to a button of each of the first column to the eighth column, each of the chord pitches of the first column to the eighth column having each of the first root pitch to the eighth root pitch, a major third pitch from each of the first root pitch to the eighth root pitch, and $1^{st}$ and $3^{rd}$ of major chord (excluding the $5^{th}$ root) pitch from each of the first root pitch to the eighth root pitch.

24. The electronic accordion according to claim 16, wherein the controller is further configured to execute:

assigning chord pitches to a button of each of the first column to the eighth column, each of the chord pitches of the first column to the eighth column having each of the first root pitch to the eighth root pitch, a major third pitch from each of the first root pitch to the eighth root pitch, and a minor $7^{th}$ pitch combined with a $5^{th}$ of root pitch from each of the first root pitch to the eighth root pitch.

25. The electronic accordion according to claim 16, wherein the controller is further configured to execute:

assigning chord pitches to a button of each of the first column to the eighth column, each of the chord pitches of the first column to the eighth column having each of the first root pitch to the eighth root pitch, a major third pitch from each of the first root pitch to the eighth root pitch, and a minor $7^{th}$ pitch combined with a root pitch from each of the first root pitch to the eighth root pitch.

26. The electronic accordion according to claim 16, wherein the controller is further configured to execute:

assigning the first root pitch to the eighth root pitch such that the first root pitch to the eighth root pitch are in line in a direction substantially orthogonal to an expansion and contraction direction of the bellow.

27. The electronic accordion according to claim 26, wherein the controller is further configured to execute:

assigning the first root pitch to the eighth root pitch such that adjacent pitches of the first root pitch to the eighth root pitch become perfect fifth pitches from each other.

28. The electronic accordion according to claim 15, wherein the plurality of columns of buttons are arranged in lines in a direction substantially parallel to an expansion and contraction direction of the bellow.

* * * * *